US012286868B2

(12) United States Patent
Becker

(10) Patent No.: US 12,286,868 B2
(45) Date of Patent: Apr. 29, 2025

(54) WELL PRODUCTION METHODS AND TUBING SYSTEMS

(71) Applicant: DUCON—BECKER SERVICE TECHNOLOGY, LLC., Ventura, CA (US)

(72) Inventor: Billy G. Becker, Ventura, CA (US)

(73) Assignee: DUCON—BECKER SERVICE TECHNOLOGY, LLC., Ventura, CA (US)

( * ) Notice: Subject to any disclaimer, the term of this patent is extended or adjusted under 35 U.S.C. 154(b) by 353 days.

(21) Appl. No.: 17/437,577

(22) PCT Filed: Mar. 23, 2020

(86) PCT No.: PCT/US2020/024230

§ 371 (c)(1),
(2) Date: Sep. 9, 2021

(87) PCT Pub. No.: WO2020/198149

PCT Pub. Date: Oct. 1, 2020

(65) Prior Publication Data

US 2022/0154561 A1 May 19, 2022

Related U.S. Application Data

(60) Provisional application No. 62/856,445, filed on Jun. 3, 2019, provisional application No. 62/824,392, filed on Mar. 27, 2019.

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS 2,478,483 A * 8/1949 Hartman ..... E21B 43/123 417/117
2,678,605 A * 5/1954 Tappmeyer ..... E21B 43/122 166/54.1

(Continued)

FOREIGN PATENT DOCUMENTS

GB 2479432 A * 10/2011 ..... E21B 43/00

OTHER PUBLICATIONS

International Search Report / Written Opinion dated Jun. 22, 2020 in related/corresponding PCT Application No. PCT/US2020/024230.

(Continued)

*Primary Examiner* — Crystal J Lee
(74) *Attorney, Agent, or Firm* — Morgan, Lewis & Bockius LLP

(57) ABSTRACT

A method for artificial gas lift of a fluid from a well includes lowering a tubing system into the well, wherein the tubing system includes an inner tubular string, and an outer tubular string disposed concentrically around the inner tubular string; based on a flow amount of the fluid from the well, selecting an artificial gas lift process; reconfiguring the tubing system, while in the well, to implement the selected artificial gas lift process; and lifting the fluid to the surface with the selected artificial gas lift process.

18 Claims, 34 Drawing Sheets

(56) References Cited

U.S. PATENT DOCUMENTS

| | | | | |
|---|---|---|---|---|
| 3,065,807 | A * | 11/1962 | Wells | E21B 17/18 166/241.1 |
| 3,216,512 | A * | 11/1965 | Grable | E21B 21/01 175/171 |
| 3,489,438 | A | 1/1970 | McClure | |
| 3,664,441 | A | 5/1972 | Carey | |
| 3,786,878 | A | 1/1974 | Chapman | |
| 3,943,618 | A | 3/1976 | Perkins | |
| 4,067,596 | A | 1/1978 | Kellner et al. | |
| 4,100,981 | A | 7/1978 | Chaffin | |
| 4,149,739 | A | 4/1979 | Morris | |
| 4,997,048 | A | 3/1991 | Isom | |
| 5,139,090 | A | 8/1992 | Land | |
| 5,775,736 | A | 7/1998 | Svetlik | |
| 5,806,598 | A | 9/1998 | Amani | |
| 5,911,278 | A | 6/1999 | Reitz | |
| 6,179,056 | B1 * | 1/2001 | Smith | E21B 43/128 166/313 |
| 6,305,476 | B1 | 10/2001 | Knight | |
| 7,134,514 | B2 | 11/2006 | Riel et al. | |
| 8,539,976 | B1 | 9/2013 | Rodgers, Jr. et al. | |
| 8,777,273 | B2 | 7/2014 | Syse et al. | |
| 9,453,398 | B1 * | 9/2016 | Zhang | E21B 43/123 |
| 10,718,457 | B2 | 7/2020 | Haynes et al. | |
| 2003/0164240 | A1 | 9/2003 | Vinegar et al. | |
| 2004/0182437 | A1 | 9/2004 | Messick | |
| 2005/0061369 | A1 | 3/2005 | De Almeida | |
| 2006/0137881 | A1 * | 6/2006 | Schmidt | E21B 43/123 166/372 |
| 2006/0283606 | A1 | 12/2006 | Partouche et al. | |
| 2007/0227739 | A1 | 10/2007 | Becker et al. | |
| 2007/0235197 | A1 * | 10/2007 | Becker | E21B 43/123 166/372 |
| 2011/0067883 | A1 | 3/2011 | Falk et al. | |
| 2011/0259597 | A1 | 10/2011 | Bjerke | |
| 2014/0041863 | A1 | 2/2014 | Dowling et al. | |
| 2014/0069659 | A1 * | 3/2014 | Wang | E21B 43/123 166/321 |
| 2014/0179448 | A1 | 6/2014 | Collins et al. | |
| 2014/0284065 | A1 | 9/2014 | Fraignac et al. | |
| 2015/0315869 | A1 | 11/2015 | Landry | |
| 2017/0343986 | A1 * | 11/2017 | Zhang | E21B 43/123 |
| 2017/0370162 | A1 | 12/2017 | Carrois et al. | |
| 2018/0320492 | A1 | 11/2018 | Shen et al. | |
| 2019/0376369 | A1 | 12/2019 | Daniel et al. | |
| 2020/0318452 | A1 | 10/2020 | Becker et al. | |

OTHER PUBLICATIONS

International Search Report and Written Opinion dated dated Feb. 4, 2020, in related/corresponding PCT Application No. PCT/US2019/054387.

International Preliminary Report on Patentability, PCT/US2019/054387, dated Aug. 10, 2021.

International Search Report and Written Opinion dated Jun. 22, 2020, in related/corresponding PCT Application No. PCT/US2020/024247.

International Preliminary Report on Patentability, PCT/US2020/024247, dated Sep. 28, 2021.

International Preliminary Report on Patentability, PCT/US2020/024230, dated Sep. 28, 2021.

* cited by examiner

WELL PRODUCTION METHODS AND TUBING SYSTEMS

BACKGROUND

Technical Field

Embodiments of the subject matter disclosed herein generally relate to artificial gas lift systems and methods, and more specifically, to a tubing system and associated lift method that allows well production for the entire life of the well.

Discussion of the Background

After a well is drilled to a desired depth relative to the surface, and a casing protecting the wellbore is installed, cemented in place, and perforated for connecting the wellbore to the subterranean formation, it is time to extract the oil and/or gas and/or any other fluid from the formation. Although the discussions herein are focused on lifting oil from the well, those skilled in the art would understand that the methods discussed herein are applicable to lifting any fluid from an underground reservoir. At the beginning of the well's life, the pressure of the oil and/or gas from the subterranean formation is usually high enough so that the oil flows out unassisted to the head of the well to the surface. Thus, for this stage of the well production, no additional pressure assistance is typically needed to bring the oil to the surface. This first phase of the life of the well is called herein the Natural Flow phase.

However, the fluid pressure of the formation decreases over time to such a level that the hydrostatic pressure of the column of fluid in the well becomes equal to or larger than the pressure inside the subterranean formation. In this case, the oil will stop flowing to the surface of the well. The well enters now the second phase of its life, when external energy is necessary for bringing the oil to the surface. For example, an artificial gas lift method may to be used to recover the oil and/or gas from the well. Thus, artificial gas lift is necessary for the well to maximize recovery of oil/gas.

The artificial gas lift method is typically characterized by having a single production tubing 110 lowered into the casing 102 of the well 101, as shown in FIG. 1. The artificial gas lift method and associated production tubing are able to work in both low and high fluid rate applications. This method works across a wide range of well depths. The external energy introduced to the system 100 for lifting the oil and/or gas is typically added by a surface gas compressor 104, which is driven by a natural gas fueled engine. There can be single or multiple injection ports used along the vertical profile of the production tubing (or tubing string) for the high pressure gas lift gas to enter the production tubing. Multiple injection valves 112A, 1128 receive the gas supplied by the compressor 104 into the annulus C, and then they discharge the compressed gas at corresponding ports into the annulus A of the production tubing 110, to reduce the hydrostatic gradient pressure required to start production from an idle well. However, this method introduces multiple potential leak points that impact its reliability. Note that although A represents the bore of the production tubing 110, those skilled in the art use the term "annulus A" when referring to this specific bore. For this reason, the term annulus A is used herein to refer to bore A. FIG. 1 also shows a formation 116 from which oil 114 enters into the casing 102, through holes 118 made into the casing. Single injection ports (including lifting around open-ended production tubing) are simpler and more reliable, but require higher lift gas pressures to start the production from an idle well.

The gas lift method works by having the injected lift gas mixing with the reservoir fluids inside the production tubing and reducing the effective density of the fluid column. Gas expansion of the lift gas also plays a role in keeping flow rates above the critical flow velocities to push the fluids to the surface. For this method, the reservoir needs to have sufficient remaining energy to flow oil and gas into the inside of the production tubing and overcome the flowing gas lift pressures being created inside the production tubing. The ultimate abandonment pressure associated with conventional gas lift methods and apparatus is materially higher than other methods such as rod or beam pumping, which are now discussed.

Another method for pumping the fluid from inside the well to the surface is the Rod or Beam pumping, which typically produces the lowest abandonment pressure of any artificial lift method and ends up being the "end of life" choice to produce an oil well through to its economic limit. Rod pumping is characterized by the installation of the production tubing, sucker rods and a downhole pump. Rod or Beam Pumping works in low to medium rate applications and from shallow to intermediate well depths. Another lifting process uses an Electrical Submersible Pump (ESP) to pump the fluid from the well, or a Hydraulic Piston Pump, or a Hydraulic Jet Pump (HJP), or a Plunger Lift, or a Progressive Cavity Pump (PCP), etc.

However, most of the above methods share the same drawback, which is now discussed. There is no single method for bringing the oil to the surface for the entire life of a well. As the formation pressure decreases, a first method used for lifting the oil needs to be changed to a second method, which is more appropriate for the lower pressure of the oil in the well. As the pressure of the formation further decreases, a third method may be necessary to continue to fully produce the well. Any such change presently requires to take the entire production tubing out of the well and change one or more artificial lift methods/pumps associated with the production tubing. This is a very time consuming procedure and requires extensive work, which is undesirable. Further, during these changes, there is no oil production, which makes the entire process more expensive.

Thus, there is a need to provide a tubing system and method that overcome the above noted problems and offer to the operator of the well a much simplified and economical way to extract the oil during the entire life of the well.

SUMMARY

According to an embodiment, there is a method for artificial gas lift of a fluid from a well. The method includes lowering a tubing system into the well, wherein the tubing system includes an inner tubular string, and an outer tubular string disposed concentrically around the inner tubular string; based on a flow amount of the fluid from the well, selecting an artificial gas lift process; reconfiguring the tubing system, while in the well, to implement the selected artificial gas lift process; and lifting the fluid to the surface with the selected artificial gas lift process.

According to another embodiment, there is a method for artificial gas lift oil from a well. The method includes lowering a tubing system into the well, wherein the tubing system has an annulus A, an annulus B concentric to the annulus A, and an annulus C, formed between the tubing system and the well; seating a first valve into a joint pipe mandrel, which is integrated in the tubing system, the first valve being configured to direct a pressured gas from annulus B to annulus C for annular lifting of the oil; and replacing the first valve with a second valve into the joint pipe mandrel, the second valve being configured to direct the pressured gas from annulus B to annulus A for tubing lifting of the oil.

According to yet another embodiment, there is a method for artificial gas lift oil from a well, and the method includes installing, with no packer, a dual, concentric, tubing system into the well; lowering, through the dual, concentric, tubing system, a valve; pumping a pressured gas into a first annulus of the dual, concentric, tubing system; and directing the pressured gas from the first annulus, through the valve, into a second annulus or a third annulus, depending of the lowered valve.

According to another embodiment, there is a method for artificial gas lift of a fluid from a well, and the method includes, based on a flow amount of the fluid from the well, selecting an artificial gas lift process; and reconfiguring a tubing system, while in the well, to implement the selected artificial gas lift process, where the tubing system includes an inner tubular string, and an outer tubular string disposed concentrically around the inner tubular string.

According to yet another embodiment, there is a tubing system for lifting a fluid from a well, and the tubing system includes an inner tubular string; an outer tubular string disposed concentrically around the inner tubular string; a joint pipe mandrel having an inner pipe and an outer pipe; and a chamber pump. The inner pipe and the outer pipe of the joint pipe mandrel attach simultaneously to the inner and outer tubular strings, respectively, by a single rotational motion.

According to another embodiment, there is a tubing system for lifting a fluid from a well, and the tubing system includes plural joint pipe elements that form a single annulus A and a single annulus B when connected to each other, where the annulus A is fluidly insulated from the annulus B; a joint pipe mandrel integrated with the plural joint pipe elements; and a chamber pump connected to a distal joint pipe element of the plural joint pipe elements, where the chamber pump is attached to the distal joint pipe element with a single rotational motion so that both annuli A and B are extended through the chamber pump.

According to still another embodiment, there is an upper standing valve that closes an upper end of an accumulation chamber used to lift a fluid from a well, and the upper standing valve includes a body extending along a longitudinal axis and having a bore; a ball located in the bore for blocking a fluid flow in one direction but not in an opposite direction; an external seal; and a bleeding passage formed in a wall of the body and configured to fluidly connect the bore to an exterior of the body.

In still another embodiment, there is a tubing system for lifting a fluid from a well, and the tubing system includes an inner tubular string; an outer tubular string disposed concentrically around the inner tubular string; and a joint pipe mandrel having an inner pipe and an outer pipe. The inner pipe and the outer pipe of the joint pipe mandrel attach simultaneously to the inner and outer tubular strings, respectively, by a single rotational motion.

According to another embodiment, there is a joint pipe mandrel to be integrated into a tubing system for lifting oil from a well. The joint pipe mandrel includes an inner conduit extending along a longitudinal axis X and having an annulus A; an outer conduit that extends along the longitudinal axis X and is located around the inner conduit so that an annulus B is formed between the inner conduit and the outer conduit; and a side pocket attached to the inner conduit and located in the annulus B.

According to yet another embodiment, there is a chamber pump for lifting a fluid to the surface, from a well, the chamber pump including a gas submersible pump mandrel and an accumulation chamber attached to the gas submersible pump mandrel. The gas submersible pump mandrel has dual concentric pipes at an upstream end.

BRIEF DESCRIPTION OF THE DRAWINGS

The accompanying drawings, which are incorporated in and constitute a part of the specification, illustrate one or more embodiments and, together with the description, explain these embodiments. In the drawings.

Figure 8:
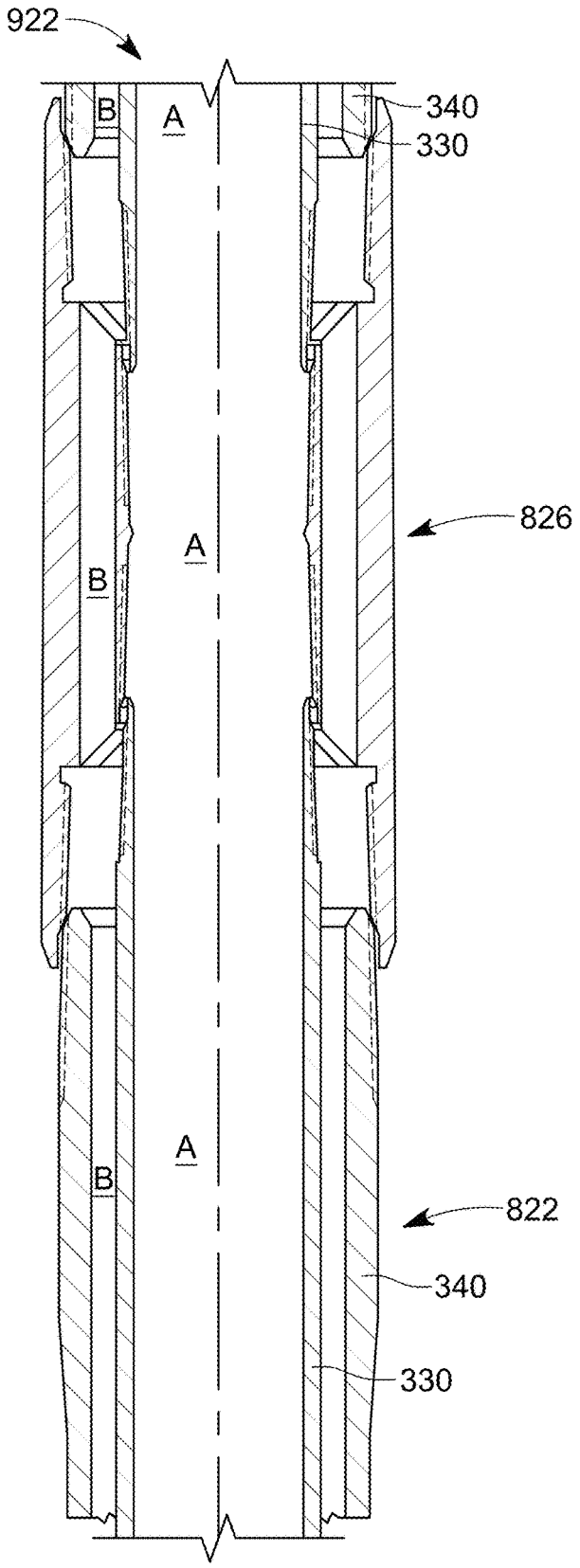
Figure 9:
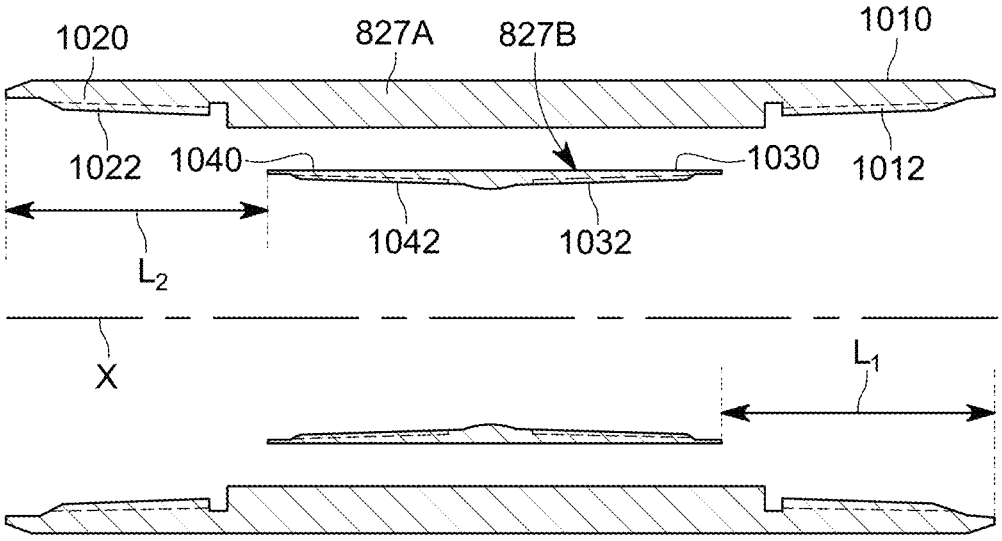
Figure 10:
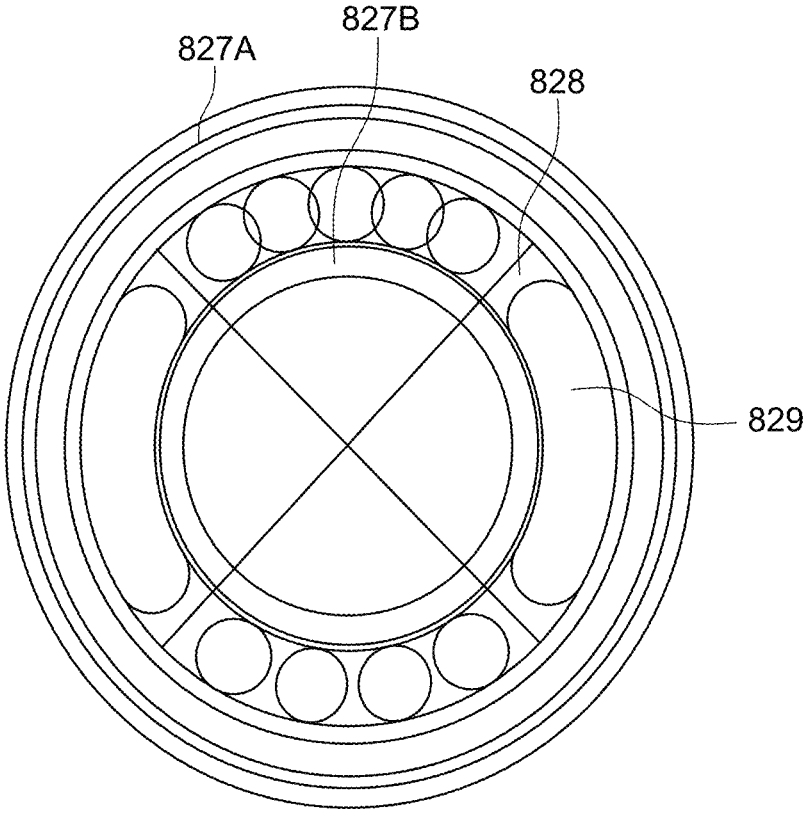
Figure 11:
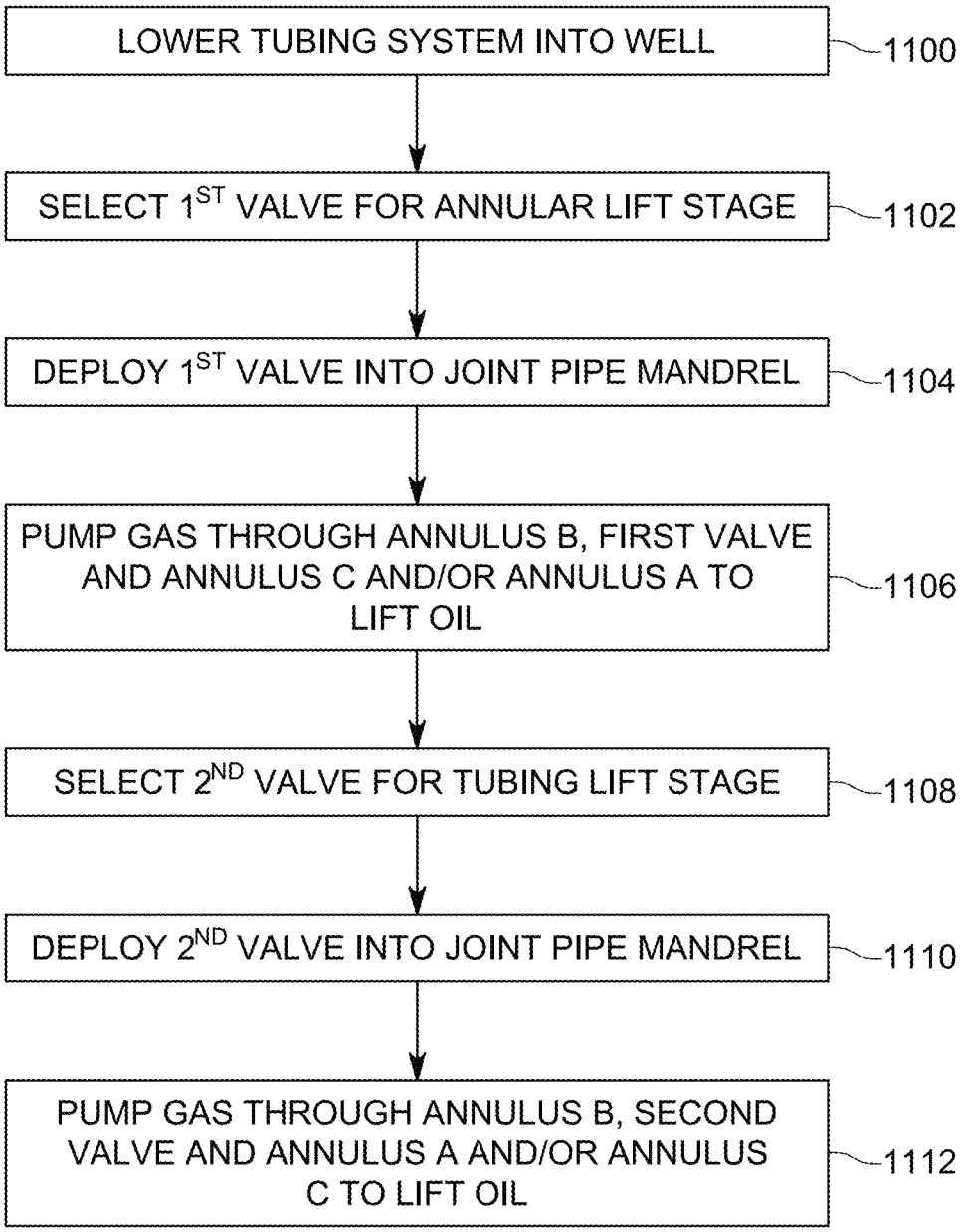
Figure 12:
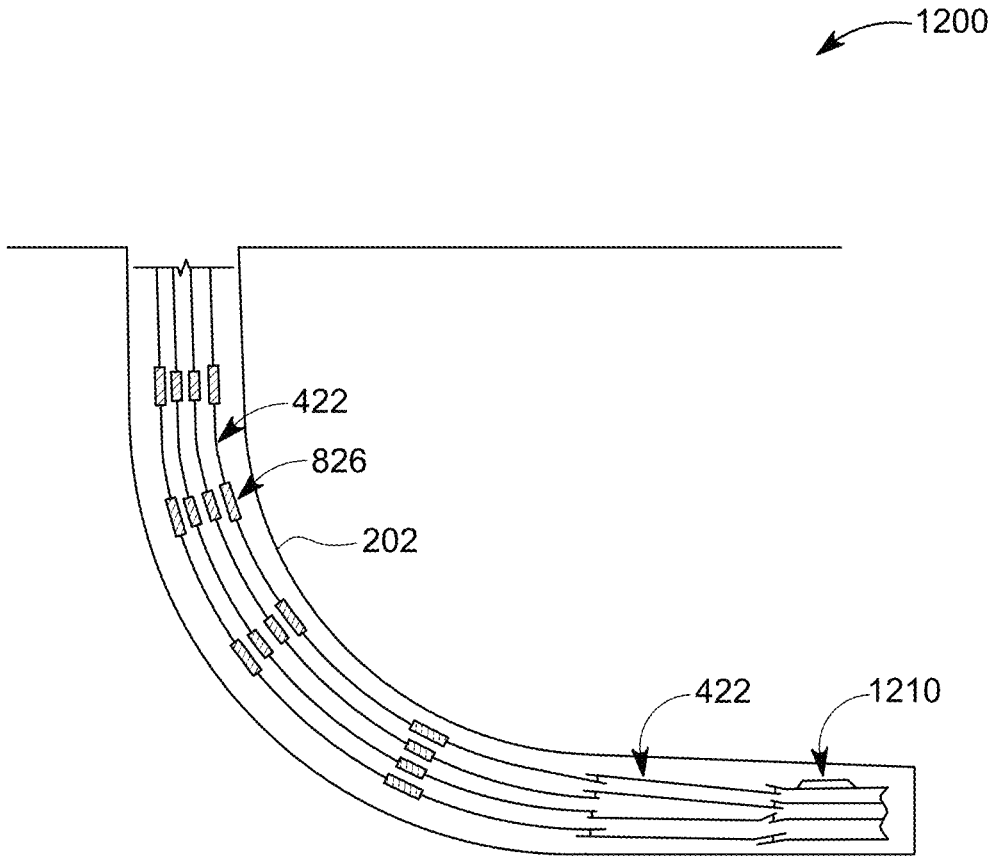
Figure 13:
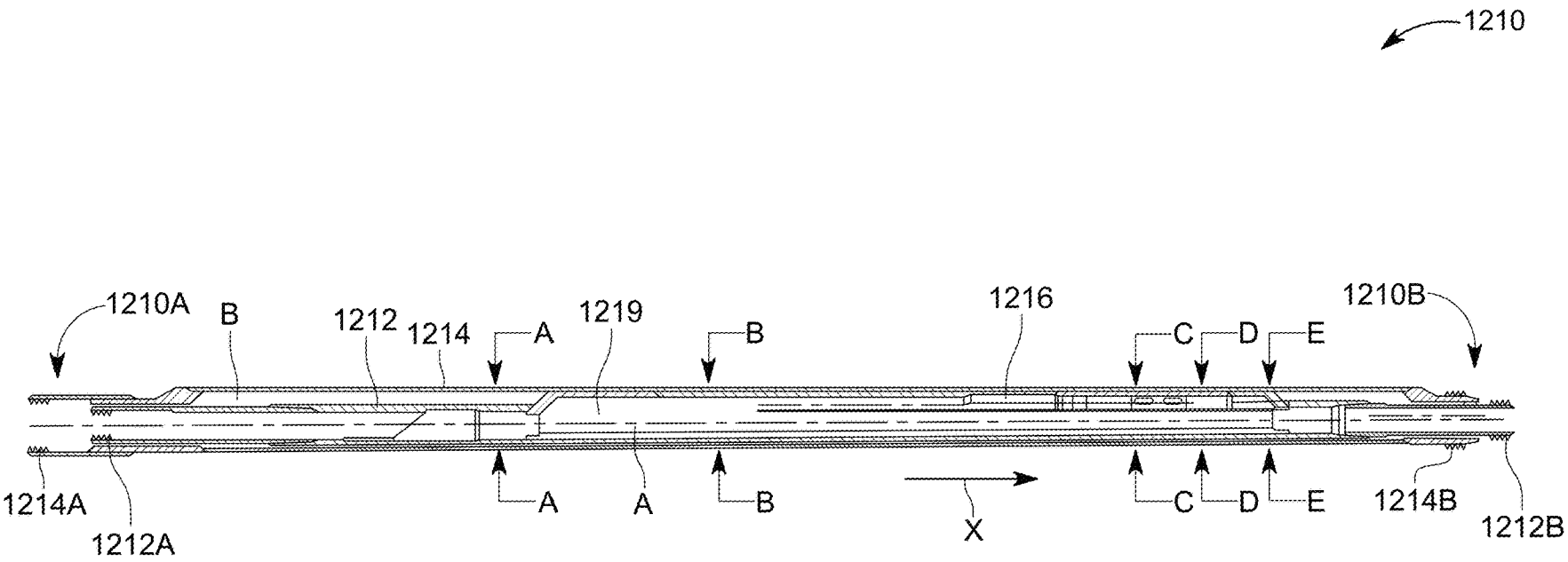
Figure 15:
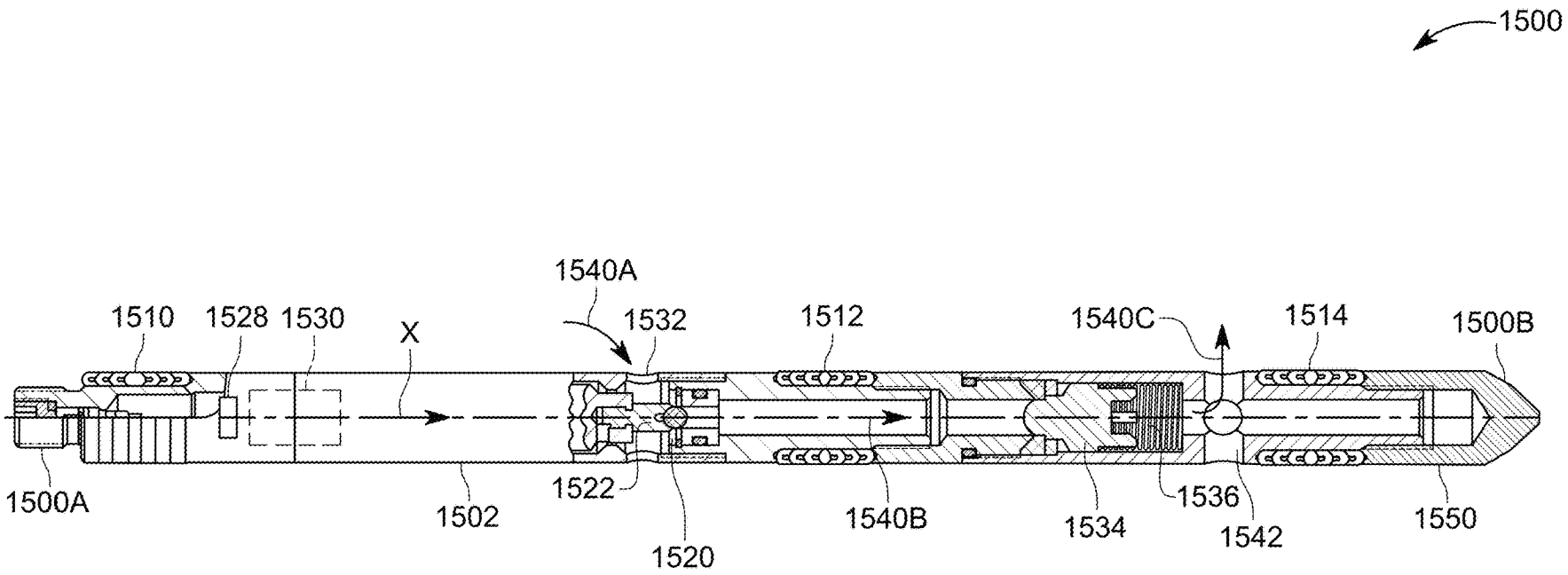
Figure 16:
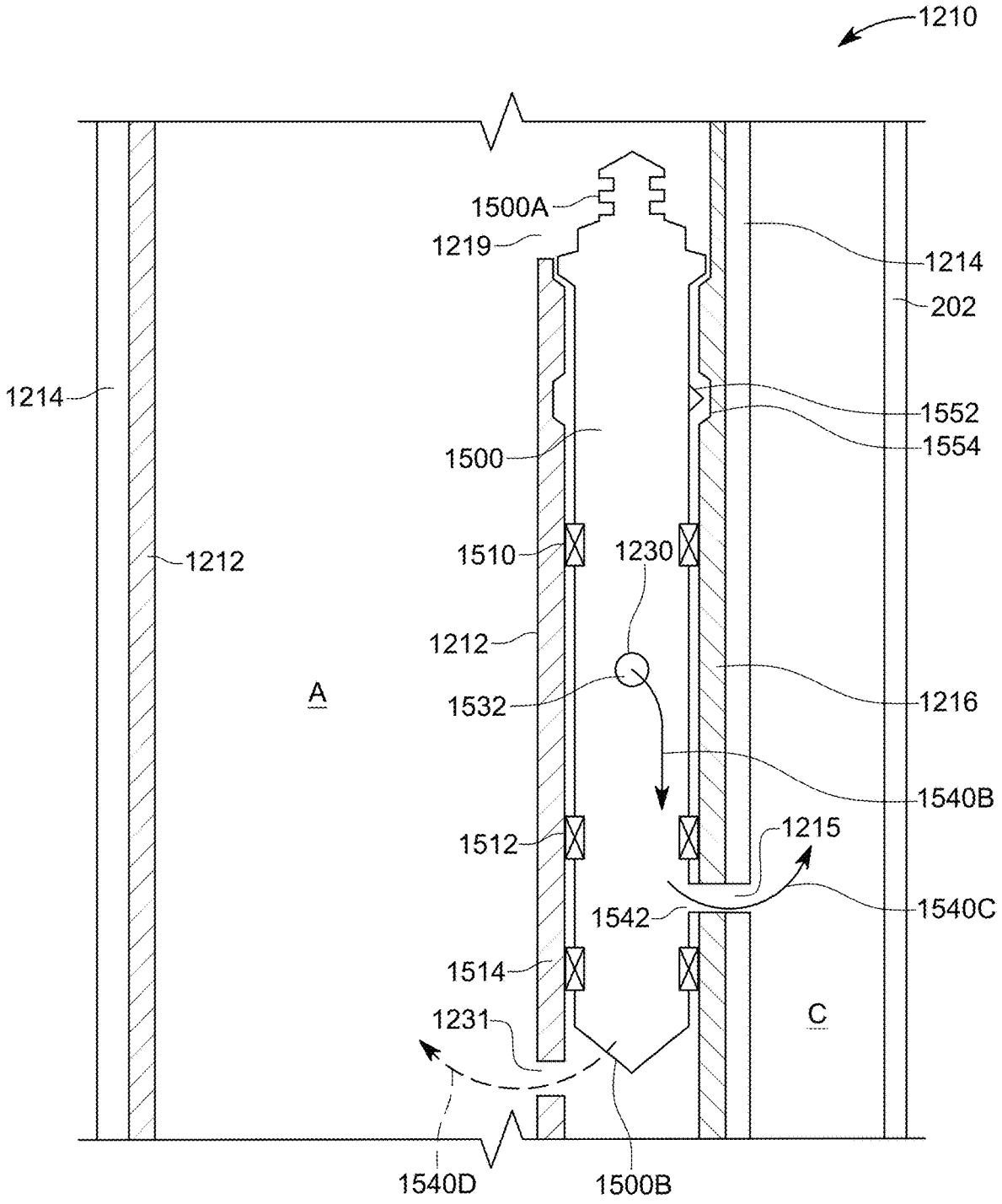
Figure 17A:
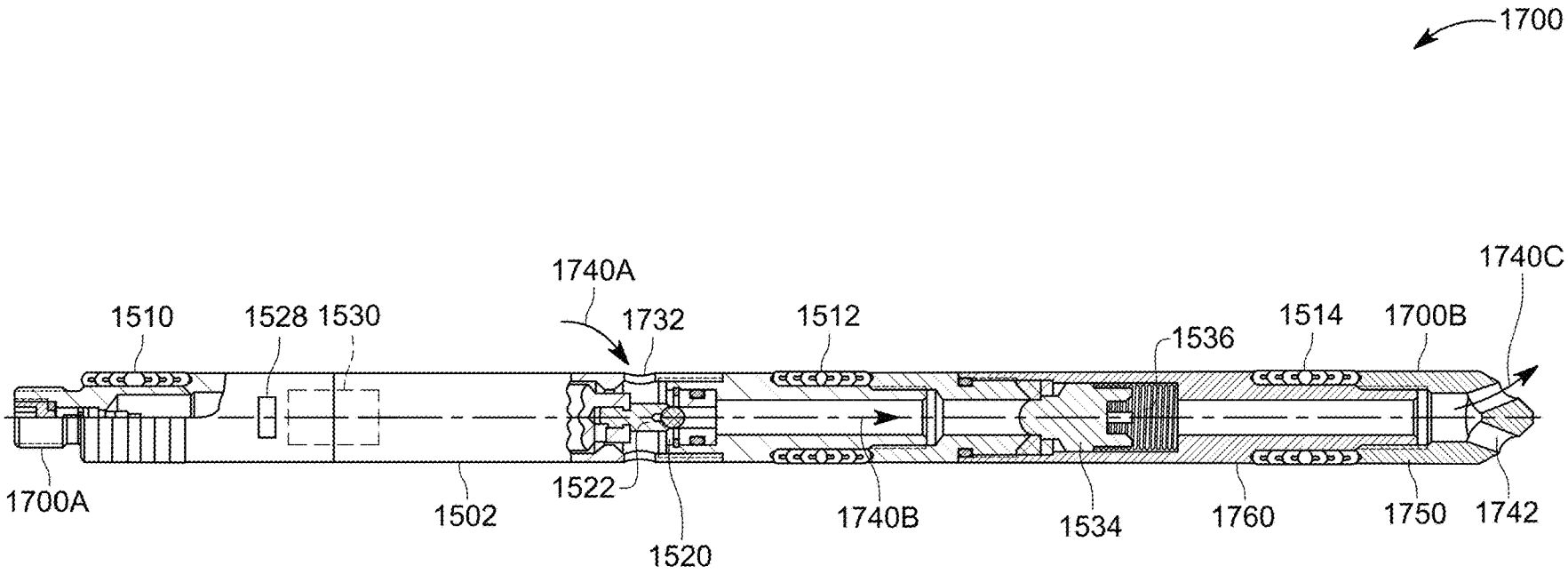
Figure 17B:
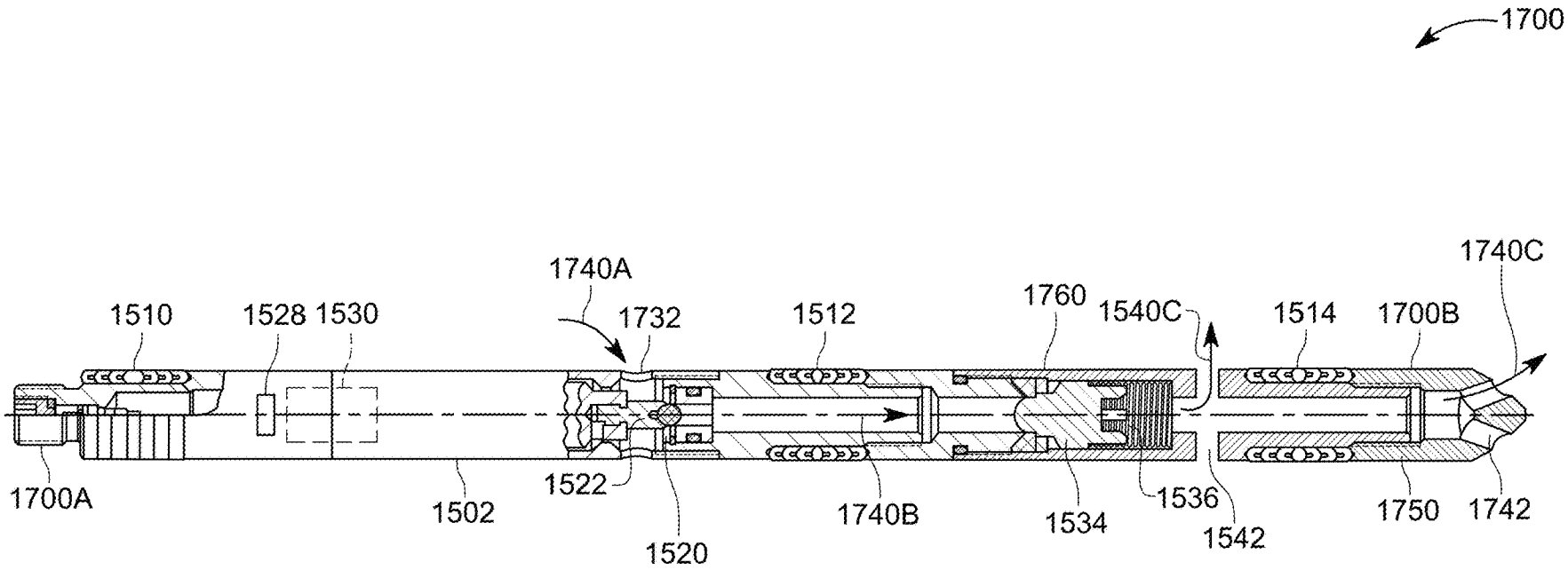
Figure 18:
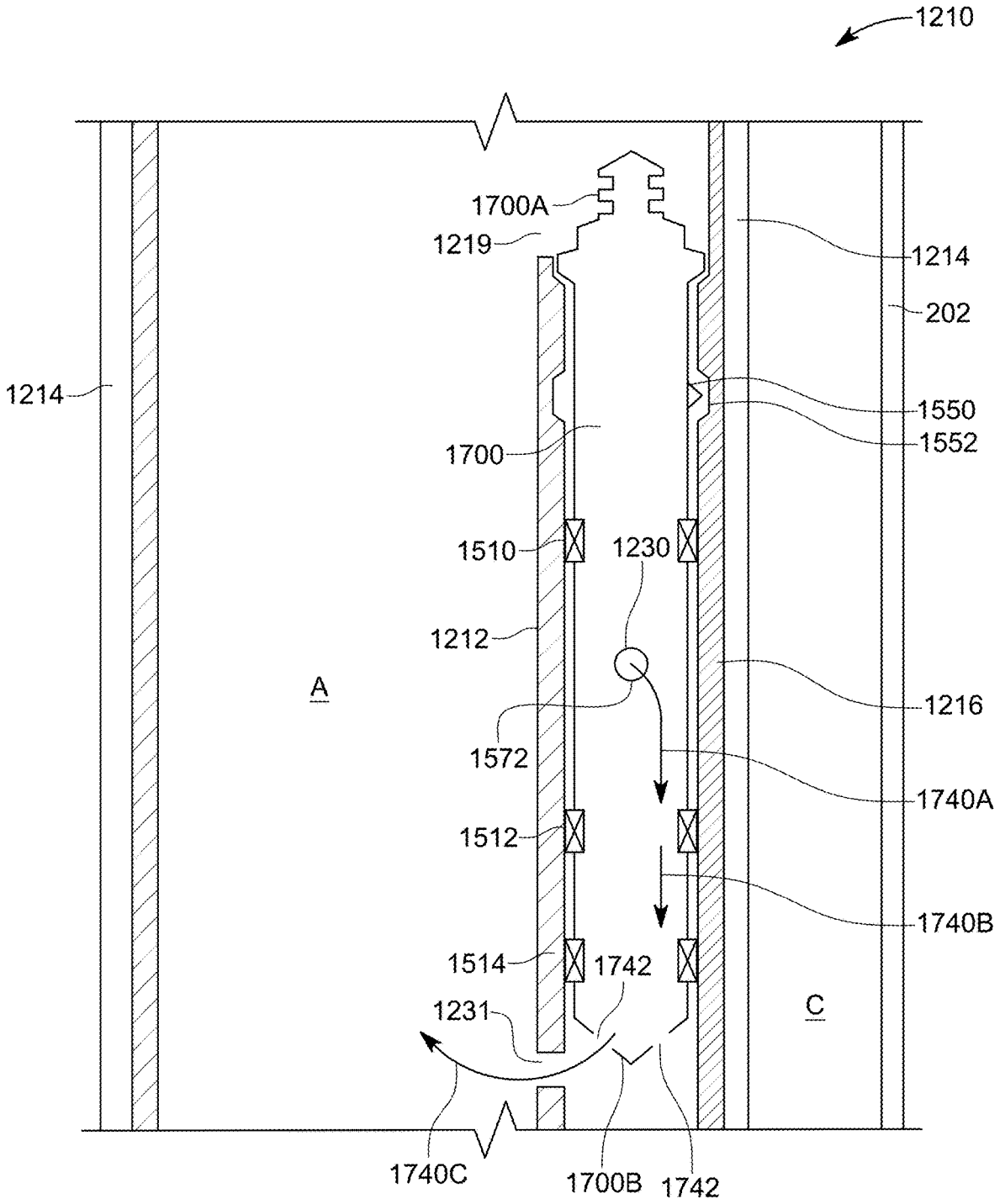
Figure 19:
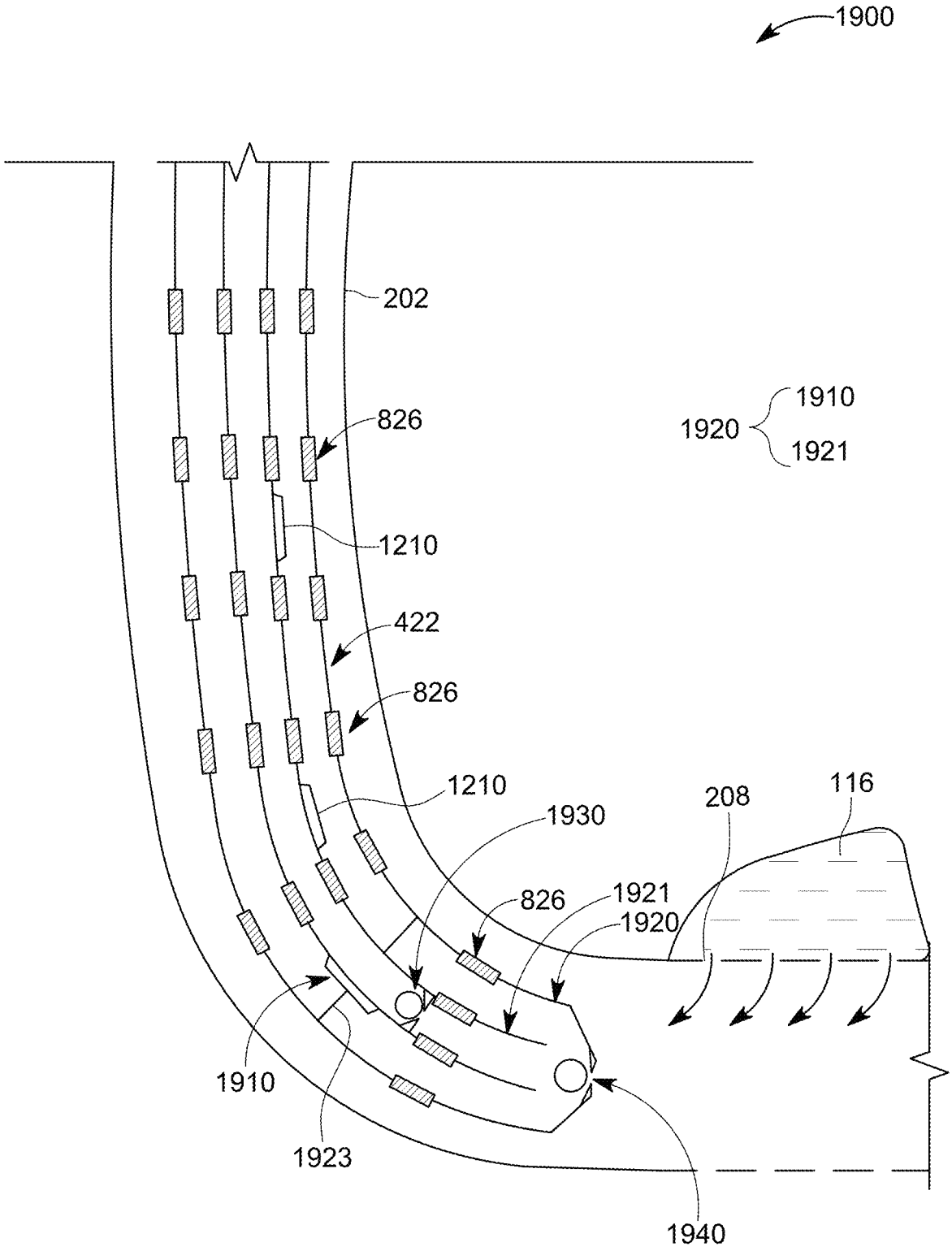
Figure 20:
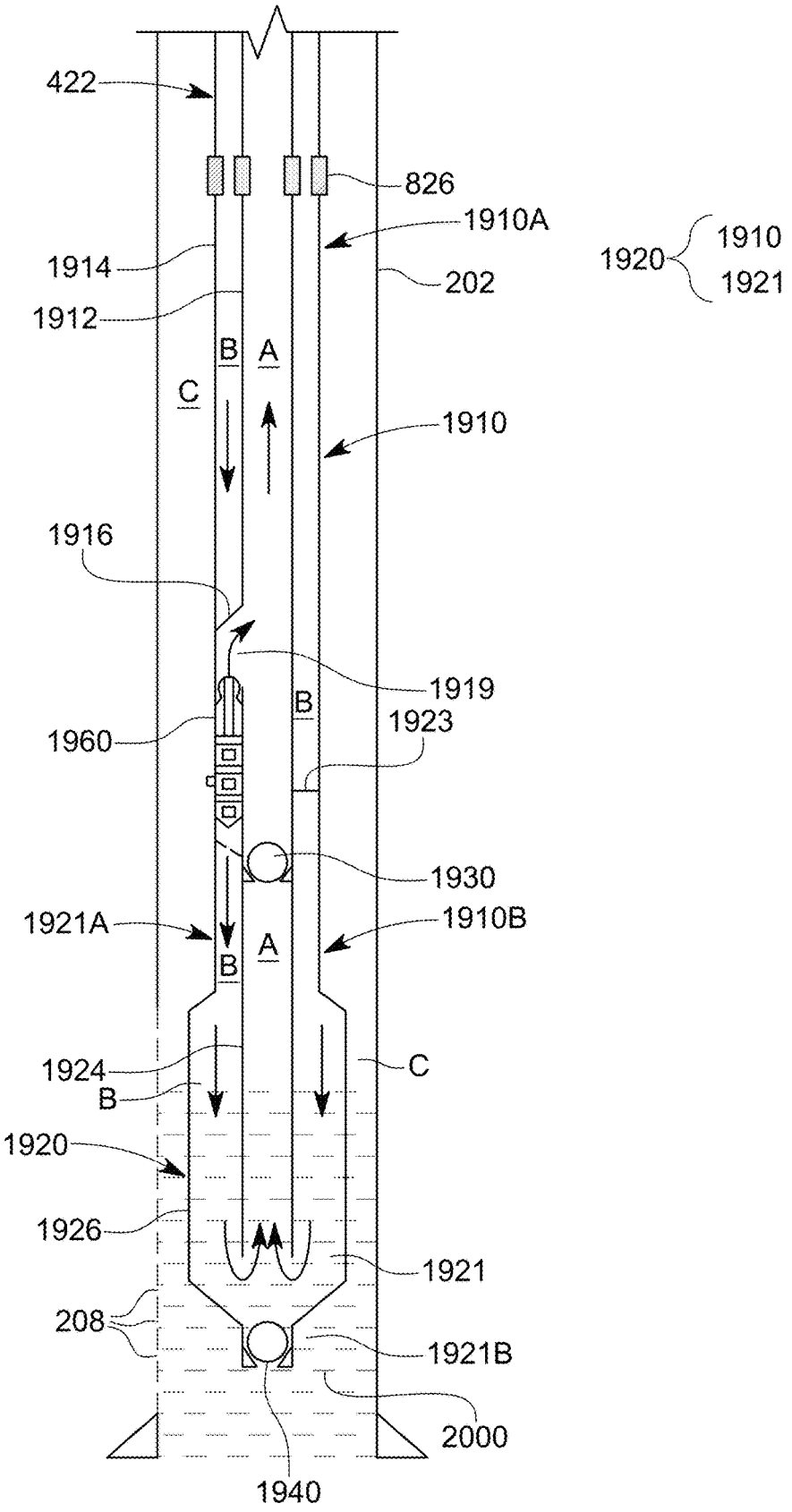
Figure 21A:
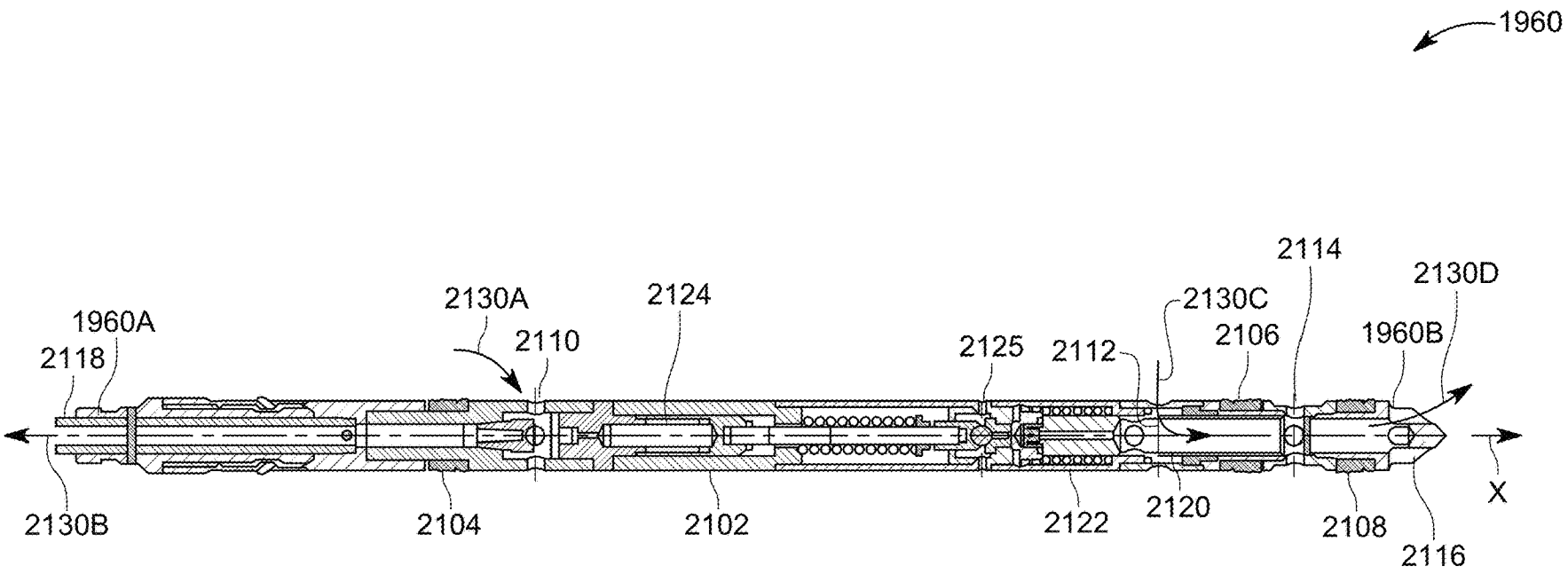
Figure 21B:
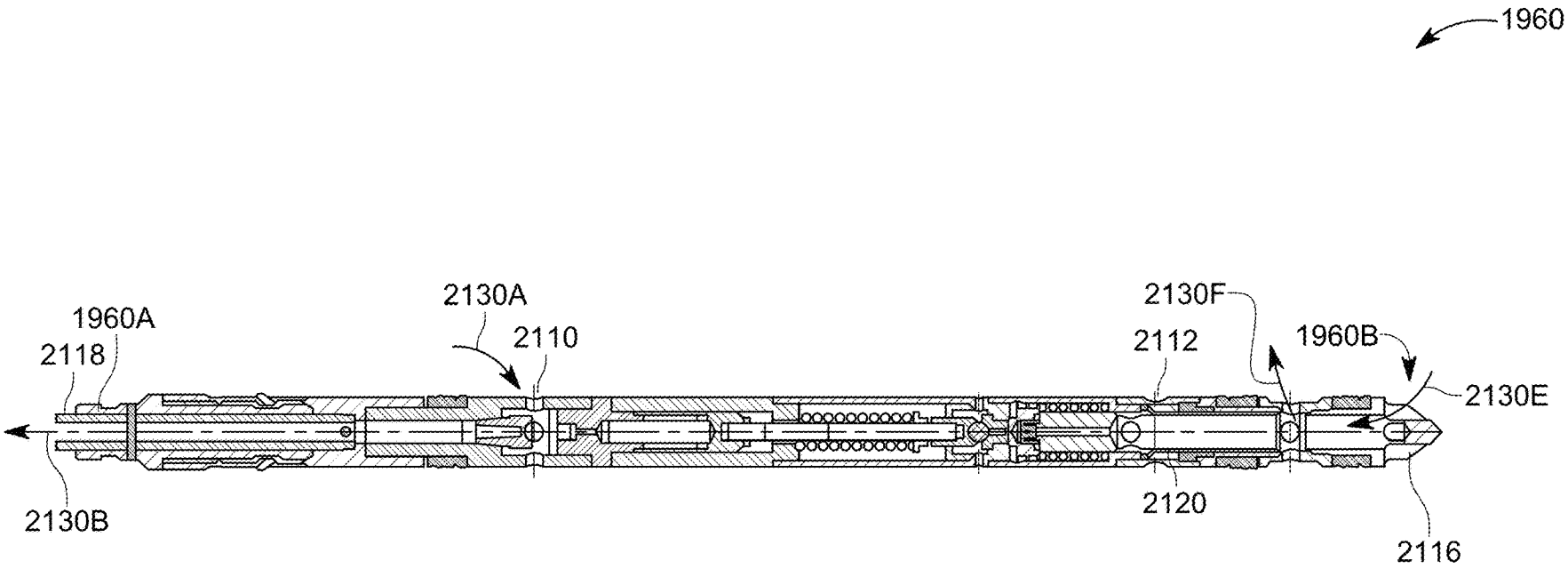
Figure 22:
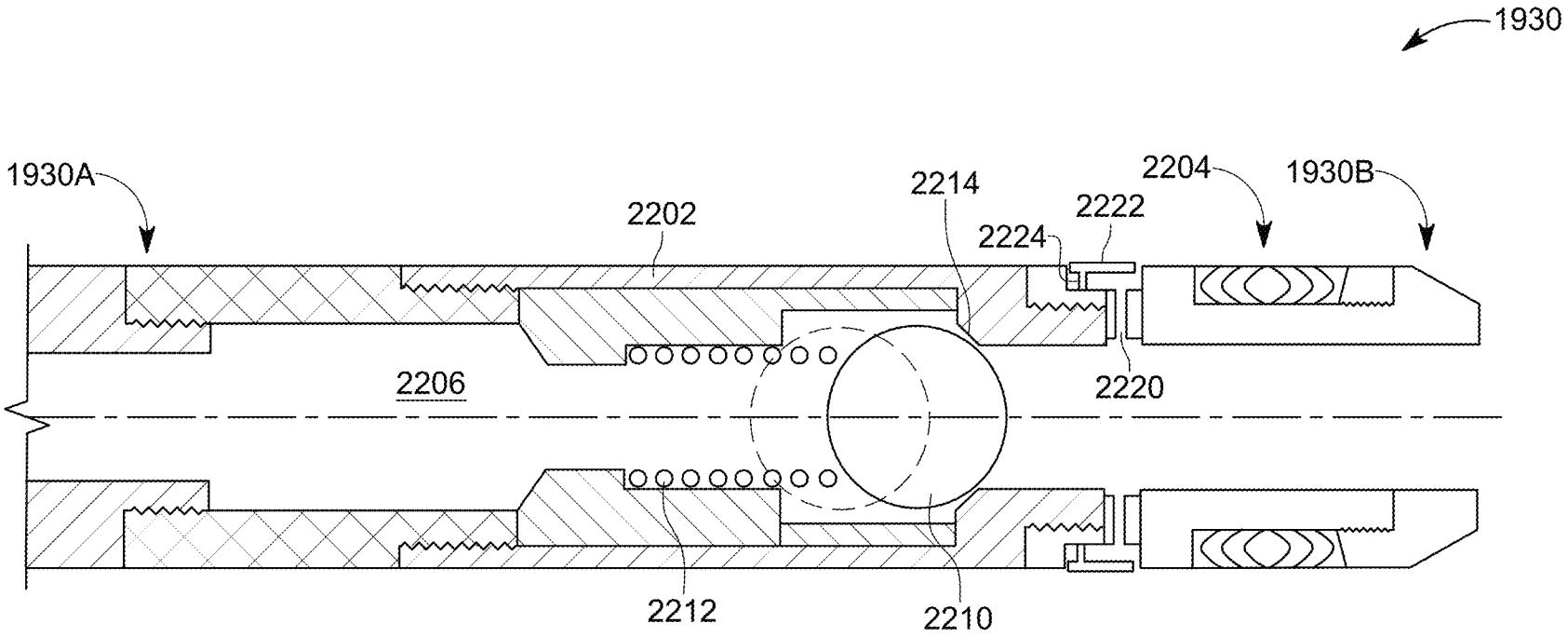
Figure 23:
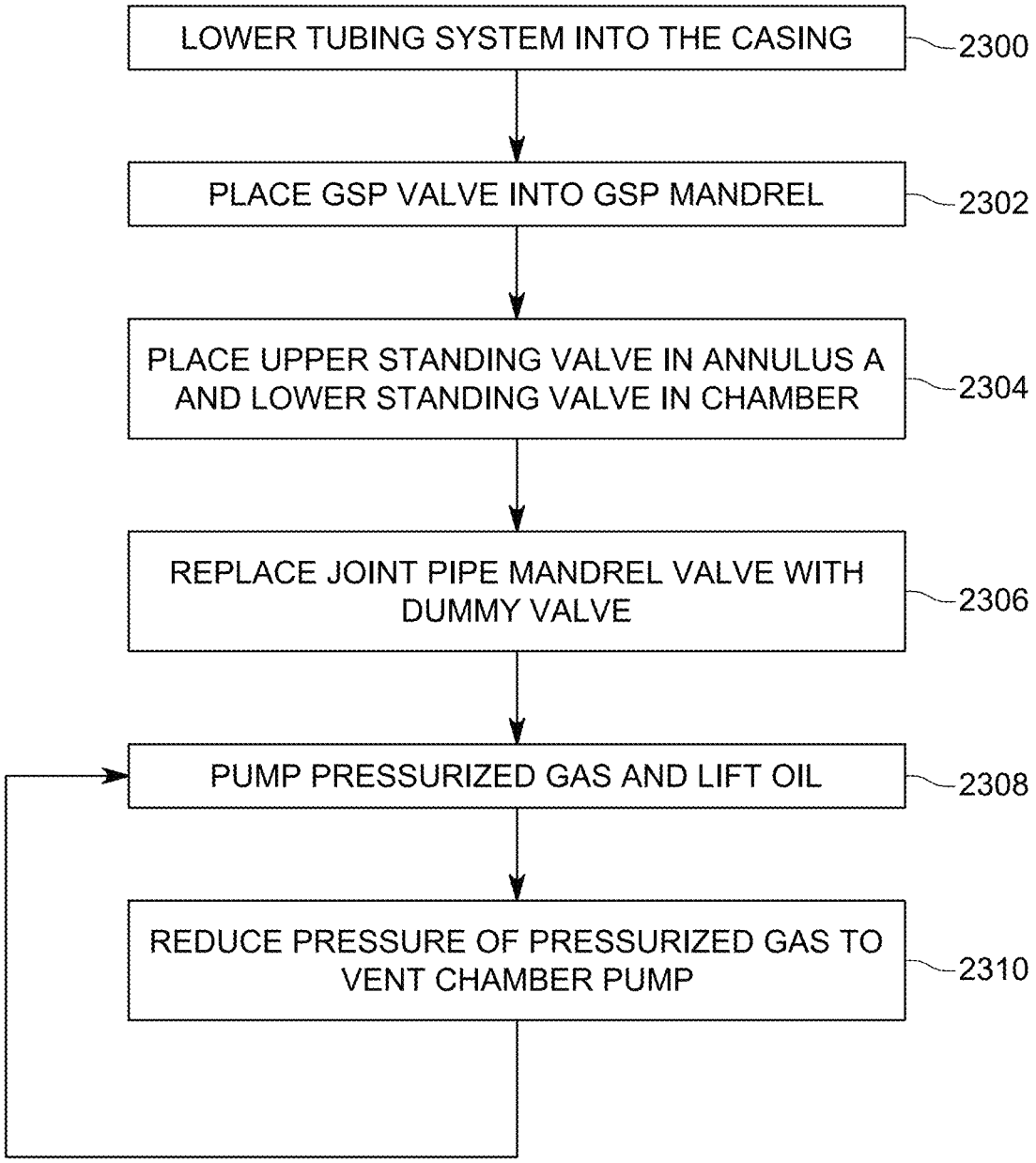
Figure 25:
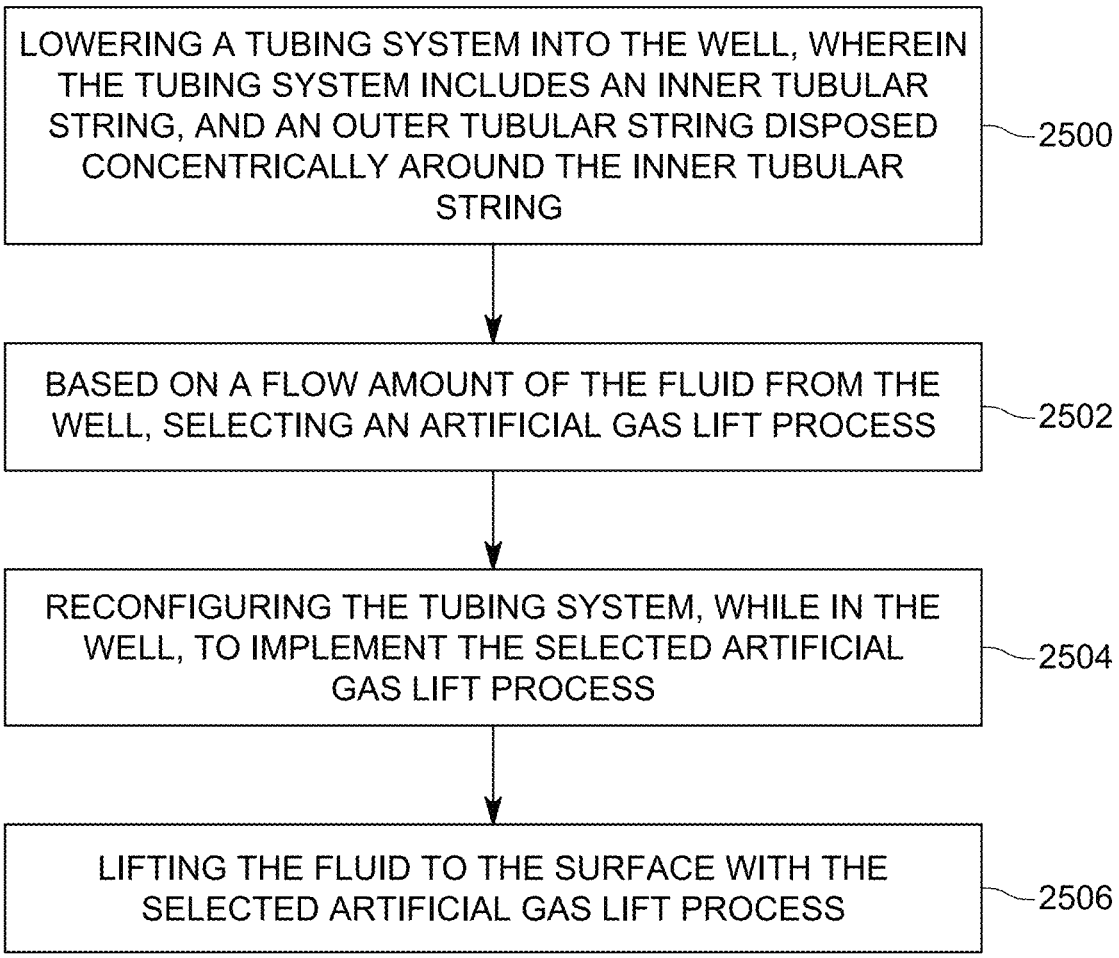
Figure 26:
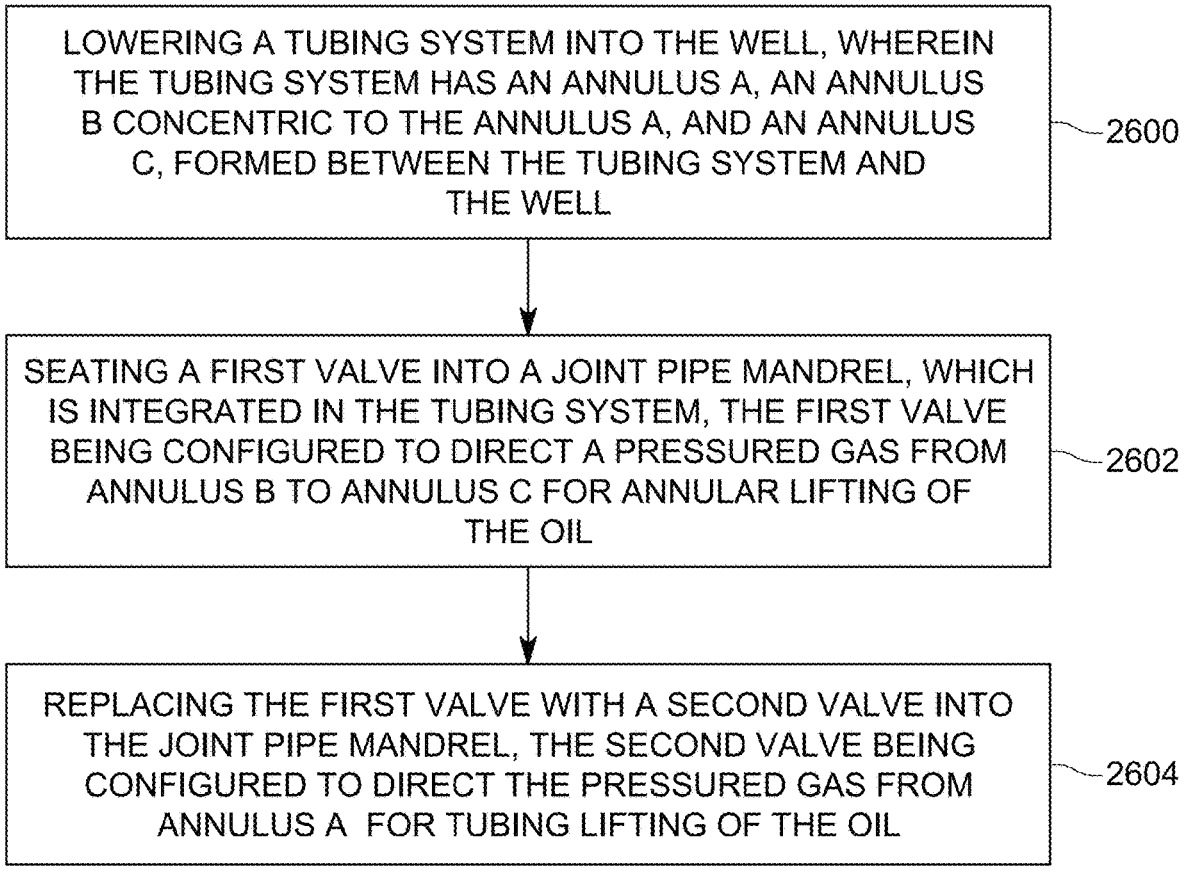
Figure 27:
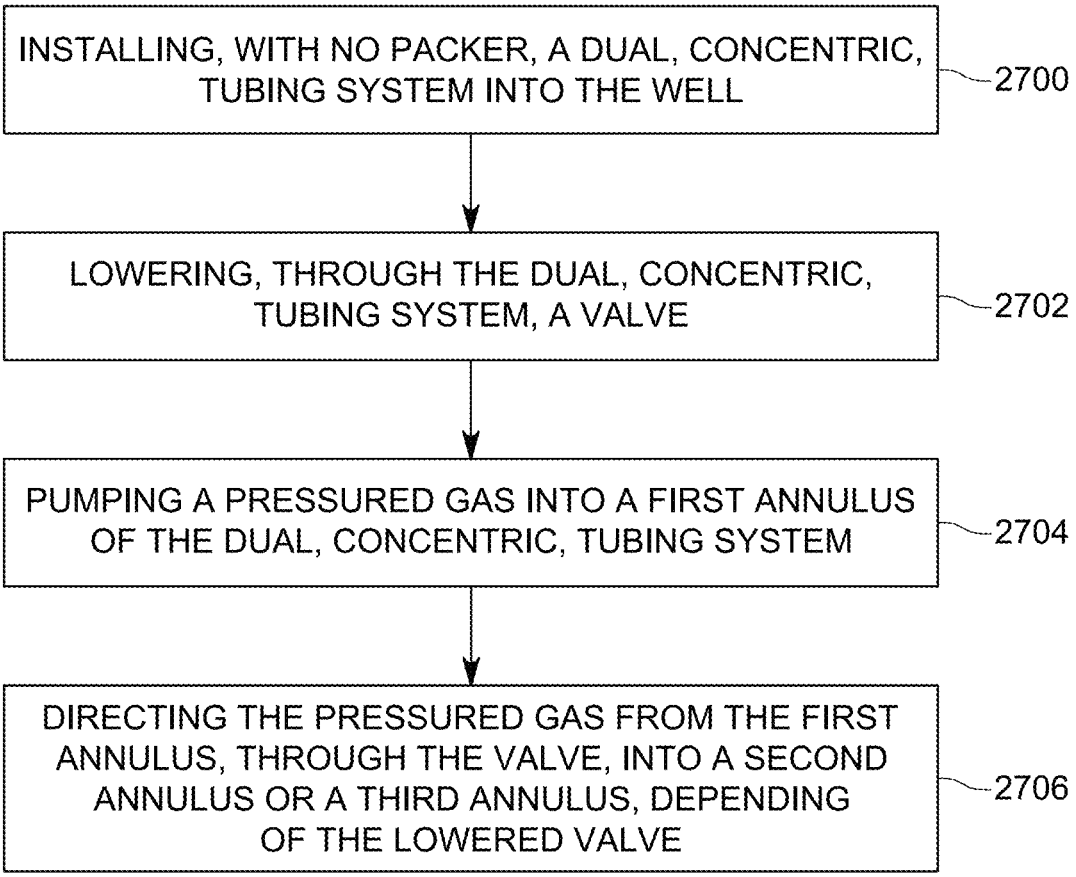

Figure illustrates how the inner pipe is added to the outer pipe for forming the joint pipe element;

FIG. 8 illustrates a double housing connector being attached to two joint pipe elements;

FIG. 9 illustrates the connector having the dual housing;

FIG. 10 illustrates a cross-section of the dual housing connector;

FIG. 11 is a flowchart of an artificial gas lift method that uses a tubing system that can be reconfigured without being taken out of the well;

FIG. 12 illustrates the reconfigurable tubing system;

FIG. 13 illustrates a joint pipe mandrel that is part of the reconfigurable tubing system;

FIGS. 14A to 14I illustrate various cross-sections through the inner and outer members of the joint pipe mandrel;

FIG. 15 illustrates a first valve that can be landed into the joint pipe mandrel to reconfigure the reconfigurable tubing system;

FIG. 16 illustrates a cross-section of the joint pipe mandrel and the first valve;

FIGS. 17A and 17B illustrate a second valve that can be landed into the joint pipe mandrel to reconfigure the reconfigurable tubing system;

FIG. 18 illustrates a cross-section of the joint pipe mandrel and the second valve;

FIG. 19 illustrates the reconfigurable tubing system having joint pipe mandrels, gas submersible pump mandrels, and an accumulation chamber;

FIG. 20 illustrates the gas submersible pump mandrel, and the accumulation chamber;

FIGS. 21A and 21B illustrate a gas submersible pump valve that is configured to be deployed into the gas submersible pump mandrel;

FIG. 22 illustrates an upper standing valve that is configured to be deployed a chamber pump;

FIG. 23 is a flowchart of a method for lifting oil using the reconfigurable tubing system;

FIGS. 24A to 24D illustrate various gas lift stages implemented with the reconfigurable tubing system;

FIG. 25 is a flowchart of a gas lift method for lifting a fluid with the reconfigurable tubing system;

FIG. 26 is another flowchart of a gas lift method for lifting a fluid with the reconfigurable tubing system;

FIG. 27 is still another flowchart of a gas lift method for lifting a fluid with the reconfigurable tubing system.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a tubing system that includes two concentric tubular strings that are used for lifting a fluid from a deviated (e.g., horizontal) well. However, the embodiments discussed herein are also applicable to a vertical well or to a tubing system that has more than two concentric tubular strings.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a tubing system includes outer and inner tubular strings, where the inner tubular string is located inside the outer tubular string. Each of the inner and outer tubular strings is made of plural pipes connected to each other. A single pipe of the inner tubular string and a single pipe of the outer tubular string are fixedly attached to each other to form a single unit, which is called herein a joint pipe element. At least one end of the joint pipe element is threaded in a such a way that when connected to another threaded end of another joint pipe element, inner pipes of the two joint pipe elements have matching threads that connect to each other and the outer pipes of the two joint pipe elements also have matching threads that connect to each other, as male/female connectors. Further, when two joint pipe elements are connected to each other, the threads of the inner pipes and the threads of the outer pipes simultaneously engage with each other.

In one application, there is a connector between adjacent joint pipe elements such that two inner pipes are connected to each other through an inner housing of the connector and two outer pipes are connected to each other though an outer housing of the connector. This means that by applying a torque to the outer pipe of one joint pipe element to connect to another outer pipe of another joint pipe element, or to the connector, the inner pipes of these two joint pipe elements automatically connecting to each other and are fluidly communicating with each other, i.e., the threads of the inner and outer pipes are simultaneously mating to each other or to the corresponding connector by applying a single rotational motion only to one of the outer pipes.

This also means that at least four different pipes, belonging to the two different joint pipe elements, can be connected to each other through a single rotational motion, with or without the connector. This further means that the outer tubular string and the inner tubular string are formed simultaneously, by connecting a joint pipe element to another joint pipe element, which is different from the traditional methods that form first the outer tubular string, and then the inner tubular string.

In this embodiment, the outer and inner tubular strings are not formed consecutively, or in parallel, but rather they are formed simultaneously, with the inner tubular string located inside the outer tubular string. Thus, in one application, it is possible to install two or more pressure autonomous concentric or partially concentric tubing strings into the casing of a subsurface well, simultaneously, as one tubular unit, instead of consecutively installed concentrically or in parallel. This process is very efficient and time saving as the operator does not have to manually engage the inner pipes to each other and apply a separate torque to each inner pipes for building up the inner tubular string.

Further, one or more of the joint pipe elements have side pockets that are configured to accept a gas valve. The gas valve can be deployed into or retrieved from its corresponding side pocket through the inner tubular string, after the entire tubing system has been deployed in the well. The gas valve is deployed/retrieved using a slickline or wireline, as discussed later. Thus, by deploying the appropriate gas valve, it is possible to reconfigure the tubing system for various stages of its life. This means that there is no need to remove the tubing system from the well for reconfiguring it. Using the slick line, it is possible in a matter of hours and not days to remove an existing valve and deploy another one so that the flow of gas and/or oil is adjusted as required. The joint pipe element that has the pocket for receiving such valve is called herein a joint pipe mandrel. These joint pipe mandrels have various ports, as will be discussed later, that permit to reconfigure the flow of the pumped gas from annulus C to annulus A, or from annulus B to annulus C for an annular lift stage of the well, and then from annulus B to annulus A for a tubing lift stage of the well. For a final stage of the well, the gas submersible pump (GSP) lift stage, it is possible to add another valve (to be discussed later) in communication with a chamber pump located at the distal end of the tubing system, to further recover the oil.

Thus, the novel joint pipe elements, joint pipe mandrels, corresponding gas valves, and the chamber pump make the tubing system more versatile, so that the operator can reconfigure it during the entire life of the well without the need to take it out of the well, as the existing methods do.

Prior to discussing the joint pipe mandrels, the corresponding gas valves, the chamber pump, and the methods of reconfiguring this tubing system, a short overview of the joint pipe elements (which are disclosed in more detail in Provisional Patent Application No. 62/801,396, filed on Feb. 5, 2019, and assigned to the same assignee as this application, the entire disclosure of which is incorporated by reference herein), which offer the capability of reconfiguring the tubing system, is provided.

Figure 1:
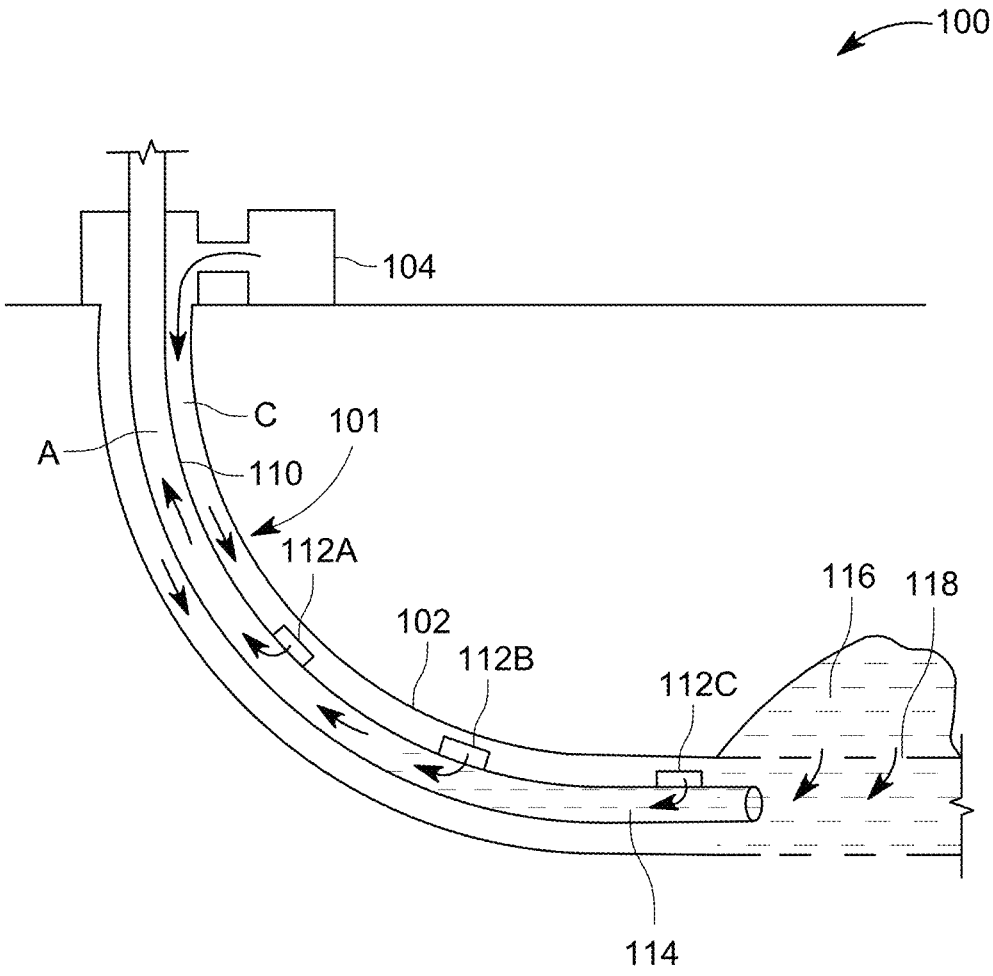
FIG. 1 illustrates a horizontal well and associated equipment for well production operations.
Figure 2:
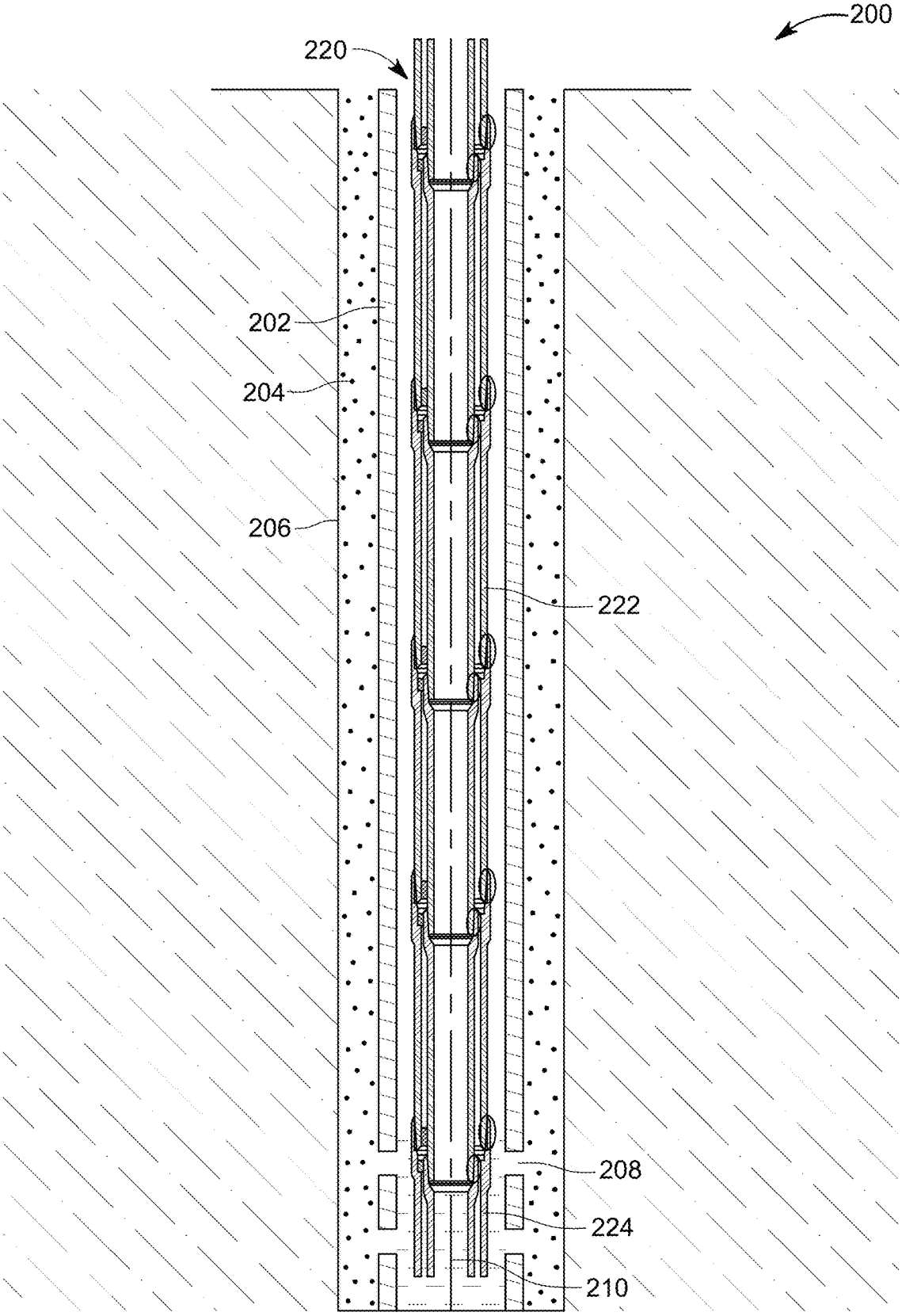
FIG. 2 illustrates a tubing system made of plural joint tube elements.

FIG. 2 shows an oil well 200 in which a casing 202 has been installed. Casing 202 has been cemented with cement 204 inside the borehole 206. Plural perforations 208 have been formed at least at the bottom of the well (in fact, these perforations are formed at various stages of the casing) so that oil 210 from the formations around the well 206 is flowing inside the casing 202. A tubing system 220 has been lowered into the casing 202 to lift the oil. The tubing system 220 is made of plural joint pipe elements 222. The number of the joint pipe elements may be any integer equal to or larger than 2. The most distal joint pipe element 224 may have a configuration different from the joint pipe element 222, which is discussed later.

Figure 3:
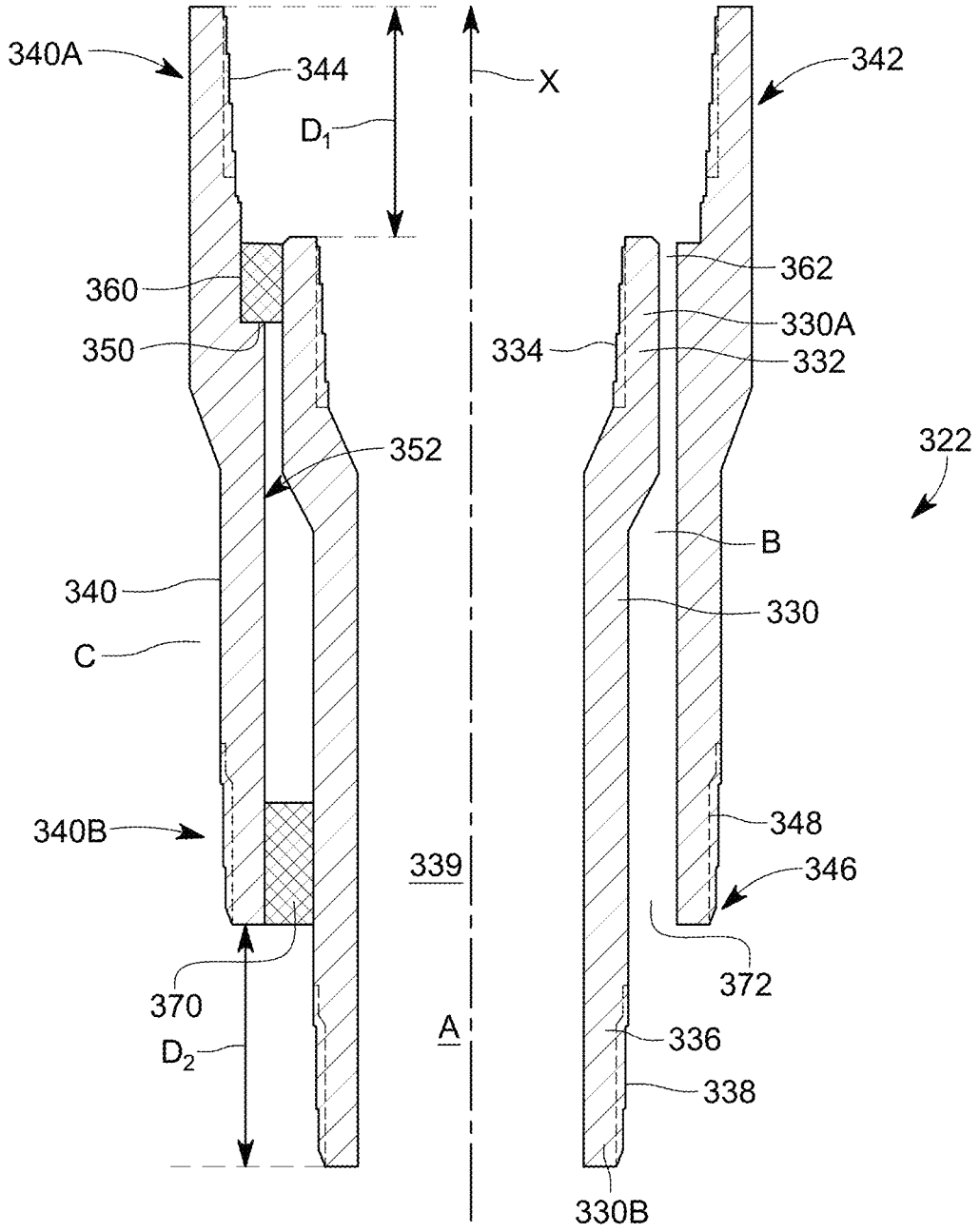
FIG. 3 illustrates a joint tube element that includes concentric inner and outer pipes fixedly connected to each other.

FIG. 3 shows a single joint pipe element 322 having an inner pipe 330 and an outer pipe 340. The upstream end 340A of the outer pipe 340 is shaped as an outer tubular box 342. This box can be formed, for example, by upsetting or forging (or any known process). In this embodiment, an internal thread (female) 344 is formed on the internal part of the outer tubular box 342. The downstream end 340B of the outer pipe 340 is shaped as a tubular pin 346 having an external thread (male) 348, that would mate with a corresponding thread 344 of a next single joint pipe element (not shown).

Two or more upstream lugs 360 are attached (for example, welded) to the inner pipe 330 as shown in FIG. 3. The term "lug" is used herein to include any means for connecting the inner pipe to the outer pipe in order to transfer rotational torque and share tensile and compression loads. This term may include, but it not limited to, a slug, a weld, a centralizer, or full or partial length feature on the inner or outer string, or a combination of features and other parts. Further, the term may include a key formed in one pipe and an extension or shoulder formed in the other pipe, such that the extension or shoulder is configured to engage the key. Other similar or equivalent mechanisms are intended to be included in this term as long as the two pipes are attached to each other in such a way to transfer rotational torque from the outer pipe to the inner pipe and share tensile and compression loads. Note that FIG. 3 shows only a single upstream lug 360 as this figure is a longitudinal cross-section view of the single joint pipe element 322. However, more or less lugs may be used and the shape of these lugs may be selected as necessary by the manufacturer of the joint pipe element. The inner pipe 330 is shown having a bore (called herein annulus A as it is customary in the industry, although a bore is different from an annulus), and the slots 362 between the upstream lugs 360 allow the gas or fluid to pass from one single joint pipe element to another through annulus B. The annulus A is in fact the fluid path of the inner tubing string and annulus B is the fluid path of the outer tubing string.

Lug 360 is in contact with the outer pipe 340 and may be attached to it also by welding. However, in another embodiment, the lugs 360 are welded to the inner pipe 330 and then this assembly is pressed inside the outer pipe 340, with no welding. The lugs 360 may engage with a corresponding groove 350 formed in one of the pipes. Because the size of the lugs may be a little larger than the size of the annulus B, by pressing the lugs between the two pipes makes the connection of the inner and outer pipes to be fixed, i.e., a torque applied to the outer pipes is transmitted to the inner pipe and thus, the inner pipe cannot rotate relative to the outer pipe or vice versa, the two pipes act as a single unit under rotation. Other methods for attaching the lugs to the inner and outer pipes may be used. It is noted that the inner pipe cannot rotate relative to the outer pipe for any of the joint pipe elements discussed herein because of these lugs. In this way, the torque applied to the outer pipe of a joint pipe element is conveyed though the lugs to the inner pipe, thus insuring that all threads in the joint pipe element are sufficiently tightened when forming a tubing system. This is valid irrespective of the manufacturing method selected for forming the joint pipe element, i.e., the lugs are welded, or just pressed, or forged, etc.

Still with regard to FIG. 3, in one application, the grooves 350 are formed in the bore 352 of the outer pipe 340 so that, when the inner pipe 330 and the upstream lugs 360 are placed inside the outer pipe 340, a corresponding lug 360 stops its movement along the X axis when contacting the corresponding groove 350. The number of grooves coincides with the number of lugs. The groove 350 is made so that an alignment of the inner pipe relative to the outer pipe along the longitudinal axis X is achieved. For example, in the embodiment of FIG. 3, the top most part of the inner pipe 330 is offset from the top most part of the outer pipe 340 by a distance D1. In one application, the distance D1 is between a couple of millimeters to a couple of centimeters. In still another application, the distance D1 may be zero, i.e., the top most part of the outer pipe may be flush with the top most part of the inner pipe.

Still with regard to FIG. 3, the inner pipe 330 is made to have an upstream end 330A and a downstream end 330B that are both treaded. The upstream end 330A is shaped as an inner tubular box 332 that has internal (female) threads 334. The inner tubular box 332 may be made, in one application, by upset forging. Other methods may be used to form this part. The downstream end 330B is shaped as an inner tubular pin 336 having an external (male) thread 338. The inner pipe 330 has a bore 339 (that forms annulus A of the inner tubular string) through which a valve may be lowered into the well or oil may be brought to the surface. As previously discussed, in the following, the bore 339 of the inner pipe 330 is called annulus A, the passage between the inner pipe 330 and the outer pipe 340 is called annulus B, and the passage between the outer pipe 340 and the casing (not shown) is called the annulus C.

For aligning the inner pipe 330 relative to the outer pipe 340, in addition to the upstream lugs 360 discussed above, downstream lugs 370 may be used at the downstream end of the outer and inner pipes. Two or more downstream lugs 370 may be used. FIG. 3 shows that slots 372 are formed between the downstream lugs 370, similar or not to the slots 362, for allowing a gas or fluid to pass by. Although FIG. 3 shows the inner pipe 330 being concentric relative to the outer pipe 340, it is possible that only one or both ends of the two pipes to be concentric, while the body (the part between the ends) is not concentric, as discussed later. One or both ends of the two pipes are concentric so that one joint pipe element can be attached to another joint pipe element by a single rotational motion. Note that the terms "downstream" and "upstream" in this application refer to a direction toward the toe bottom of the well and a direction toward the top head of the well, respectively.

Figure 4:
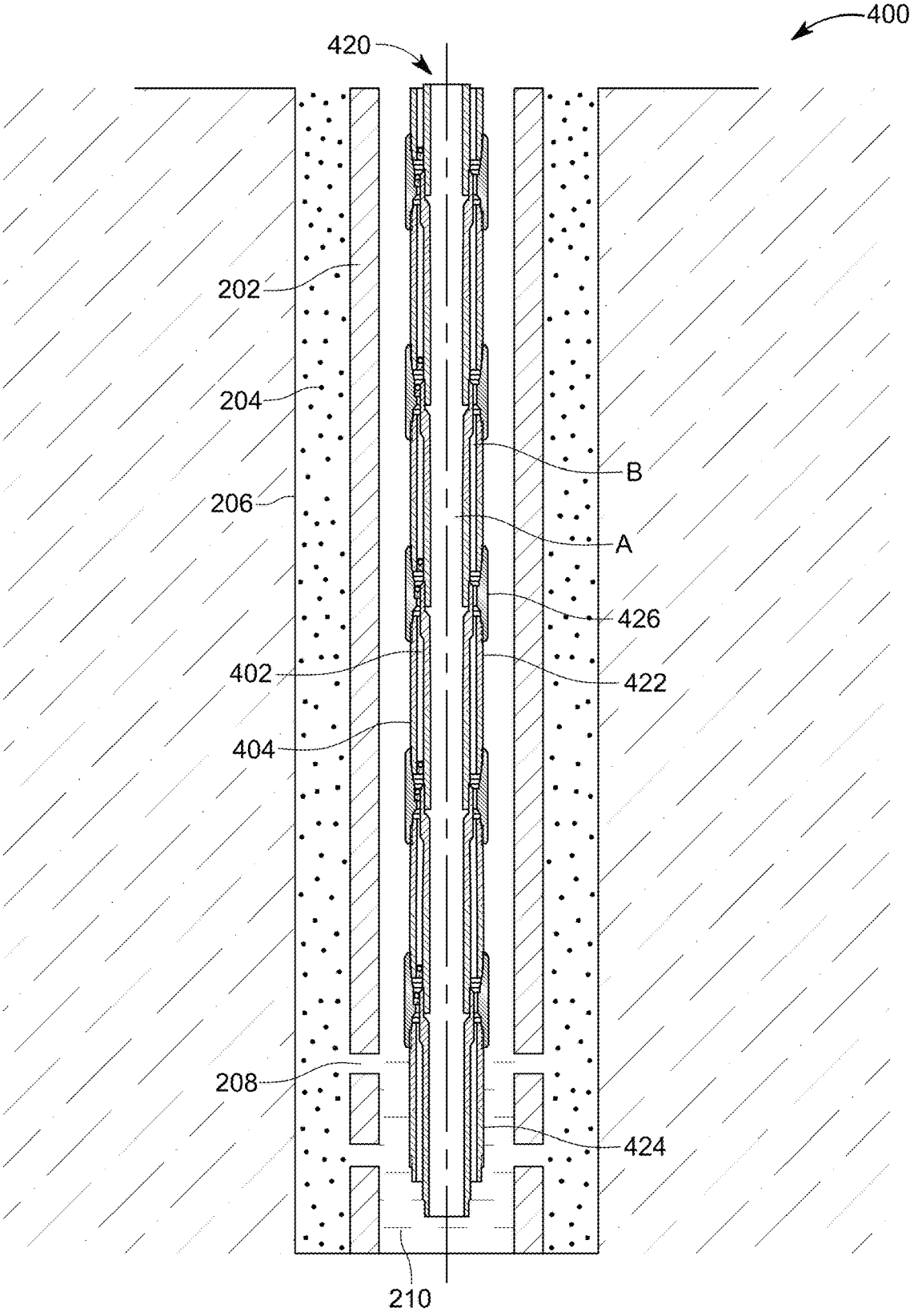
FIG. 4 illustrates a tubing system that uses plural joint tube elements and dual housing connectors.

The dual simultaneous connection between two joint pipe elements can also be achieved by using a connector (i.e., a single housing or a dual housing connector; the term "connector" is used herein to refer to either of these two connectors) as now discussed. FIG. 4 shows an oil lifting system 400 that includes a tubing system 420 for artificial gas lifting. The tubing system 420 includes plural joint pipe elements 422, connected to each other through corresponding single housing connectors 426. Note that single housing connector 426 connects only two outer pipes to each other or only two inner pipes to each other. However, as will be discussed later with regard to FIG. 9, it is possible to have a double housing connector 826 that connects simultaneously both the inner and outer pipes of two joint pipe elements to each other. The most distal joint pipe element 424 (e.g., the chamber pump), may be connected at its upstream end with the same single housing connector 426, while its downstream end may have no connection, as will be discussed later. Each of the joint pipe element 422 has an inner pipe and an outer pipe similar to the joint pipe element 332. When the joint pipe elements 422 and the single housing connectors 426 are all connected to each other, they form an inner tubular string 402 and an outer tubular string 404. The inner tubular string 402 has a continuous bore A, which is called herein annulus A, and the outer tubular string 404 forms an annulus B with the inner tubular string 402. The pressure in each of the tubular string can be controlled independent of the other tubular string.

Figure 5:
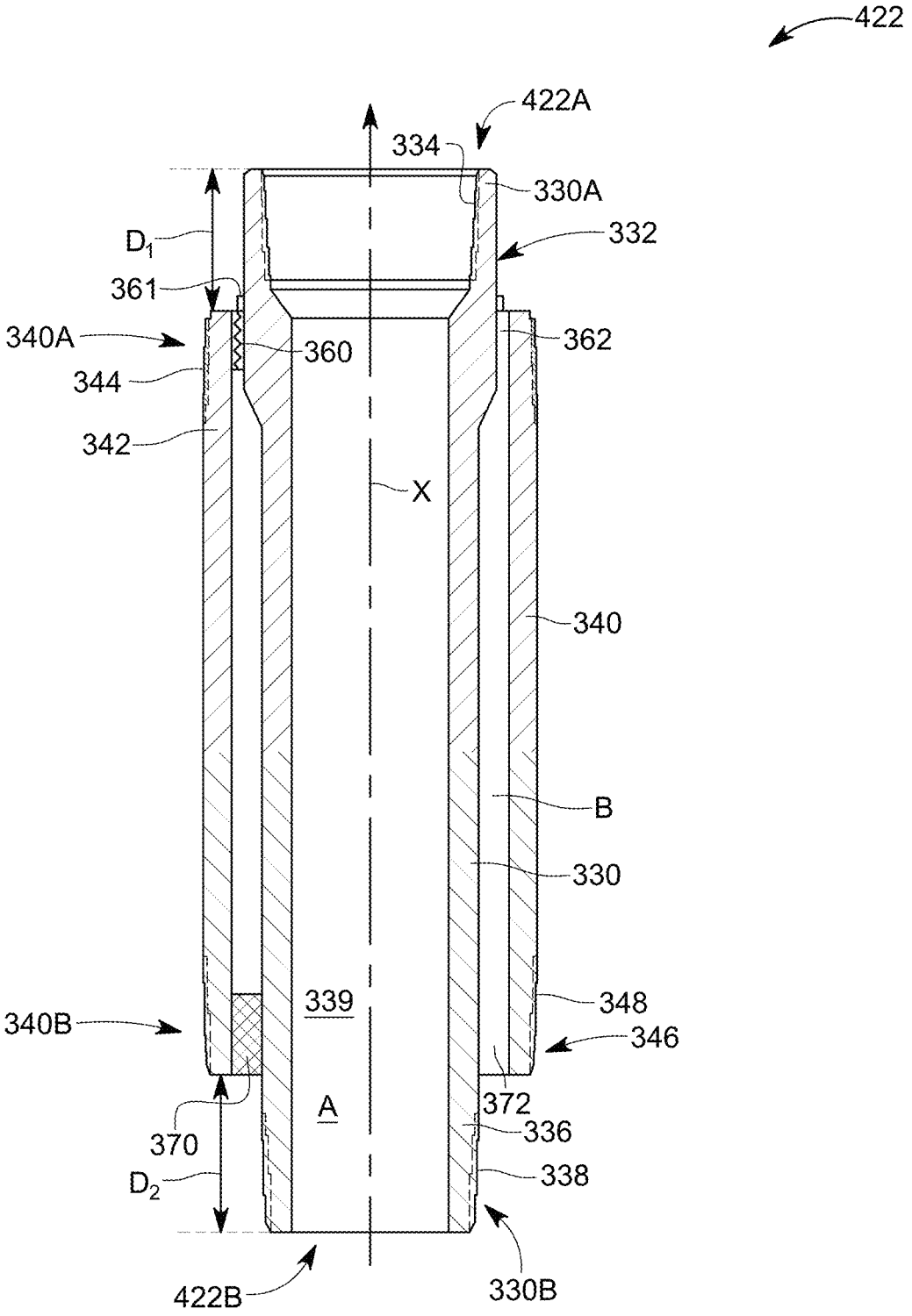
FIG. 5 illustrates a joint tube element having inner and outer pipes configured to be connected as a single unit to a single housing connector.

A joint pipe element 422 that is configured to connect to a single housing connector 426 is now discussed with regard to FIG. 5. The joint pipe element 422 includes, similar to the joint pipe element 322, an inner pipe 330 and an outer part 340. The downstream end 422B of the joint pipe element 422 is identical to the downstream end of the joint pipe element 322, and thus, the description of the elements of this end is omitted.

However, the upstream end 422A of the joint pipe element 422 is modified relative to the upstream end of the joint pipe element 322, as now discussed. These modifications are made to accommodate the single housing connector 426. More specifically, the inner pipe 330 has the upstream end 330A shaped as an inner tubular box 332 that has internal threads 334. The top most part of the inner tubular box 332 may be offset by a distance D1 relative to the top most part of the outer pipe 340, along the longitudinal axis X. The outer pipe 340 has the upstream end 340A shaped as an outer tubular pin 342 with external threads 344. The inner tubular box 332 is leading the outer tubular pin 342 along the longitudinal axis X. Similarly, the inner tubular pin 336 of the inner pipe 330 is offset by a distance D2 from the outer tubular pin 346 of the outer pipe 340. However, for the downstream end, the outer tubular pin 346 is leading the inner tubular pin 336 along the longitudinal axis X. Similar to the joint pipe element 322, the distances D1 and D2 may be the same or different or zero.

The upstream lugs 360 located at the upstream end of the joint pipe element 422 may be optional as a corresponding single housing connector 426 may achieve their functionality. However, if used, the upstream lugs 360 are attached (e.g., welded) to the outer pipe and the inner pipe may have a shoulder 361 that contacts the lug 360. The downstream lugs 370 located at the downstream end of the joint pipe element 1022 are similar to those of the joint pipe element 322.

Figure 6:
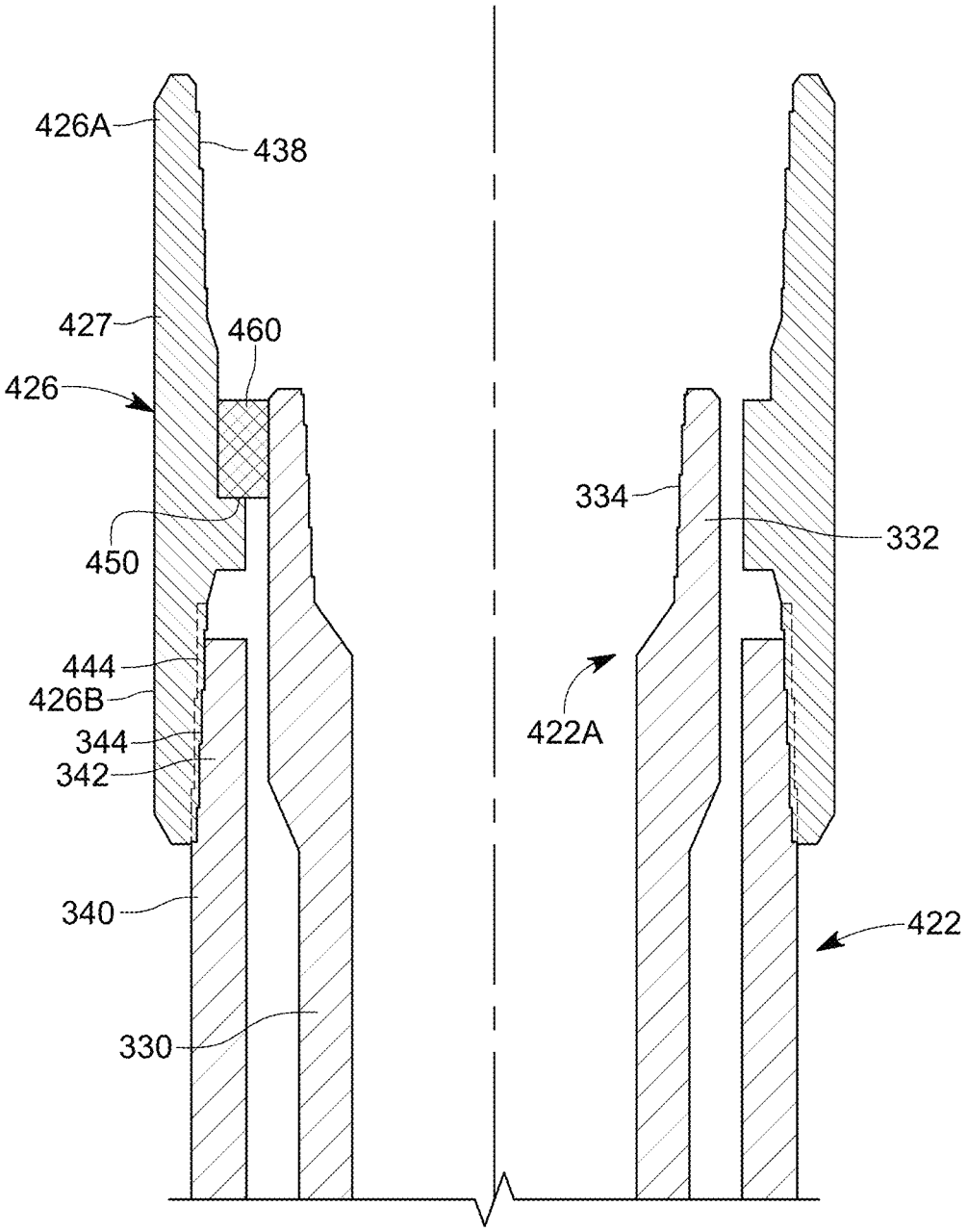
FIG. 6 illustrates an upstream end of a joint pipe element attached to a single housing connector.

The single housing connector 426 is shown in FIG. 6 being attached to the upstream end 422A of the joint pipe element 422. The single housing connector 426 has a body 427, which has an upstream part 426A that is shaped as a tubular box and has inner threads 438 that mate with the outer treads 338 of the outer pipe 340 of another joint pipe element (not shown). The connector body 427 also has a downstream part 426B that is shaped as a tubular box and has inner treads 444 that mate with the outer threads 344 of the outer pipe 340 of the joint pipe element 422.

Figure 7:
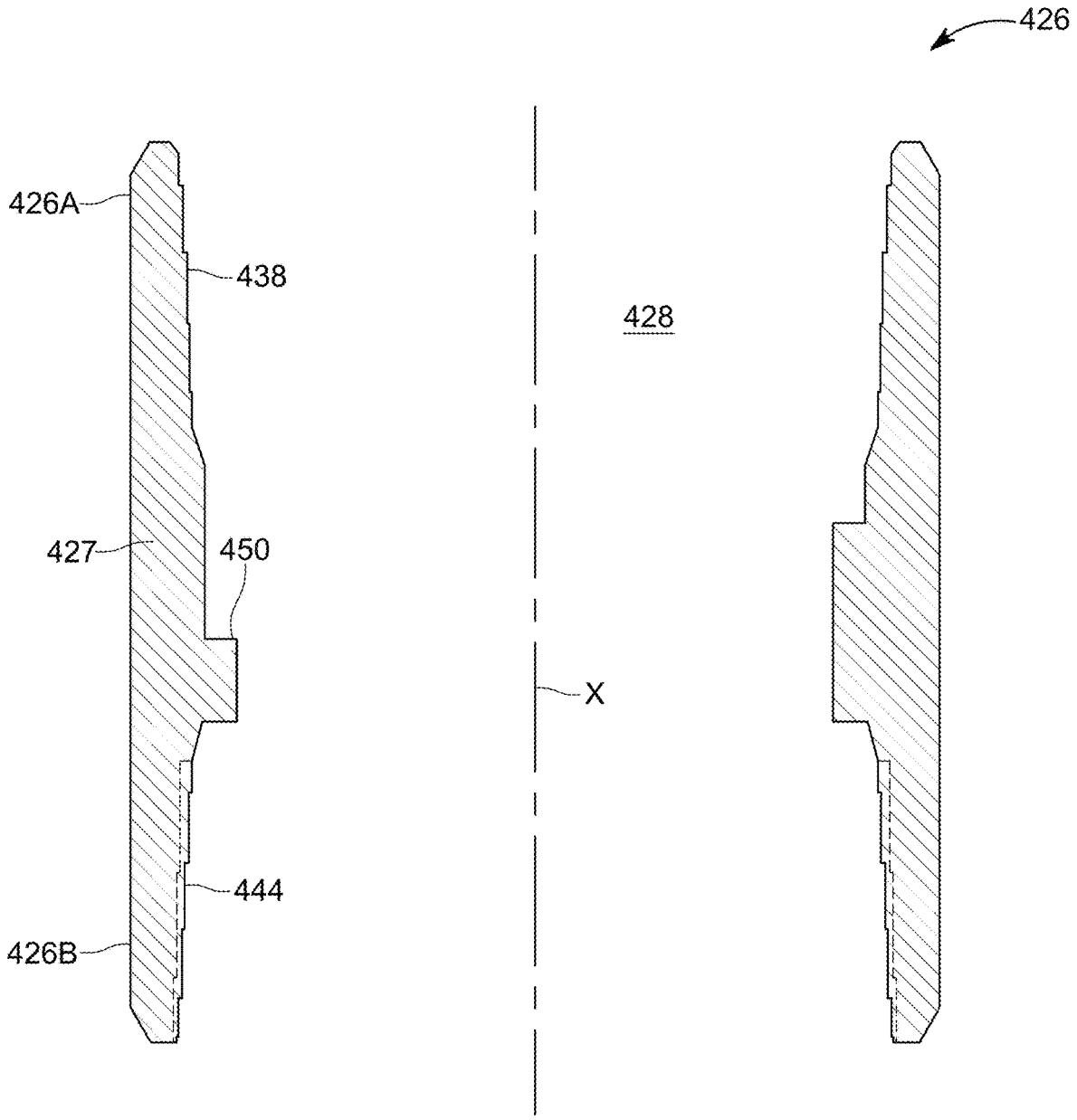
FIG. 7 illustrates the single housing connector.

The single housing connector 426 is shown by itself in FIG. 7 in cross-section. It is noted that in this embodiment, there are grooves 450 (only one is shown, but can be as many grooves as the number of lugs 460 attached to the inner pipe of the joint pipe element) for receiving a corresponding lug. The groove 450 extends in this embodiment into the bore 428 of the single housing connector 426. While FIGS. 6 and 7 show the single housing connector 426 connecting to each other only the outer pipes of the joint pipe elements (note that the inner pipes of the joint pipe elements connect directly to each other), in one embodiment it is possible to have a modified single housing connector 426 that connects only the inner pipes of the joint pipe element 422 and the joint pipe element 422. It is also possible to configure the single housing connector to connect only the inner pipes of two joint pipe elements and the outer pipes directly connect to each other and the single housing connector is located in annulus B.

In still another embodiment, as illustrated in FIG. 8, a dual housing connector 826 is configured to connect both the inner pipes and the outer pipes of the joint pipe elements 822 and 922 to each other, to form the annulus A and the annulus B. FIG. 9 shows a cross-section through the dual housing connector 826. The dual housing connector 826 has an outer body 827A that connects the outer pipes of the joint pipe elements and an inner body 827B that connects the inner pipes of the joint pipe elements. The inner body 827B is attached to the outer body 827A, as shown in FIG. 10, by one or more webs or bridges 828. In one application, the outer body, the inner body and the one or more webs are integrally formed from a single solid part. Holes or slots 829 or both are formed between the two bodies and the webs for allowing the fluid in annulus B to move from one joint pipe element to another one. In one application, the slot has an oval form. Other shapes may be used for the slot 829. In one embodiment, the two bodies 827A and 827B are made of a same piece of material, i.e., they are an integral body.

Returning to FIG. 9, the outer body 827A is shaped as an upstream tubular box 1010 that has inner threads 1012 and as a downstream tubular box 1020 that has inner threads 1022. The inner threads 1012 and 1022 are configured to engage the corresponding threads of the outer pipes of the joint pipe elements or a joint pipe element and one of a tool or production tubing. In one application, the threads of the inner pipes simultaneously engage the corresponding threads of the dual housing connector. The threads of the inner and outer pipes may be configured to have the same length. However, in one application, the threads of the outer pipes may be longer that the threads of the inner pipes.

The inner body 827B of the dual housing connector is shaped at one end as an upstream tubular box 1030 that has inner threads 1032 and is shaped at another end as a downstream tubular box 1040 that has inner threads 1042. The inner threads 1032 and 1042 are configured to engage the corresponding threads of the inner pipes of the joint pipe elements. In this embodiment, the inner tubular boxes 1030 and 1040 are offset inside the housing relative to their outer counterparts 1010 and 1020, along the longitudinal X axis. More specifically, in this embodiment, the inner tubular boxes 1030 and 1040 are recessed from the outer tubular boxes 1010 and 1020, respectively, by distanced L1 and L2, as illustrated in FIG. 9. Distances L1 and L2 may be the same or different or even zero.

The embodiments discussed above described a joint pipe element that can be connected either directly to another joint pipe element or indirectly, through a connector, to another joint pipe element. The inner and outer pipes of such joint pipe element may be made of a same material (e.g., a metal, a composite, etc.) or from different materials. The number of teeth per inch of the threads of the inner and outer pipes and the connector are identical so that when one joint pipe element is rotated to connect to another joint pipe element or to the connector, both the inner and outer pipes are simultaneously engaging with the corresponding inner and outer pipes of the other element or connector. The inner and outer pipes of the above discussed joint pipe elements were shown to be concentric and they can be installed in vertical or horizontal wells. They can be installed with a packer or with no packer.

Plural joint pipe elements connected to each other form the tubing system, which can be seen in FIGS. 4 and 6 as including an inner tubular string formed from all the inner pipes of the joint pipe elements, and an outer tubular string formed from all the outer pipes of the joint pipe elements. The tubing system may be used to install production and/or work-over concentric U-tube capability to any depth of the well bore.

In one embodiment, a joint pipe element may be modified to house a well servicing receiver device such as gas lift mandrels, sliding sleeves, valves, and/or ported landing nipples. These tubular well servicing devices can be physically joined and ported to one or more of the flow areas between the inner pipe and the other conduits in the well, including the well casing and the outer string annulus. Well servicing tools can be installed through the annulus A of the joint pipe element by using wireline or coiled tubing or they can be pumped down into the inner pipe of the joint pipe element to selectively either block off or control pressure, fluid or gas passage between two or more of the conduits. Various valves and mandrels are now discussed with regard to a continuous gas lift method.

FIG. 11 is a flowchart of a method for continuous gas lift that uses joint pipe elements as discussed above. In step 1100, a tubing system (for example, system 1200 shown in FIG. 12) is lowered into a well. The tubing system includes joint pipe elements that are attached directly to each other or through the connectors discussed above. In one application, if the well is a deviated well as illustrated in FIG. 12, then the joint pipe elements 422 are attached to each other via connectors 826, for the vertical portion of the well (where the weight of the elements act on each connection), and directly to each other for the horizontal portion of the well (as no weight of the elements is exerted for this part). Note a connector offers high strength to the tubing system. At least one joint pipe mandrel 1210 is inserted into the tubing system 1200 as also illustrated in FIG. 12.

A joint pipe mandrel 1210 is shown in more detail in FIG. 13. The joint pipe mandrel 1210 has an outer member or conduit (pipe) 1214 that houses an inner member or conduit (pipe) 1212. The inner member 1212 defines the annulus A while the outside surface of the inner member 1212 and the inner surface of the outer member 1214 defines the annulus B. A pocket 1216 is attached to the inner member 1212 for housing a valve, as discussed later. The pocket 1216 partially extends along a length of the inner member 1212 and abuts to the inner surface of the outer member 1214. The pocket 1216 is fluidly insulated from the outer member 1214 except for one or more ports discussed later. The pocket 1216 is also fluidly insulated from the inner member 1212, except along a slot 1219, which extends along the inner member 1212, and which is configured to receive a valve from a kickover tool that is deployed through the annulus A. In other words, the slot 1219 is at least as long as the valve that needs to be delivered into the pocket 1216, and the slot provides a "gate" between the inner member 1212 and the pocket 1216, so that the valve can be mechanically transferred, by the kickover tool or other tool, from annulus A of inner member 1212 into the bore of the pocket 1216. In this way, a flow of a fluid in annulus A is insulated from a flow of another fluid in annulus B and a cross-over from one annulus to another can be controlled at the above noted ports with the valve.

The joint pipe mandrel 1210 has an upstream end 1210A that has threads 1212A formed on the inner part of the inner member 1212 and threads 1214A formed on the inner part of the outer member 1214. The joint pipe mandrel 1210 also has a downstream end 1210B that has threads 1212B formed on the outer part of the inner member 1212 and threads 1214B formed on the outer part of the outer member 1214. The threads on the upstream end of the inner and outer members have the same pitch so that they engage corresponding threads of a joint pipe element simultaneously, with a single rotation motion. The same is true for the threads on the downstream end. In one embodiment, the threads of the upstream end have the same size and configuration as the threads of the downstream end. Those skilled in the art would understand that the threads on either end may be formed on either inner or outer part of the inner and outer members and it is a matter of convenience or choice which part of the inner and outer members holds the threads. In other words, consistent with the terminology of the joint pipe element 422 discussed in the previous embodiments, the upstream ends of the inner and outer members may be shaped as a tubular box or a tubular pin.

The upstream end 1210A of the joint pipe mandrel 1210 may be connected to a corresponding connector 826 (not shown in the figure) or directly to a joint pipe element 422 (not shown in the figure). The same is true for the downstream end 1210B. In one application, the downstream end 1210B may be unconnected from any other element, i.e., it may be the most element of the tubing system. Note that plural joint pipe mandrels 1210 may be provided along the tubing system 1200, each intercalated with other joint pipe elements. For example, between 1 and 20 joint pipe mandrels 1210 may be integrated in the tubing system 1200.

Figure 14A:
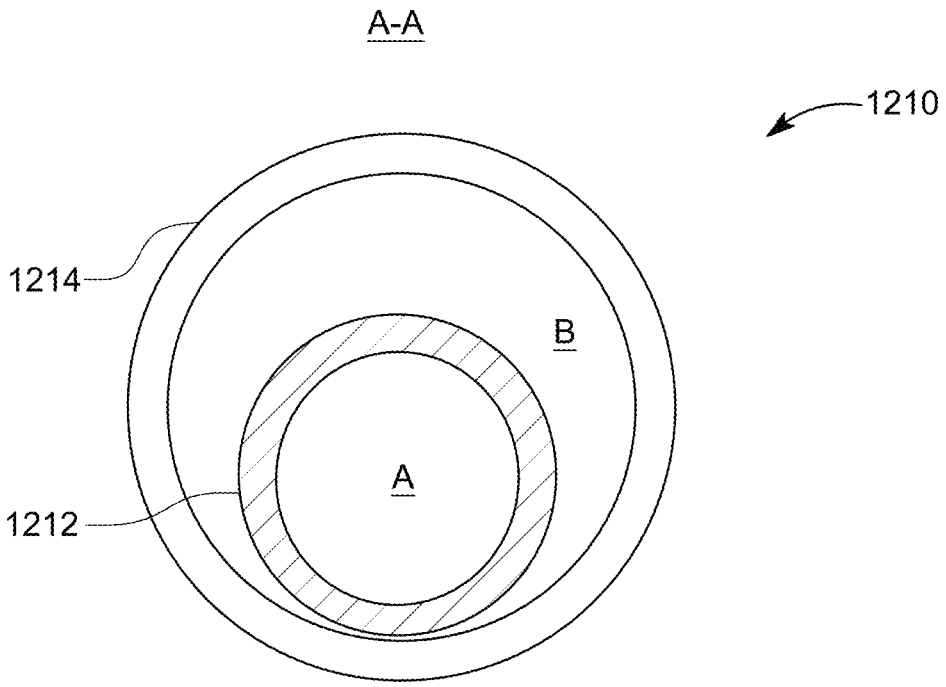

Five cross-sections A-A to E-E of the joint pipe mandrel 1210 are shown in FIGS. 14A to 14I for a better understanding of the relationship between the annulus A and annulus B within the mandrel. Cross-section A-A is shown in FIG. 14A and illustrates the outer member 1214 and the inner member 1212. This part of the inner member 1212 is not concentric with the outer member 1214 due to the pocket 1216. There is no fluid communication between these parts of the inner and outer members in this section. The inner member 1212 is pressed against an inner surface of the outer member 1214 by the pocket 1216, as discussed later. Also, this part of the inner member 1212 and the outer member 1214 is shaped as a closed cylinder, as shown in FIG. 14A.

Figure 14B:
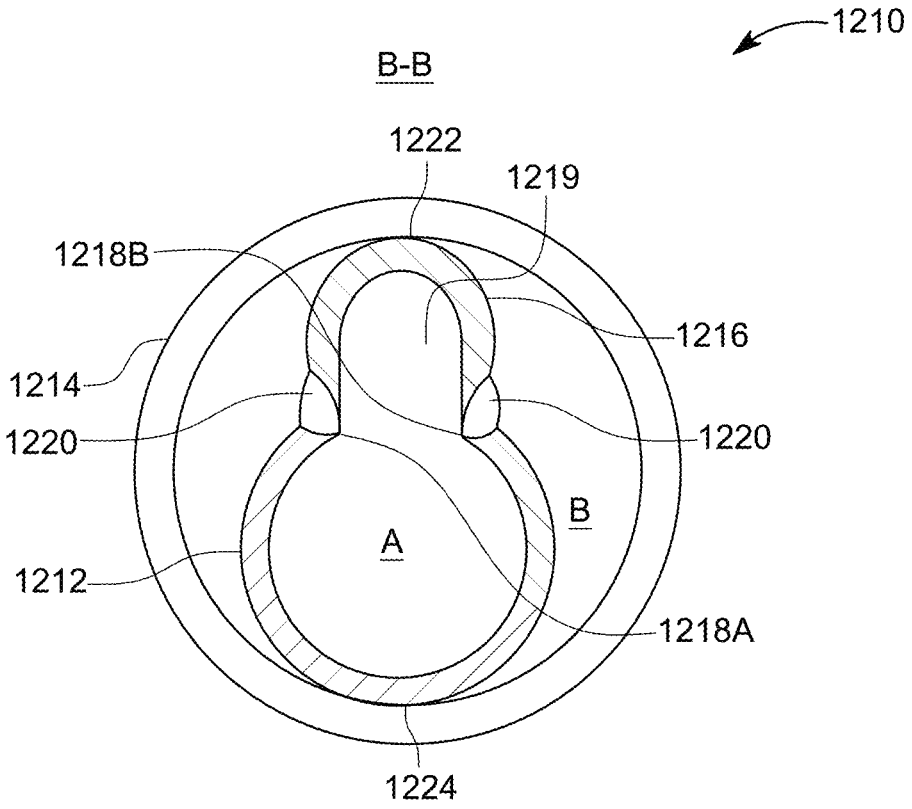
Figure 14C:
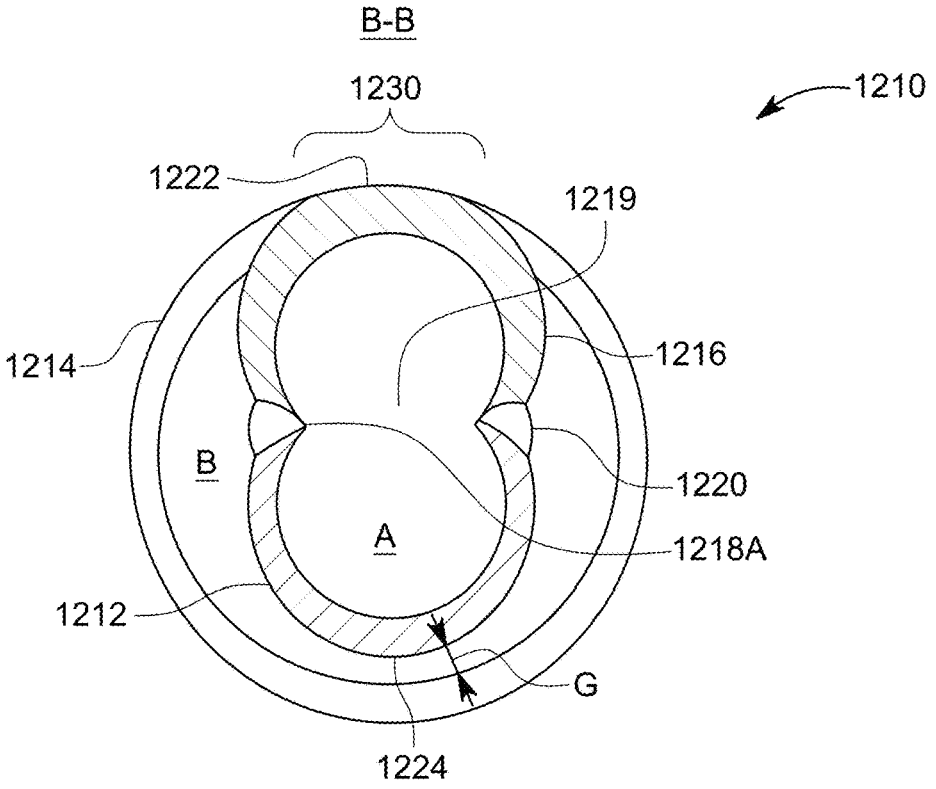

FIG. 14B shows the side pocket 1216 being attached to the inner member 1212 at points 1218A and 1218B. The slot 1219 extends between the points 1218A and 1218B, and it is configured to receive a valve. The slot 1219 extends along the longitudinal axis X for less of the total length of the pocket 1216 so that the valve can fully occupy a bore D, shown later in FIG. 14D, of the pocket. Because of this slot, this second portion of the inner member is shaped as a partial cylinder while the outer member is shaped as a full cylinder while the pocket is shaped as a partial cylinder. The pocket is welded at points 1218A and 1218B to the inner member 1212, as indicated by welding material 1210. In this embodiment, the top (apex) 1222 of the pocket 1216 is pressed against the inner surface of the outer member 1214 while the bottom 1224 of the inner member 1212 is pressed against the inner surface of the outer member 1214. In another embodiment, as illustrated in FIG. 14C, a slot 1230 is cut into the outer member 1214, along its longitudinal axis, and the top 1222 of the pocket 1216 is welded to the outer member 1214. Thus, in this embodiment, this portion of the outer member is shaped as a partial cylinder, similar to the inner member. The pocket is also shaped as a partial cylinder for this portion. The bottom 1224 of the inner member 1212 for the embodiment illustrated in FIG. 14D may form a gap G with the inner surface of the outer member 1214. Other configurations may be imagined for the arrangement of the inner member 1212 and pocket 1216 inside the outer member 1214 as long as annuli A and B are kept fluidly insulated from each other.

Figure 14D:
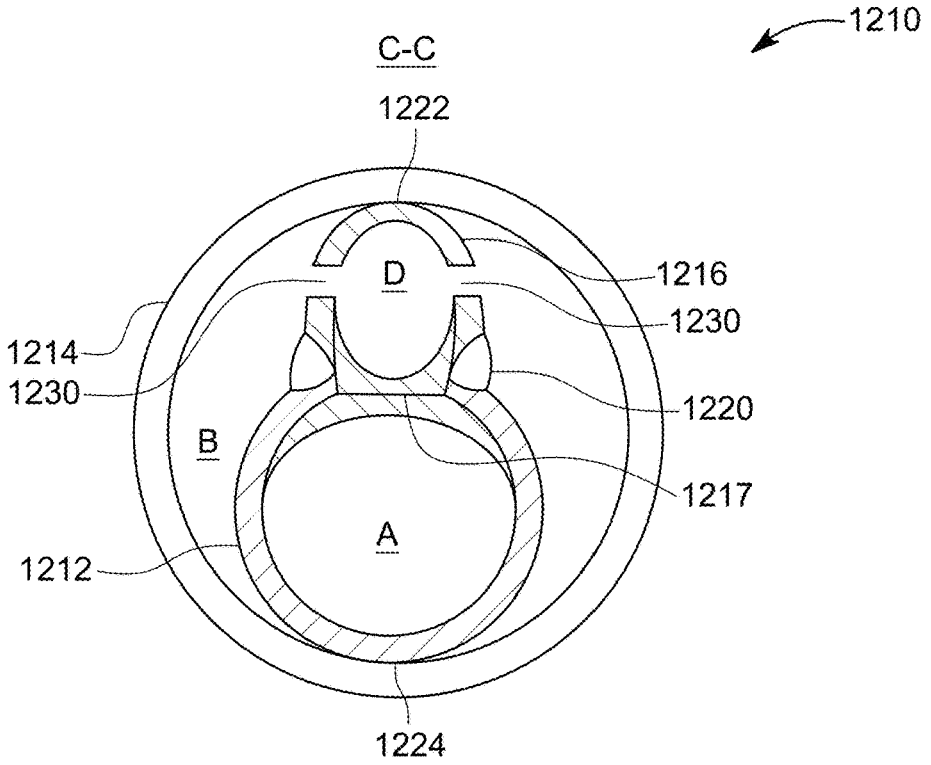

FIG. 14D shows the C-C cross-section of the joint pipe mandrel 1210 at the place where the slot 1219 is over, which means that this portion of the pocket has a bore D. A difference between the C-C cross-section and the B-B cross-section shown in FIG. 14B is that one or more ports 1230 are formed between the pocket 1216 and the bore (or annulus B) of the outer member 1214. This means that a fluid from annulus B can enter inside the pocket 1216 or a fluid from the pocket 1216 can enter inside the annulus B at these ports. As will be discussed later, the pocket 1216 is occupied by a valve (not shown in the figure) and this valve would effectively control the flow of a fluid from or to annulus B. Another difference between the C-C cross-section and the B-B cross-section is that the pocket 1216 has a wall 1217 that separates the annulus A from the bore D of the pocket 1216.

Figure 14E:
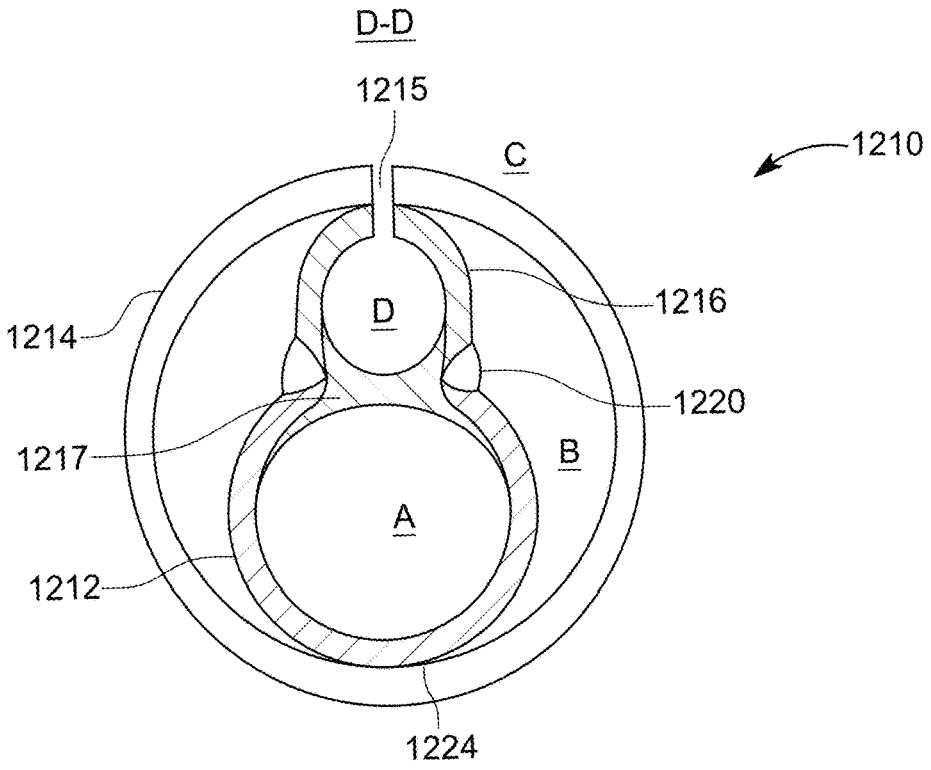

FIG. 14E shows the D-D section through the joint pipe mandrel 1210 and this time a port 1215 is formed between the outside (which corresponds to annulus C) of the outer member 1214 and bore D of the pocket 1216. For this section, the inner member is fully closed and the outer member is fully closed except for the port 1215. This means that the valve that will occupy the bore D may control a fluid flow toward and from the annulus C. The wall 1217 between the annulus A and the bore D is also present in this cross-section.

Figure 14F:
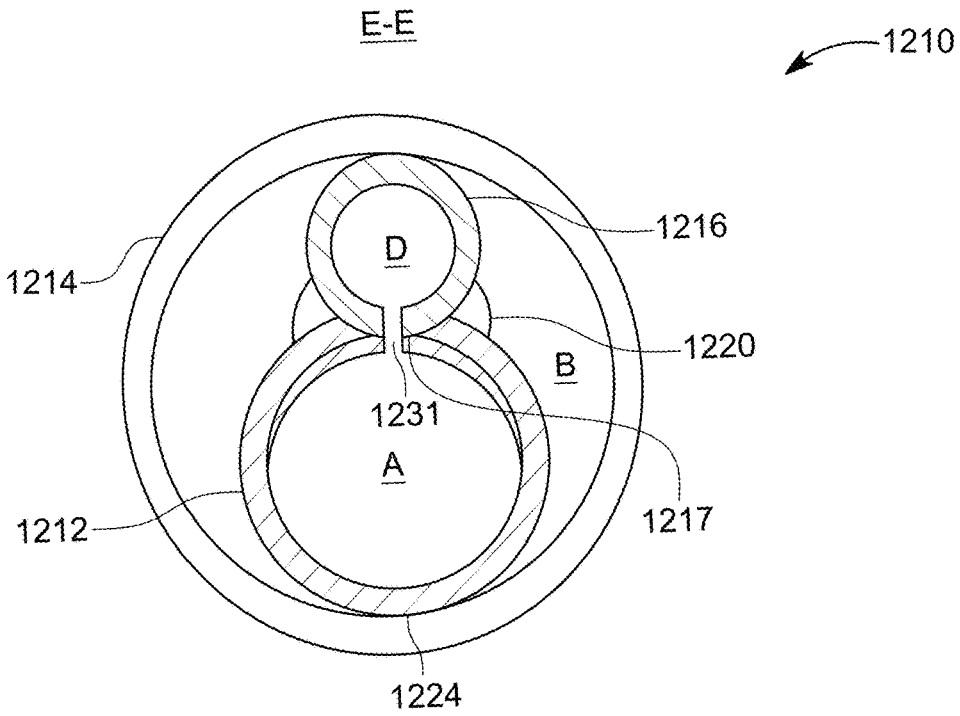

FIG. 14F shows the E-E cross-section through the joint pipe mandrel 1210 and for this section, a port 1231 is formed between the bore D of the pocket 1216 and the annulus A of the inner member 1212. Thus, for this portion, the inner member is shaped as a closed cylinder with a port 1231, the outer member is shaped as a closed cylinder, and the pocket is shaped as a closed cylinder with a port 1231. When the valve (not shown) is placed inside the bore D of the pocket 1216, this valve would be able to control a fluid flow to and from the annulus A.

Given the capability of bore D to communicate with any of the annuli A, B and C at some port along the length of the pocket 1216, the valve or valves to be installed in bore D would be able to establish fluid communication between any two annuli of the tubing system having the joint pipe mandrel 1210 and the joint pipe elements 422, in effect achieving a U-tube with any two of the annuli A, B and C. This is advantageous because by being able to form a U-tube between different annuli during the life of the well, without taking out the tubing system, in effect allows to reconfigure the tubing system and apply different gas lifting methods depending on the pressure of the formation.

Figure 14G:
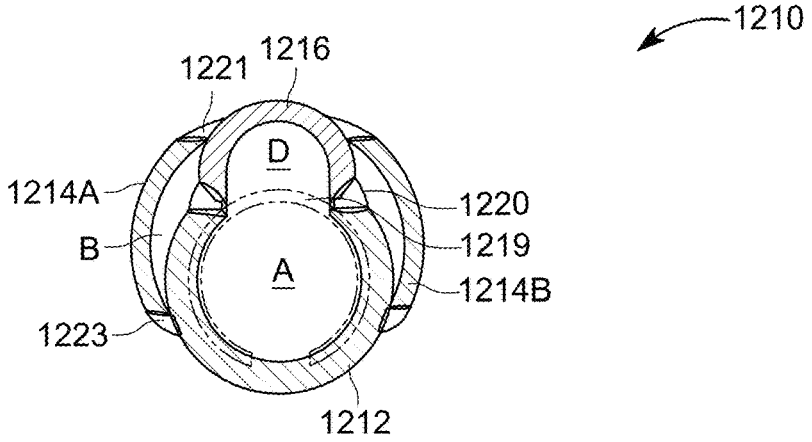
Figure 14H:
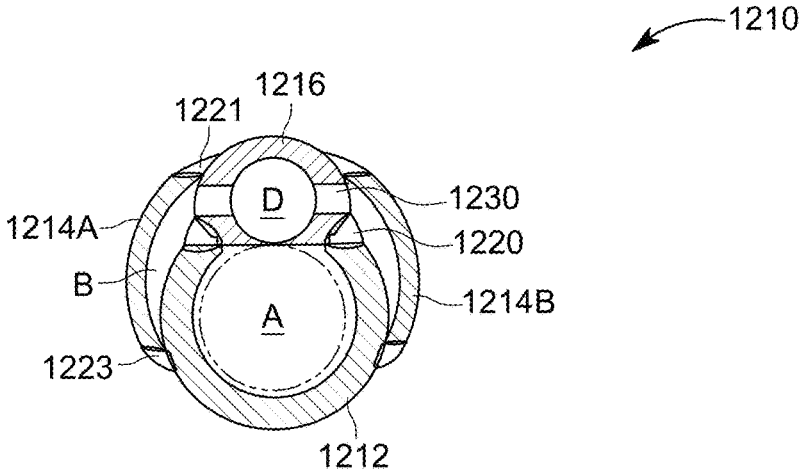
Figure 14I:
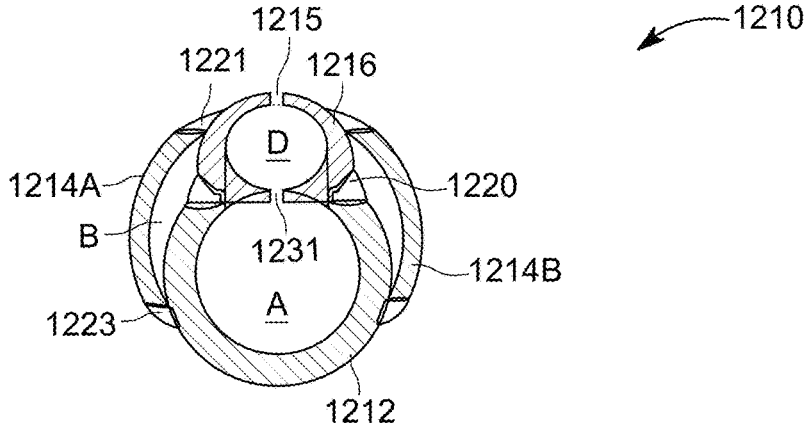

FIGS. 14G to 14I show another embodiment in which the pocket 1216 is attached to the inner member 1212, similar to the embodiment illustrated in FIGS. 14A to 14F. However, the difference is that the outer member 1214 is not a full or partial cylinder, for the portion of the joint pipe mandrel 1210 that corresponds to the pocket 1216. For this embodiment, two curved independent parts 1214A and 1214B extend along the inner member 1212 to form the annulus B. The two curved parts 1214A and 1214B are welded at points 1221 to the outside portion of the pocket 1216 and at points 1223 to the outside portion of the inner member 1212. Note that although FIG. 14I shows the port 1215 between bore D and annulus C and the port 1231 between the bore D and the annulus A, formed at the same longitudinal position, these two ports are staggered along the pocket 1216, as shown in FIGS. 14E and 14F. The upstream and downstream ends of this joint pipe mandrel as identical to the one shown in FIG. 13, i.e., having concentric dual pipes with threads.

Returning to FIG. 11, in step 1102, a first valve is selected for being place inside the pocket of the joint pipe mandrel, for facilitating fluid communication between annulus B and annulus C. With this configuration, a gas that would be pumped by a compressor, from the surface into the annulus B, would advance along the tubing system 1200, would then enter the joint pipe mandrel 1210, and the first valve would direct the compressed gas from annulus B into annulus C to push the oil up the annulus C, toward the surface. Note that the first valve may also be configured to receive the gas at a port fluidly connected to the annulus B and then to output the gas at two different ports, a first port fluidly connected to annulus C and a second port fluidly connected to annulus A. In this way, the gas can be discharged simultaneously in annuli A and C. This first artificial gas lift stage is called herein the annular lift stage. The annular lift stage may be used when the oil pressure in the formation is still high, but not high enough to push by itself the oil to the surface. For example, a first range of such oil pressure is large enough to generate at least 600 barrels of fluid per day, i.e., 600 bfpd.

In step 1104, the selected first valve is lowered into the well with a slick line, through annulus A, until reaching the desired joint pipe mandrel. The first valve is then transferred into the pocket 1216 of the joint pipe mandrel 1210 and placed in bore D. The first valve is configured to receive the gas pumped from the surface into annulus B, at port 1230, as illustrated in FIG. 14D. The valve then directs the pumped gas into annulus C, at port 1215, as shown in FIG. 14E and/or into annulus A, at port 1231, as shown in FIG. 14F.

FIG. 15 illustrates the first valve 1500 having a body 1502 that extends along a longitudinal axis X. The body 1500 has three circular packers or seals 1510, 1512, and 1514 disposed around the external surface of the body such that these seals engage with the pocket 1216 of the mandrel 1210 (as shown in FIG. 16) so that no fluid from the well passes along the body of the valve. FIG. 15 further shows a valve seat 1520 and a valve stem 1522 in the closed position. A closed gas chamber 1528 is connected to a bellow 1530. The gas chamber 1528 is filled with a gas under pressure when the valve is at the surface. The pressure of the gas is selected to be the pressure at which the valve opens when in the well. The bellows 1530 is thus controlled by the pressure difference between the gas in the chamber 1528 and the gas injected from the surface, along path 1540A, at port 1532. When the pressure of the injected gas is higher than the pressure of the chamber 1528, the valve stem 1522 moves upward, which raises the stem from the seat 1520. The gas from outside the valve then enters inside the valve along path 15408 and forces a check valve 1534, which is biased by a spring 1536, to open. The gas then exits the valve at port 1542, along path 1540C. Note that the downstream end 15008 of the valve is caped with a solid cap 1550 (i.e., a cap that has no ports) so that no fluid can escape through the cap. The upstream part 1500A of the valve is also closed so that no gas can escape. The upstream part 1500A is configured to be connectable to a slick line latch so that the valve can be deployed into or removed from the pocket 1216 as desired. However, solid cap 1550 can be replaced with a cap having a port, as discussed later in FIGS. 17A and 17B, so that the pressurized gas can be released, at the same time, in both annuli A and C.

FIG. 16 shows the first valve 1500 being deployed inside the pocket 1216 of the joint pipe mandrel 1210. FIG. 16 shows a latch mechanism 1552 that is extended into a corresponding groove 1554, formed in the wall of the pocket 1216, to anchor the first valve to the pocket. FIG. 16 also shows the port 1532 of the first valve 1500 being aligned with the slot 1230 cut into the wall of the pocket 1216. Note that FIG. 14D shows the slot 1230 achieving fluid communication between the bore D of the pocket 1216 and the annulus B. Because the first valve 1500 fully occupies the bore D of the pocket 1216, as shown in FIG. 16, the fluid communication is established between the annulus B of the joint pipe mandrel 1210 and the interior of the valve 1500. The pressurized gas from the annulus B is now directed along path 1540A (see FIG. 15), 1540B, and 1540C (see FIG. 16) to the port 1542 of the first valve 1500. Port 1542 of the first valve 1500 is in fluid communication with the port 1215 formed between bore D of the pocket 1216 and annulus C as shown in FIG. 14E. Because bore D of the pocket 1216 is occupied by the first valve 1500, this means that the pressured gas from the first valve 1500 is fluidly connected to the annulus C of the casing 202, as shown in FIG. 16.

Thus, with the first valve 1500 located in the pocket 1216 of the joint pipe mandrel 1210, the pressurized gas from the annulus B is directed to annulus C so that the oil present in the annulus C is pushed toward the surface for collection. If the cap 1550 of the first valve is changed with a ported cap, then the pressurized gas from annulus B is transferred not only to annulus C, but also to annulus A, as indicated by the dash line 1540D in FIG. 16.

Therefore, returning to FIG. 11, the method continues in step 1106 by pumping the pressurized gas through annulus B, first valve 1500, and then annulus C (and/or annulus A) to bring the oil to the surface, which constitutes the annular lift stage. Note that the annular lift stage takes places for a first pressure range of the oil in the formation.

When the pressure of the oil in the formation decreases, so that it enters a second pressure range, which is different from the first pressure range, a second valve is selected in step 1108 for reconfiguring the tubing system from the annular lift stage to the tubing lift stage. The first pressure range that is appropriate for the tubing lift stage varies with the size of the joint pipe elements, but it is considered to correspond to an oil production of about 400 to 600 bfpd. Those skilled in the art would understand that these numbers are approximate and the operator of the well may select other ranges. The tubing lift stage is mainly characterized by pumping the pressured gas into annulus B and then into annulus A instead of annulus C. However, it is possible to pump the pressured gas into annulus B and then both into annuli A and C at the same time. One skilled in the art would note that the joint pipe elements that form the tubing system allow the operator to pump the pressured gas into any of the annuli A, B and C and with an appropriate valve, can configure the tubing system to lift the oil through any one or more of the annuli A, B and C.

The second stage valve 1700 that is selected in step 1108 is shown in FIG. 17A and is similar to the first stage valve 1500, except that port 1542 is closed, so that there is no communication with annulus C. However, the second stage valve 1700 has a port 1742 at the downstream end 1700B, in the cap 1750, which is in fluid communication with the annulus A when the valve is located in the pocket 1216. The second valve 1700 can be modified to make the pressured gas be discharged, at the same time, into both annuli A and C. To achieve this, the lower part 1760 is replaced with the corresponding part from the first valve 1500 to establish fluid communication with annulus C, and the cap 1550 of the first valve is replaced with the ported cap 1750, to establish fluid communication with annulus A, as illustrated in FIG. 17B.

Returning to the method of FIG. 11, in step 1110 the second stage valve 1700 is deployed inside the pocket 1216, after the first stage valve 1500 was removed from the pocket 1216, as shown in FIG. 18. The second stage valve 1700 is configured to receive the pressured gas at port 1732, from annulus B, and to discharge the same at port 1742, into annulus A. Arrows 1740A (see FIG. 17A), 1740B and 1740C (see FIG. 18) show the path of the pressured gas, from the annulus B, through the second valve 1700 and then into the annulus A (while arrows 1740A, 1740B, 1740C and 1540C show the path of the pressured gas, from the annulus B, through the second valve 1700 and then into the annuli A and C). The oil that is present in annulus A is then aerated by the pressured gas, which results in a reduced density of the oil, and thus the oil is lifted to the surface in step 1112, through annulus A, during this tubing lift stage.

The method illustrated in FIG. 11 is advantageous over the existing methods because it does not require the removal of the tubing system for changing from annular lift to tubular lift. In addition, the novel tubing system can be reconfigured to provide other types of gas flow, not only from B to C and from B to A, but for example from B to both A and C. Furthermore, for changing from one gas lift stage to another gas lift stage, only the valve housed by the joint pipe mandrel needs to be changed, which can be performed with a wire line or a slick line. Changing the first valve 1500 with the second valve 1700 can be achieved in a matter of hours, not days as in the present methods. The first and second valves illustrated in FIGS. 15 and 17A-17B are exemplary. Those skilled in the art could use other valves for achieving the change in gas flow. Although FIG. 12 showed the joint pipe mandrel 1210 to be located at the end of the tubing system, it is possible to place the same or other joint pipe mandrels at any location along the tubing system. It is also possible to distribute plural joint pipe mandrels along the tubing system.

For example, the joint pipe elements of the embodiments discussed herein can be installed in a well in which a single tubing string extends from the surface to a hanger nipple with an inner sting continuation of the upper tubing string and an additional outer concentric tubing string extending through a casing/outer tubular packer device. The outer tube can be ported above the packer to allow the annulus C to connect either/or to the outer and inner pipes of the joint pipe element extended through the packer to provide for production or well servicing devices to any depth of the well in either vertical or horizontal oriented wellbores.

The disclosed joint pipe elements, when attached to the outer and inner tubular strings of a continuous flow venting chamber pump and installed into a well bore, to any desired depth, provide for gas lift capability for producing fluid/gas from an oil well from initial completion to tertiary condition-life of the well production, in either vertical or horizontal wells. This installation could be run with or without a casing packer.

In one application, the joint pipe element can be combined with a hydraulic reciprocating piston pump, or with a hydraulic venturi "jet" piston pump, or with a hydraulic turbine pump, or with an electrical submersible pump (ESP) to provide for producing fluid/gas from the well bore. In another application, the joint pipe elements discussed herein can be combined with a hydraulic reciprocating piston or hydraulic "jet" pump or electrical submersible pump to produce fluid/gas from a well bore, utilizing gas lift to reduce the discharge pressures of the pump to increase production.

In still another application, the plural joint pipe elements may be installed below a single tubing string with a ported inlet device to provide communication from the casing conduit to the B annular conduit above a packer device, which isolates the upper casing area from the lower casing area. This extends the casing conduit to the lower part of the well providing artificial lift deeper in the well bore.

In yet another application, the plural joint pipe elements may be connected upward to a well head landing bowl and made to be compatible with a casing hangar to provide for well head connections to surface conduits for each of the joint pipe element inner string flow area and outer/inner annular flow areas and a separate casing annular flow area.

While the gas lift method illustrated in FIG. 11 is best fit to be used to lift oil from the well for two different pressure ranges, a first range corresponding to the annular lift stage and a second range corresponding to the tubular lift stage, the method may be further adapted to continue the gas lift even when the pressure of the formation decreases and enters a third range, that extends from the lowest pressure of the second range to almost no pressure. A numerical example is provided for illustrating this point, but the numbers in this example should not be construed as limiting the method or the application of the tubing system that uses joint pipe elements. Suppose that the first pressure range corresponds to an oil production of 600 bfpd or more, the second pressure range corresponds to an oil production of 400 to 600 bfpd, and the third pressure range corresponds to an oil production of 1 to 400 bfpd. As discussed above, the annular lift stage method injects the pressured gas into annulus B and discharges it into annulus C (or both annuli A and C) so that the oil moves to the surface along annulus C. The tubular lift stage method injects the pressured gas into annulus B and discharges it into annulus A so that the oil moves to the surface along annulus A. For the third stage of the life of the well, which is called herein the gas submersible pump (GSP) stage, a gas chamber pump is used together with a GSP valve for further lifting the oil at this low oil pressure.

FIG. 19 illustrates a gas lift tubing system 1900 that is capable to lift oil using a combination of the annular lift stage, the tubular lift stage, and the GSP lift stage. Gas lift tubing system 1900 includes plural joint pipe elements 422 interconnected with one or more of the joint pipe mandrels 1210 discussed above. The joint pipe elements 422 can be connected directly to each other or through connectors 826. As discussed with regard to the method illustrated in FIG. 11, the joint pipe mandrel 1210 together with the first valve 1500 configure the tubing system to perform the annular lift stage. When the first valve 1500 is replaced with the second valve 1700, the joint pipe mandrel 1210 together with the second valve 1700 perform the tubular lift stage. For the third stage, the GSP lift stage, another joint pipe mandrel 1910 (called the GSP mandrel herein) is used together with an accumulation chamber 1921 for lifting the oil from the formation 116. The joint pipe mandrel 1910 and the accumulation chamber 1921 form a chamber pump 1920. An upper standing valve 1930 and a lower standing valve 1940 are also used in conjunction with the chamber pump 1920 to define the accumulation chamber 1921, as discussed later. Note that the casing 202 has perforations 208 next to the formation 116 for receiving the oil from the formation. The GSP mandrel 1910 and the accumulation chamber 1921 are first introduced and then it is discussed how they are used to perform the GSP lift stage. The GSP mandrel 1910 and the accumulation chamber 1921 can be formed as a single unit (i.e., the chamber pump 1920), or they can be formed as two separated units and then attached with a connector 826 as shown in FIG. 19, to achieve the chamber pump 1920. In the following, for simplicity of description, it is assumed that the GSP mandrel 1910 and the accumulation chamber 1921 form a unitary chamber pump 1920. FIG. 19 also shows an isolation bridge 1923 formed at the bottom of the GSP mandrel 1910, which is discussed later.

The GSP mandrel 1910 is shown in FIG. 20 having an outer tube 1914 and an inner tube 1912, that is concentric (at least at the upstream end) to the outer tube 1914. In other words, the upstream end 1910A has two concentric tubes. Because of this configuration, the upstream end 1910A of the GSP mandrel 1910 is compatible with the joint pipe element 422, either directly, or via the connector 826. The term "compatible" is understood to mean that the two concentric pipes of the end of the GSP mandrel connect simultaneously to the two concentric pipes of the joint pipe element or the connector, through a single rotational motion. A pocket 1916 is formed on the outside of the inner tube 1912, for receiving the GSP valve 1960, which is discussed in more detail later. A slot 1919 is formed between the pocket 1916 and the inner tube 1912, similar to the mandrel shown in FIG. 13, for receiving the GSP valve. The isolation bridge 1923 is shown blocking the annulus B, between the GSP mandrel 1910 and the accumulation chamber 1921. In this way, the pressured gas that is injected in the annulus B can enter the annulus B of the accumulation chamber only through the GSP valve 1960.

The downstream end 1910B of the GSP mandrel may be configured to have concentric tubes, as shown in the figure, to connect to the accumulation chamber 1921. The upstream end 1921A of the accumulation chamber 1921 may also be configured to have concentric tubes. The tubes of the accumulation chamber and the GSP mandrel are uninterrupted in this embodiment. However, in one application, they may be made separately and then they are connecting through a single rotational motion to each other. The downstream end 1921B of the accumulation chamber 1921 is configured as an intake. A bottom standing valve 1940 may be installed with a slick line to the accumulation chamber, when necessary. The bottom standing valve 1940 allows the oil 2000 from the casing 202 to enter inside the chamber pump 1920, but prevents it from exiting the accumulation chamber.

The accumulation chamber 1920 also includes a dip tube 1924 that continues the annulus A of the tubing system. The annulus formed between the dip tube 1924 and the shell 1926 of the chamber pump 1920 extends the annulus B of the tubing system to the GSP mandrel. The upper standing valve 1930 is configured to fit either in the annulus A of the GSP mandrel 1910 or into the annulus A of the accumulation chamber 1921. In this embodiment, the upper standing valve 1930 fits into the annulus A of the accumulation chamber, just downstream from the GSP mandrel. FIG. 20 also shows plural perforations 208 formed into the casing 202 around the chamber pump 1920. Oil from the formation enters the casing 202 through the perforations 208 and floods the accumulation chamber 1921 of the chamber pump 1920.

GSP valve 1960, upper standing valve 1930 and lower standing valve 1940 are removable from their positions. This means that the GSP valve 1960, the upper standing valve 1930, and the lower standing valve 1940 can be deployed with a slick line at their locations shown in FIG. 20 when necessary (usually during the GSP gas lift stage). As will be discussed later, for the annular lift stage and the tubing lift stage, there is no need for the GSP valve and the upper and lower standing valves, and thus, these valves are not present during the annular lift and the tubing lift stages. However, when the tubing system is reconfigured for the GSP lift stage, the presence of the GSP valve 1960, the upper standing valve 1930, and the lower standing valve 1940 is desired. These three valves can be deployed inside the tubbing system using a slick line or other similar device. There is no need to remove the tubbing system for having these three valves installed.

The GSP valve 1960 and the upper and lower standing valves 1930 and 1940 are now discussed in turn. FIGS. 21A and 21B illustrate the GSP valve 1960. The valve has a body 2102 that extends along the longitudinal axis X. The body has three external seals 2104, 2106 and 2108, which fluidly isolate the regions between the seals when the GSP valve is placed in the GSP mandrel. The region between the first seal 2104 and the second seal 2106 has two ports 2110 and 2112. In the initial position, the first port 2110 is open and the second port 2112 is closed by a sleeve 2120. A spring 2122 is connected to the sleeve 2120 and configured to bring it back to the closed position, after being moved downstream, as discussed later. When the pressured gas is available at the first port 2110 (which communicates with annulus B of the GSP mandrel 1910), it enters inside the upper part of the body 2102, along path 2130A, and then follows an internal path 2130B, along the upstream direction, and allows the gas to exit the valve 1960 at the upstream end 1960A, at port 2118. This port is configured to communicate with the annulus A of the GSP mandrel, as will be discussed later. The pressured gas also acts on the bellows 2124 (for example, through pilot port 2125, which opens to annulus B) and makes the sleeve 2120 to move downstream, opening the second port 2112 and closing the third port 2114. At this time, the pressured gas enters inside the body 2102 through the second port 2112 and follows the second path 2130C toward the downstream end 1960B of the GSP mandrel 1960. The pressured gas is then following path 2130D, via the fourth port 2116, outside the valve. This gas path will be used to purge the accumulation chamber, as discussed later.

When the pressure of the gas is lowered, the bellows 2124 cuts the supply of gas to the sleeve 2120, and the spring 2122 brings the sleeve back to the close position, where the second port 2112 is closed and the third port 2114 is open. For this situation, as shown in FIG. 21B, the incoming pressured gas still follows path 2130A into the valve, and then exits along path 2130B into the annulus A of the GSP mandrel. However, because sleeve 2120 is closing the second port 2112, the pressurized gas from the chamber pump is vented along path 2130E into the valve, through the fourth port 2116 and then allowed to exit along path 2130F into the annulus C.

The upper standing valve 1930 is shown in FIG. 22 and has a body 2202 that has an external seal 2204. The upper standing valve 1930 has a bore 2206 that is in fluid communication with annulus A when the valve is deployed. A ball 2210 is located inside the bore 2206 and is biased with a spring 2212 against a seat 2214, to prevent a fluid to move from the upstream end 1930A to the downstream end 1930B. However, a fluid can move from the downstream end toward the upstream end. The lower standing valve 1940 can have the same structure as the upper standing valve 1930. One skilled in the art would understand that other check valves may be used as the upper or lower standing valves.

For the upper standing valve 1930, FIG. 22 also shows a bleeding channel 2220 formed between the bore 2206 and the outside of the valve. This channel is not necessary for the lower standing valve 1940. A strip valve 2222 is attached with a screw 2224 for allowing the fluid from the bore to exit the valve, but not allowing the fluid from outside the valve to enter inside the bore. Note that the strip valve 2222 and the screw 2224 are optional. In one application, a sized orifice may be used to replace the strip valve. The bleeding channel 2220 is used to implement pressured gas relief from annulus A to annulus B during a stage when oil is flowing from the formation into the pump chamber, as discussed later. The upper and lower standing valves are open at both the upstream end 1930A and the downstream end 1930B. The seal 2204 is configured to tightly fit in a receiving seat formed inside of either the GSP mandrel 1910 or the accumulation chamber 1921 so that fluid does not passes at the interface between the valve and the mandrel or chamber pump.

A GSP gas lift method is now discussed with regard to FIG. 23. FIGS. 24A to 24D illustrate the various flows of the gas and oil through the tubbing system 1900. Note that the tubing system 1900 is formed of plural joint pipe elements, mandrels, and connectors that together form the inner tubular string 402 and the outer tubular string 404. The inner and outer tubular strings extend all the way from the top head of the well to the chamber pump 1920. In step 2300, the tubing system 1900 is lowered into the well (casing 202). The tubing system 1900 is assembled, piece by piece, at the surface, and slowly lowered into the well. The tubing system 1900 includes, as previously discussed, a) joint pipe elements 422, b) connectors 826, c) at least one joint pipe mandrel 1210, d) one GSP mandrel 1910, and e) an accumulation chamber 1920. The method discussed with regard to FIG. 11 explained how the annular lift and the tubular lift stages are implemented using the one or more joint pipe mandrels 1210 and corresponding first and second stage valves 1500 and 1700. As also previously discussed, when the pressure of the oil formation is lower than a third threshold (e.g., 400 bfpd), the tubing system can be configured to start the GSP lift method. However, note that if the pressure in the oil formation is high enough to force the oil get to the surface unassisted (natural flow), the tubing system noted above still may be used to recover the oil.

Figure 24A:
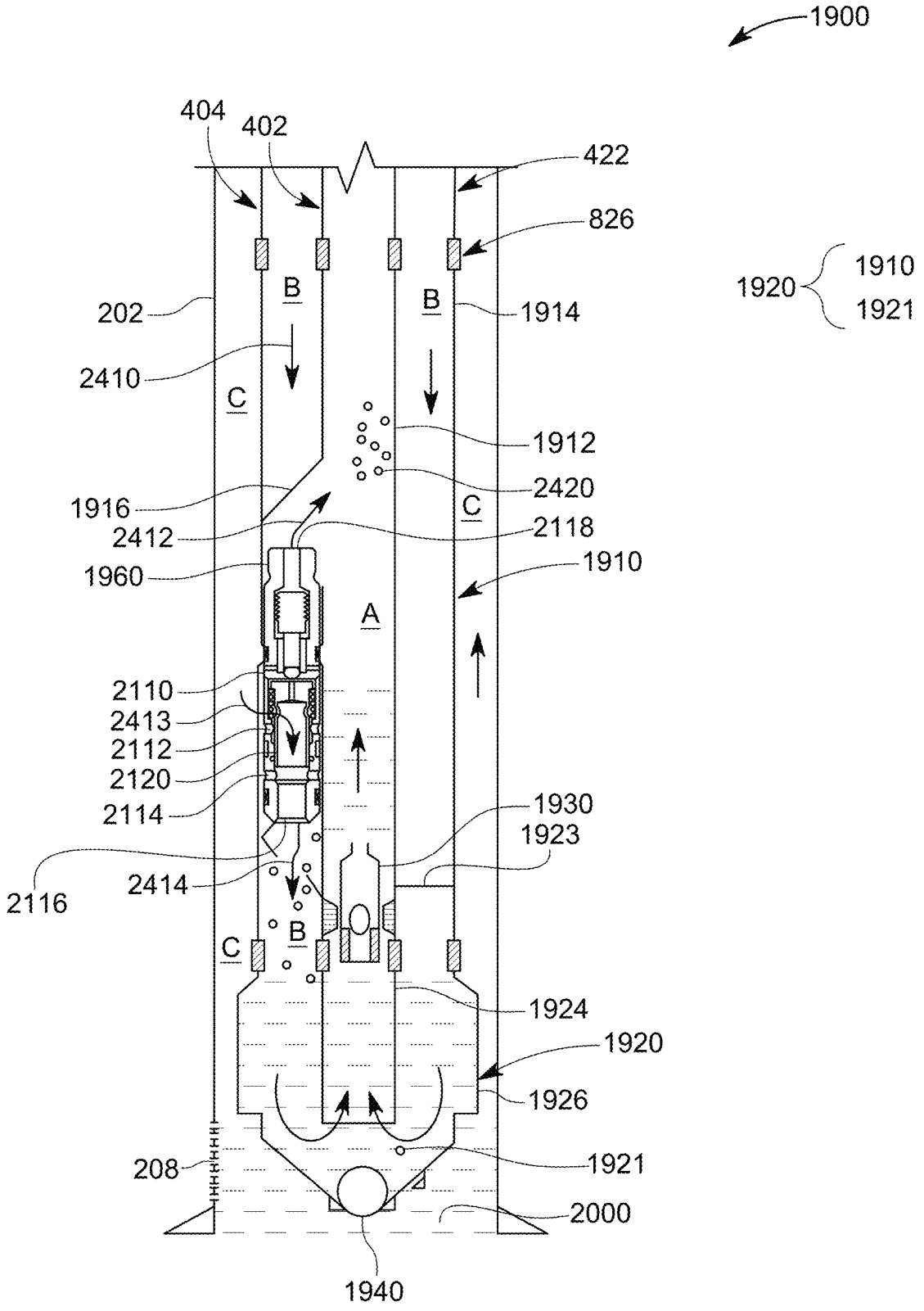

After the natural flow stage, the tubing system 1900 may be used for annular lift and tubular lift as discussed according to FIG. 11. When the well is toward its end of life, i.e., the oil pressure in the formation is small and the annular lift or tubular lift are not efficient, then the tubular system needs to be reconfigured to implement the GSP gas lift method. It is noted that for the annular lift and/or tubular lift, the GSP valve 1960 is not present (instead a dummy valve is present to seal the ports in the GSP mandrel 1910), and also the upper and lower standing valves 1930 and 1940 are not present. Thus, in step 2302, the dummy valve is removed with a slick line from the GSP mandrel 1910 and the GSP valve 1960 is lowered into the GSP mandrel as illustrated in FIG. 24A. Further, in step 2304, the lower standing valve 1940 is deployed at the intake of the collection chamber 1961, and the upper standing valve 1930 is deployed into the annulus A of the tubing system, as also shown in FIG. 24A. All valves are deployed through annulus A using a slick line or similar tool. Then, in optional step 2306, the first or second valve that is present in the joint pipe mandrel 1210 is replaced with a dummy valve for sealing the ports of the joint pipe mandrel. Alternatively, the valve in the joint pipe mandrel 1210 may be replaced with the second valve so that further pressured gas from annulus B is injected into annulus A, through which the oil is lifted to the surface.

At this stage, the tubing system is ready to lift the oil with the GSP gas lift method. For this to happen, a compressor or other surface device starts pumping in step 2308 a compressed gas 2420 through annulus B in FIG. 24A. The compressed gas follows the path indicated as 2410 through the annulus B of the joint pipe element 422 and then into the GPS mandrel 1910. Note that the GPS mandrel 1910 may have various ports, between annulus B and annulus A, annulus A and annulus C or annulus B and annulus C, similar to the joint pipe mandrel 1210 showed in FIGS. 14A to 14I. The compressed gas then enters the GSP valve 1960, at port 2110. The gas continues through the upper part of the GSP valve 1960 (as discussed with regard to FIGS. 21A and 21B) and exits the GSP valve 1960 at port 2118, as indicated by path 2412. This pressurized gas mixes with the oil present in the annulus A of the GSP mandrel 1910 and reduced its density so that the oil could be lifted to the surface.

Figure 24B:
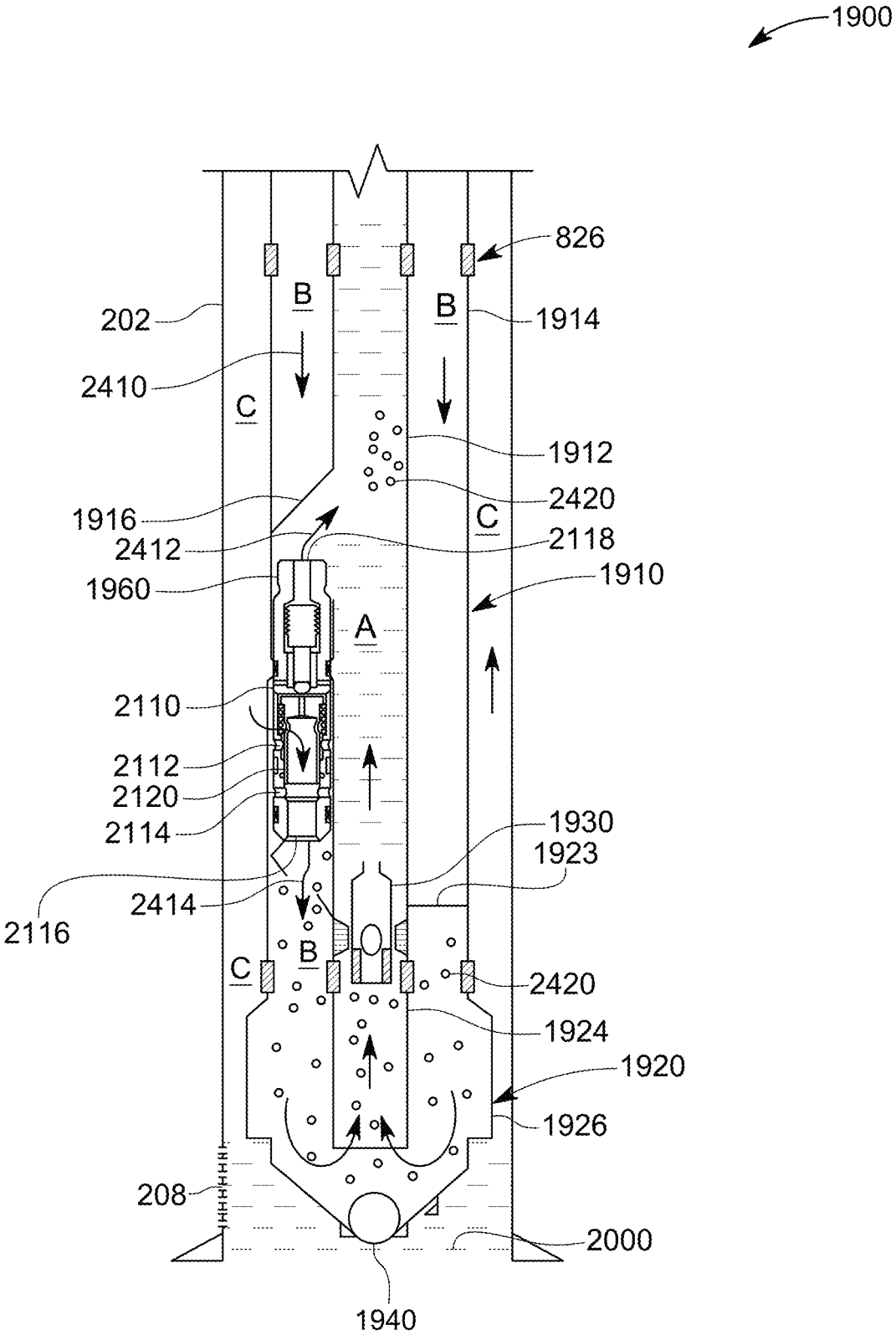

At the same time, part of the pressurized gas moves downstream toward the sleeve 2120 of the GSP valve 1960 and opens port 2112, as discussed above with regard to FIGS. 21A and 21B. Thus, part of the compressed gas travels now from annulus B through the lower part of the GSP valve, along path 2413, and exits at port 2116 along path 2414, into the annulus B of the accumulation chamber 1921 (see FIG. 24A). The oil 2000 that has entered the accumulation chamber 1921 of the chamber pump 1920 starts to be pushed up the chamber annulus A by the pressurized gas and also because the pressurized gas is continuously injected into annulus A at the top of the GSP valve 1960, which reduces the density of the oil. At this time, due to the pressures in the chamber pump, the lower standing valve 1940 is closed and the upper standing valve 1930 opens to allow the oil from the chamber pump to travel upstream, as illustrated in FIG. 24B. This stage is called the purge stage as the accumulation chamber is purged of the accumulated oil. Note that FIG. 24B shows that practically all the oil from the chamber pump 1920 has been moved upstream along annulus A.

Figure 24C:
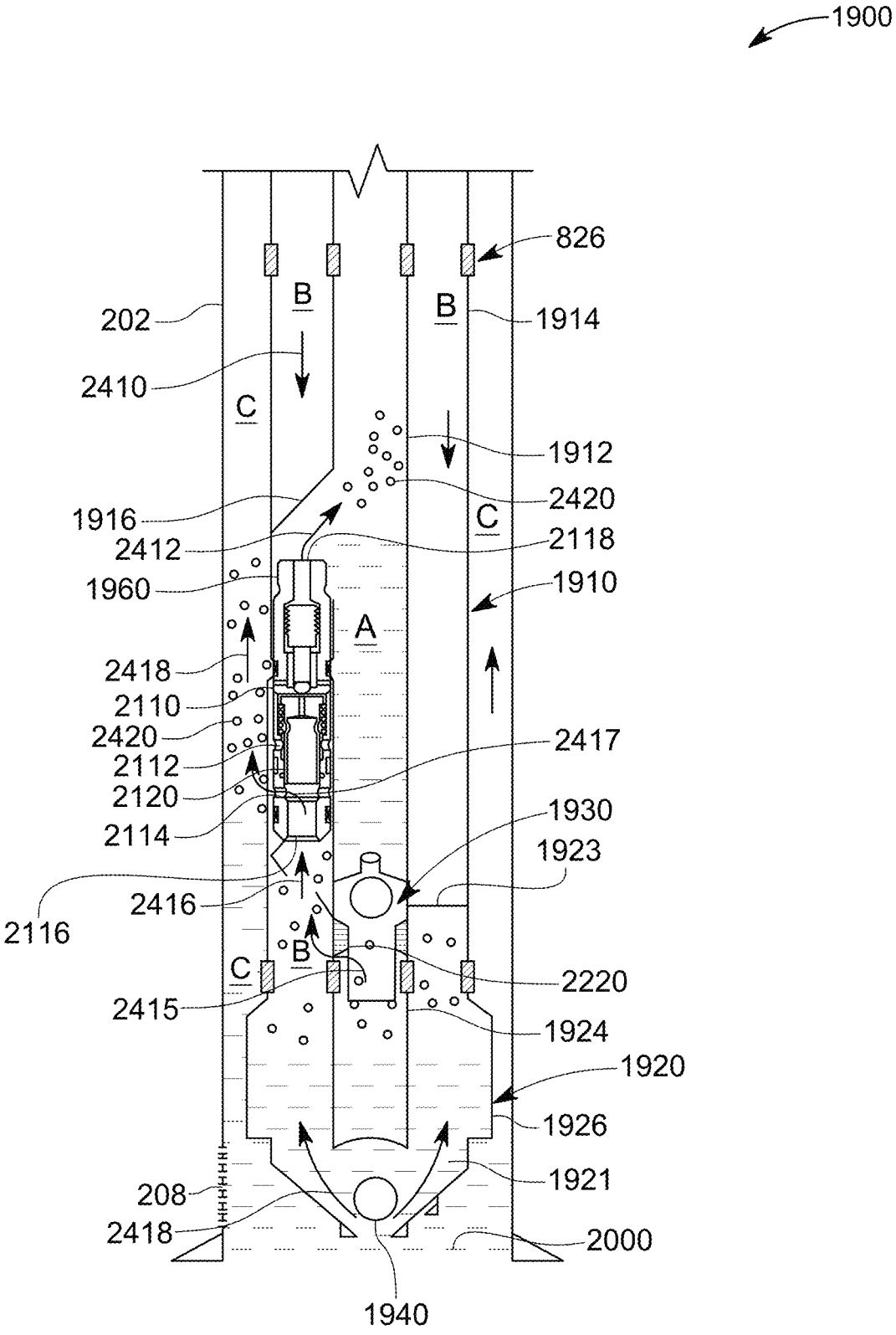
Figure 24D:
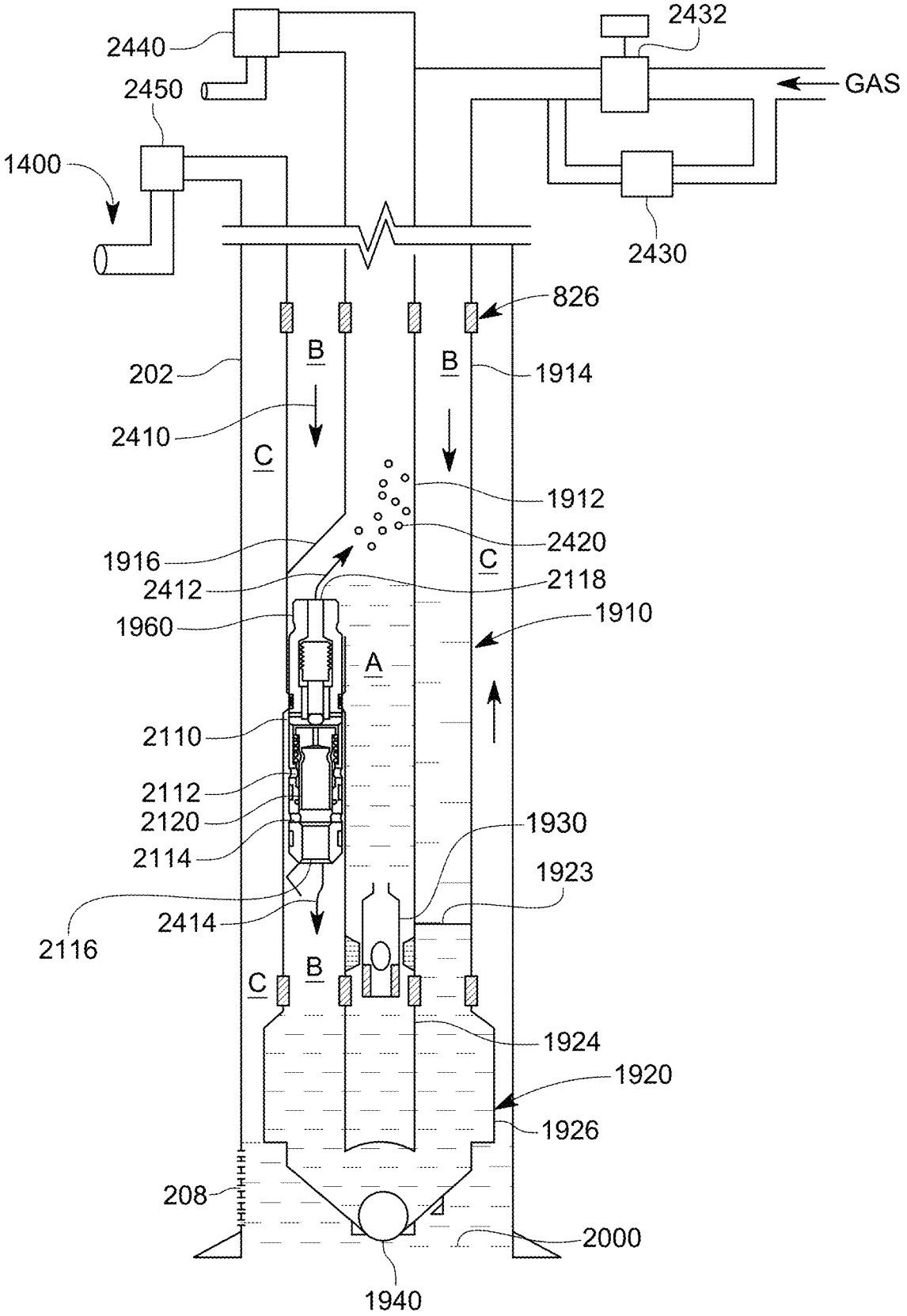

Next the tubing system enters the vent stage. During this stage, the pressure of the pressurized gas is reduced in step 2310, to force the GSP valve 1960 to close the second port 2112 and open the third port 2114, as shown in FIG. 24C, so that the pressurized gas is prevented from entering the chamber pump. Instead, because the third port 2114 is now open, the pressurized gas that accumulated in the chamber pump 1920 is able to escape along path 2415, through the bleeding passage 2220 of the top standing valve 1930, into the annulus B of the chamber pump and from annulus B, along the paths 2416 and 2417, through the lower part of the GSP valve 1960, into the annulus C (FIG. 21B shows this path as 2130E and 2130F). In this way, the pressured gas from the chamber pump is allowed to exit (vent) to annulus C and then to move upward along path 2418 to the surface of the well. At the same time, the oil 2000 from the formation is allowed to enter inside the chamber pump along path 2418, to replenish the accumulation chamber 1921, as the lower standing valve 1940 is now open. The venting stage continues until the accumulation chamber 1921 of the chamber pump 1920 is again full of oil, when the steps 2308 and 2308 are repeated for purging the accumulation chamber.

Note that through each stage discussed above, the pressurized gas is continuously pumped into annulus A along path 2412. Also note that for the tubing system discussed with regard to FIGS. 23A to 24D, there is no need to place a packer anywhere along the well, casing, the inner tubular string or the outer tubular string. This is so because of the advantageous configuration of the tubing system having the outer and inner tubular strings ported at various points.

To be able to control the pressure of the pressured gas 2420, an injection choke device 2430 (schematically shown in FIG. 24D) may be connected to annulus B. Another injection choke device with a timer (motor valve) 2432 may be installed in parallel for adding extra pressured gas at desired times. A production choke device 2440 may be connected to annulus A for receiving the oil, and a choke device 2450 may be connected to annulus C for receiving the vapor and/or the oil from annulus C during the annular flow stage and chamber purge stage of GSP.

Steps of the methods discussed above with regard to FIGS. 11 and 23 may be combined in any way as fit for gas lift operations. For example, as illustrated in FIG. 25, a method for artificial gas lift of a fluid from a well includes a step 2500 of lowering a tubing system 1900 into the well 202, wherein the tubing system 1900 includes an inner tubular string 402, and an outer tubular string 404 disposed concentrically around the inner tubular string 402, a step 2502 of selecting, based on a flow amount of the fluid from the well, an artificial gas lift process, a step 2504 of reconfiguring the tubing system 1900, while in the well 202, to implement the selected artificial gas lift process, and a step 2506 of lifting the fluid to the surface with the selected artificial gas lift process.

The selected artificial gas lift process is one of an annular lift process, a tubular lift process, and a gas submersible pump lift process. The annular lift process pumps a pressured gas along an annulus B, formed between the inner tubular string and the outer tubular string, and lifts the fluid along an annulus C, which is formed between the outer tubular string and a wall of the well. The tubular lift process pumps the pressured gas along the annulus B, and lifts the fluid along an annulus A, which is a bore of the inner tubular string. The gas submersible pump lift process injects the pressured gas along the annulus B from an accumulation chamber, lifts the fluid along the annulus A, and also releases part of the pressured gas into the annulus A to reduce a density of the fluid. The annular lift process is implemented when a production rate of the fluid is in a first artificial lift range, the tubing lift process is implemented when the production rate of the fluid is in a second range, lower than the first range, and the gas submersible pump lift process is implemented when the production rate of the fluid is in a third range, lower than or equal to the second range.

The method may also include a step of seating a first valve into a joint pipe mandrel, wherein the first valve is configured to direct a flow of the pressured gas from annulus B to annulus C, and the joint pipe mandrel is integrated into the inner tubular string, and/or replacing the first valve with a second valve in the joint pipe mandrel, by using a slick line, where the second valve is configured to direct the flow of the pressured gas from the annulus B to the annulus A, and/or placing a third valve into a chamber pump located at a distal end of the tubing system, wherein an upper part of the third stage valve is configured to direct a portion of the flow of the pressured gas from the annulus B to the annulus A, and a lower part of the third valve is configured to direct another portion of the flow of the pressured gas from the annulus B to an accumulation chamber of the chamber pump, and/or adding with the slick line a bottom standing valve to the chamber pump; and adding with the slick line an upper standing valve to the chamber pump, and/or purging the fluid accumulated in the accumulation chamber with the pressured gas so that the fluid is lifted along annulus A; and venting the pressured gas from the accumulation chamber through the upper standing valve, the annulus B, and the third valve into the annulus C.

Each step is performed with no packer and without taking out from the well the tubing system. The tubing system includes plural joint pipe elements that have concentric pipes.

According to another method illustrated in FIG. 26, there is a method for artificial gas lift oil from a well and the method includes a step 2600 of lowering a tubing system 1900 into the well 202, where the tubing system 1900 has an annulus A, an annulus B concentric to the annulus A, and an annulus C, formed between the tubing system 1900 and the well 202, a step 2602 of seating a first valve 1500 into a joint pipe mandrel 1210, which is integrated in the tubing system 1900, the first valve being configured to direct a pressured gas from annulus B to annulus C for annular lifting of the oil, and a step 2604 of replacing the first valve 1500 with a second valve 1700 into the joint pipe mandrel 1210, the second valve being configured to direct the pressured gas from annulus B to annulus A for tubing lifting of the oil.

The tubing system 1900 includes an inner tubular string 402 and an outer tubular string 404, the outer tubular string being concentrically located around the inner tubular string. The tubing system includes plural joint pipe elements, each joint pipe element having two concentric pipes.

The method further includes attaching a first joint pipe element to a second joint pipe element with a single rotational motion, and/or attaching a first joint pipe element to a connector with a single rotational motion and attaching the connector to a second joint pipe element with another single rotational motion, and/or seating a third valve 1960 into a gas submersible pump mandrel 1910 of a chamber pump 1920, attached to a distal end of the tubing system, to direct the pressured gas partially into the annulus A of the gas submersible pump mandrel and partially into a chamber pump to push the oil from the chamber pump along the annulus A, and/or reducing a pressure of the pressured gas, to continue to direct the pressured gas into the annulus A of the gas submersible pump mandrel, and to allow gas built up in the chamber pump to vent to the annulus C. The gas built up in the chamber pump vents first to the annulus B, then through the third valve, and into the annulus C.

The method may further include a step of seating a bottom standing valve at an intake of the chamber pump, and/or seating a top standing valve downstream the gas submersible pump mandrel. A shell of the chamber pump, the top standing valve and the bottom standing valve define an accumulation chamber. The method may also include a step of continuously releasing the pressured gas in the annulus A; intermittently purging the accumulation chamber of oil; and intermittently venting the accumulation chamber of the pressured gas. The step of intermittently purging pushes the oil along the annulus A and the step of intermittently venting the pressured gas into the annulus C.

In yet another embodiment, which is illustrated in FIG. 27, there is a method for artificial gas lift oil from a well that includes a step 2700 of installing, with no packer, a dual, concentric, tubing system 1900 into the well 202, a step 2702 of lowering, through the dual, concentric, tubing system 1900, a valve, a step 2704 of pumping a pressured gas into a first annulus of the dual, concentric, tubing system 1900, and a step 2706 of directing the pressured gas from the first annulus, through the valve, into a second annulus or a third annulus, depending of the lowered valve.

The dual, concentric, tubing system has an inner tubular string and an outer tubular string, that is concentrically located around the inner tubular string. The first annulus corresponds to a space between the inner tubular string and the outer tubular string, the second annulus corresponds to a bore of the inner tubular string, and the third annulus corresponds to a space between the outer tubular string and a wall of the well. The valve fluidly communicates the first annulus to the second annulus.

The method may also include a step of replacing the valve with another valve, while the tubing system is in the well, so that the another valve fluidly communicates the first annulus to the third annulus, and/or establishing an accumulation chamber at a distal end of the tubular system, by seating an upper standing valve and a lower standing valve at the distal end, into the second annulus, and/or seating a gas submersible pump valve into a mandrel of a chamber pump, that includes the accumulation chamber, for partially directing the pressured gas from the first annulus to the second annulus, and partially directing the pressured gas into the accumulation chamber for pushing the oil along the second annulus, and/or decreasing a pressure of the pressured gas to cut off a purging of the accumulation chamber due to the pressured gas.

Note that the tubing system including joint pipe elements is advantageous for its efficiency and simplicity in use. Previously, the operator of the well had to lower one by one, each of the outer pipes and to connect each of them to the previous one to form the outer tubular string. Then, the operator of the well had to lower one by one, each of the inner pipes and to connect each of them to the previous one to form the inner tubular string. The inner tubular string had to be lowered inside the outer tubular string, which added more complications as the inner tubular string contacts the outer tubular string during this operation. A large friction force between the outer tubular string and the inner tubular string had to be overcome, especially for long and horizontal wells.

In addition, for changing the gas lift from one stage to another, the current methods require the entire tubing system to be taken out of the well, appropriate valves to be replaced, and then to lower again the entire tubing system into the well. This procedure is not only time consuming, but also expensive.

In contrast to these painstakingly slow methods, the operator of the well, when equipped with the novel tubing system that includes joint pipe elements, mandrels, and valves as discussed above, connects at the same time, the inner pipes to the outer pipes, and in addition, there is no need to push the inner tubular string relative to the outer tubular string as the two strings are generated at the same time, with a single rotational movement of one joint pipe element to another joint pipe element. Further, the operator can reconfigure the flow of the pressured gas through the tubing system as desired without taking out of the well the tubing system, by only placing one or more valves into corresponding mandrels.

Some of the embodiments discussed above can be structured as follow.

Whole System and Valves

1. A tubing system (1900) for lifting a fluid from a well, the tubing system (1900) including: an inner tubular string (402); an outer tubular string (404) disposed concentrically around the inner tubular string (402); a joint pipe mandrel (1210) having an inner pipe and an outer pipe; and a chamber pump (1920), wherein the inner pipe and the outer pipe of the joint pipe mandrel (1210) attach simultaneously to the inner and outer tubular strings (402, 404), respectively, by a single rotational motion.

2. The tubing system of paragraph 1, wherein the inner tubular string (402) defines an annulus A, that extends through an inner part of the joint pipe mandrel (1210) and also through the chamber pump (1920), and wherein the outer tubular string (404) defines (1) an annulus B with the inner tubular string (402), and the annulus B extends through the joint pipe mandrel (1210) and also through the chamber pump, and (2) an annulus C with a wall of the well.
3. The tubing system of paragraph 2, wherein the inner tubular string and the outer tubular string are made from connected joint pipe elements, each joint pipe element having each end made of two concentric pipes.
4. The tubing system of paragraph 3, wherein the joint pipe mandrel has ends of the inner and outer pipes disposed concentric to each other.
5. The tubing system of paragraph 4, wherein the chamber pump has an upstream end made of two concentric pipes.
6. The tubing system of paragraph 5, wherein at least one end of (1) the inner and outer tubular strings, (2) the joint pipe mandrel, and (3) the chamber pump connects with another end of (1) the inner and outer tubular strings, (2) the joint pipe mandrel, and (3) the chamber pump, by a single rotational motion.
7. The tubing system of paragraph 2, wherein the joint pipe mandrel is configured to receive a first valve, which fits in a side pocket of the joint pipe mandrel, and the first valve fluidly connects the annulus B to the annulus C.
8. The tubing system of paragraph 7, wherein the joint pipe mandrel is configured to receive a second valve, which fits in the side pocket, and the second valve fluidly connects the annulus B to the annulus A.
9. The tubing system of paragraph 2, wherein the chamber pump includes: an outer shell that defines an accumulation chamber; and an inner dip tube that extends through the outer shell, wherein the inner dip tube has a bore that extends the annulus A, and wherein the inner dip tube and the outer shell form an annulus that extends the annulus B.
10. The tubing system of paragraph 9, further including: a lower standing valve that closes a bottom end of the accumulation chamber.
11. The tubing system of paragraph 10, further including: an upper standing valve that closes an upper end of the accumulation chamber.
12. The tubing system of paragraph 10, wherein the chamber pump further includes: a gas submersible pump mandrel.
13. The tubing system of paragraph 12, further including: a gas submersible pump valve that seats into the gas submersible pump mandrel.
14. The tubing system of paragraph 13, wherein the gas submersible pump valve is configured to continuously release a pressured gas from the annulus B into the annulus A.
15. The tubing system of paragraph 14, wherein the gas submersible pump valve is configured to fluidly connect the annulus B to the accumulation chamber when the pressured gas has a first pressure, and to fluidly connect the accumulation chamber to the annulus C when the pressured gas has a second pressure, lower than the first pressure.
16. The tubing system of paragraph 11, wherein the upper standing valve has a gas purge channel that fluidly connects the annulus A to the annulus B.
17. A tubing system (1900) for lifting a fluid from a well, the tubing system (1900) including: plural joint pipe elements (422) that form a single annulus A and a single annulus B when connected to each other, wherein the annulus A is fluidly insulated from the annulus B; a joint pipe mandrel (1210) integrated with the plural joint pipe elements; and a chamber pump (1920) connected to a distal joint pipe element of the plural joint pipe elements (422), wherein the chamber pump (1920) is attached to the distal joint pipe element with a single rotational motion so that both annuli A and B are extended through the chamber pump (1920).
18. The tubing system of paragraph 17, wherein the chamber pump has an upstream end and a downstream end, the upstream end maintains a fluid separation between annuli A and B while the downstream end fluidly connects the annulus A to the annulus B.
19. The tubing system of paragraph 18, wherein the chamber pump includes: a gas submersible pump mandrel (1910); and an accumulation chamber (1921) connected to each other.
20. The tubing system of paragraph 19, wherein the gas submersible pump mandrel has each end configured to have dual concentric pipes that define annuli A and B.
21. The tubing system of paragraph 20, wherein an upstream end of the gas submersible pump mandrel connects, through a single rotational motion, to a corresponding joint pipe element of the plural joint pipe element or a connector that has two concentric conduits.
22. The tubing system of paragraph 19, wherein the gas submersible pump mandrel has a side pocket located in the annulus B.
23. The tubing system of paragraph 22, wherein the side pocket physically contacts the outer conduit.
24. The tubing system of paragraph 22, further including: a gas submersible pump valve that fits into the side pocket.
25. The tubing system of paragraph 24, wherein the gas submersible pump valve is configured to continuously direct a pressured gas from annulus B to the annulus A.
26. The tubing system of paragraph 25, wherein the gas submersible pump valve is configured to fluidly connect the annulus B to the accumulation chamber when the pressured gas has a first pressure, and to fluidly connect the accumulation chamber to the annulus C when the pressure gas has a second pressure, lower than the first pressure.
27. The tubing system of paragraph 17, wherein the chamber pump is configured to receive, through annulus A, an upper standing valve that has a gas purge channel that fluidly connects the annulus A to the annulus B.
28. The tubing system of paragraph 17, wherein the joint pipe mandrel has a side pocket that extends into the annulus B.
29. The tubing system of paragraph 28, further including: a first valve that sits in the side pocket of the joint pipe mandrel and fluidly connects the annulus B to the annulus C.
30. The tubing system of paragraph 29, further including: a second valve that fits in the side pocket of the joint pipe mandrel and fluidly connects the annulus B to the annulus A.
31. An upper standing valve (1930) that closes an upper end of an accumulation chamber used to lift a fluid from a well, the upper standing valve including: a body (2202) extending along a longitudinal axis and having a bore (2206); a ball (2210) located in the bore (2206) for blocking a fluid flow in one direction but not in an opposite direction; an external seal (2204); and a bleeding passage (2220) formed in a wall of the body (2202) and configured to fluidly connect the bore (2206) to an exterior of the body.

32. The upper standing valve of paragraph 31, wherein the bleeding passage is located between the ball and a downstream end of the body.
33. The upper standing valve of paragraph 32, further including: a strip valve (2222) that closes the bleeding passage.
34. The upper standing valve of paragraph 33, wherein the strip valve is configured to allow a fluid from the bore to bleed outside the body, but prevents a fluid from outside to enter the bore.
35. The upper standing valve of paragraph 31, further including: a spring that biases the ball toward the bleeding passage.
36. A tubing system (1900) for lifting a fluid from a well, the tubing system (1900) including: an inner tubular string (402); an outer tubular string (404) disposed concentrically around the inner tubular string (402); and a joint pipe mandrel (1210) having an inner pipe and an outer pipe; and wherein the inner pipe and the outer pipe of the joint pipe mandrel (1210) attach simultaneously to the inner and outer tubular strings (402, 404), respectively, by a single rotational motion.
37. The tubing system of paragraph 36, wherein the inner tubular string (402) defines an annulus A, that extends through an inner part of the joint pipe mandrel (1210), and wherein the outer tubular string (404) defines (1) an annulus B with the inner tubular string (402), and the annulus B extends through the joint pipe mandrel (1210), and (2) an annulus C with a wall of the well.
38. The tubing system of paragraph 37, wherein the inner tubular string and the outer tubular string are made from connected joint pipe elements, each joint pipe element having each end made of two concentric pipes.
39. The tubing system of paragraph 38, wherein the joint pipe mandrel has ends of the inner and outer pipes disposed concentric to each other.
40. The tubing system of paragraph 39, further including: a chamber pump connected to the joint pipe mandrel.
41. The tubing system of paragraph 40, wherein the chamber pump has an upstream end made of two concentric pipes.
42. The tubing system of paragraph 41, wherein at least one end of (1) the inner and outer tubular strings, (2) the joint pipe mandrel, and (3) the chamber pump connects with another end of (1) the inner and outer tubular strings, (2) the joint pipe mandrel, and (3) the chamber pump, by a single rotational motion.

Mandrels

1. A joint pipe mandrel (1210) to be integrated into a tubing system (1900) for lifting oil from a well, the joint pipe mandrel including: an inner conduit (1212) extending along a longitudinal axis X and having an annulus A; an outer conduit (1214) that extends along the longitudinal axis X and is located around the inner conduit (1212) so that an annulus B is formed between the inner conduit (1212) and the outer conduit (1214); and a side pocket (1216) attached to the inner conduit (1212) and located in the annulus B.
2. The joint pipe mandrel of paragraph 1, wherein an upstream end of the inner conduit and an upstream end of the outer conduit are concentric.
3. The joint pipe mandrel of paragraph 2, wherein the upstream end of inner conduit has a first thread and the upstream end of the outer conduit has a second thread, and the first and second threads have a same pitch.
4. The joint pipe mandrel of paragraph 2, wherein a downstream end of the inner conduit and a downstream end of the outer conduit are concentric.
5. The joint pipe mandrel of paragraph 4, wherein the downstream end of inner conduit has a first thread and the downstream end of the outer conduit has a second thread, and the first and second threads have a same pitch.
6. The joint pipe mandrel of paragraph 1, wherein the inner conduit has a slot (1219) that extends along the longitudinal axis, and fluidly communicates the annulus A with a bore of the side pocket.
7. The joint pipe mandrel of paragraph 6, wherein the slot extends along the longitudinal axis X so that a valve passes from annulus A into the side pocket through the slot.
8. The joint pipe mandrel of paragraph 1, wherein a first part of the inner conduit is shaped as a closed cylinder, and a first part of the outer conduit is shaped as a closed cylinder; a second part of the inner conduit is shaped as a partial cylinder, a first part of the side pocket is shaped as a partial cylinder, and a second part of the outer conduit is shaped as a closed cylinder; a third part of the inner conduit is shaped as a closed cylinder, a second part of the side pocket is shaped as a partial cylinder, and the third part of the outer member is shaped as a closed cylinder; a fourth part of the inner conduit is shaped as a closed cylinder, a third part of the side pocket is shaped as a partial cylinder, and a fourth part of the outer conduit is shaped as a partial cylinder; and a fifth part of the inner conduit is shaped as a partial cylinder, a fourth part of the side pocket is shaped as a partial cylinder, and a fifth part of the outer conduit is shaped as a closed cylinder.
9. The joint pipe mandrel of paragraph 1, wherein there is an open slot between a bore of the side pocket and the annulus A through which a valve is deployed inside the pocket, there is a port between the bore and the annulus B, there is a port between the bore and an outside of the outer conduit, and there is a port between the bore and the annulus A.
10. The joint pipe mandrel of paragraph 1, wherein the side pocket is welded to the inner member.
11. The joint pipe mandrel of paragraph 10, wherein the pocket is also welded to the outer member.
12. The joint pipe mandrel of paragraph 1, further including: a first valve (1500) that seats in the side pocket and fluidly connects an outside of the outer conduit to the annulus B.
13. The joint pipe mandrel of paragraph 12, further including: a second valve (1700) that seats in the side pocket and fluidly connects the annulus B to the annulus A.
14. A chamber pump (1920) for lifting a fluid to the surface, from a well, the chamber pump (1920) including: a gas submersible pump mandrel (1910); and an accumulation chamber (1921) attached to the gas submersible pump mandrel (1910), wherein the gas submersible pump mandrel (1910) has dual concentric pipes at an upstream end (1910A).

15. The chamber pump of paragraph 14, wherein the gas submersible pump mandrel includes: an inner tube defining an annulus A; and an outer tube, wherein the inner tube is fully encircled by the outer tube and outer tube and the inner tube define an annulus B.
16. The chamber pump of paragraph 15, wherein the gas submersible pump mandrel includes: a side pocket attached to the inner tube and located in the annulus B.
17. The chamber pump of paragraph 16, wherein the side pocket has a first port that fluidly communicates with the annulus B, a second port that also fluidly communicates with the annulus B, a third port that fluidly communicates with an annulus C, which is formed between the outer tube and the well, and a fourth port that fluidly communicates with the annulus B.
18. The chamber pump of paragraph 16, wherein there is a slot between the side pocket and the inner tube so that a valve is translated from the inner tube into the side pocket.
19. The chamber pump of paragraph 16, further including: a gas submersible pump valve that seats in the side pocket and fluidly and continuously connects the annulus B to the annulus A.
20. The chamber pump of paragraph 19, wherein the gas submersible pump valve is also configured to intermittently and fluidly connect the annulus B with an annulus B of the accumulation chamber.
21. The chamber pump of paragraph 20, wherein the gas submersible pump valve is also configured to intermittently and fluidly connect the annulus B of the accumulation chamber to an annulus C, which is formed between the outer member and the well.
22. The chamber pump of paragraph 15, wherein the accumulation chamber includes: a dip tube extending along a longitudinal axis; and a shell that completely encircles the dip tube, wherein the dip tube is connected to the annulus A and an annulus defined by the dip tube and the shell is fluidly connected to the annulus B.
23. The chamber pump of paragraph 22, further including: a bottom standing valve that is configured to be lowered through the annulus A and seat into an intake of the accumulation chamber, the bottom standing valve being configured to allow the fluid to enter the accumulation chamber but not to exit the accumulation chamber.
24. The chamber pump of paragraph 23, further including an upper standing valve that is configured to be lowered through the annulus A and seat into the accumulation chamber, the upper standing valve being configured to allow the fluid to move upward along the annulus A, but not back into the accumulation chamber.
25. The chamber pump of paragraph 24, wherein the upper standing valve has a bleeding passage formed in a wall and configured to fluidly connect a bore of the valve to the annulus B of the accumulation chamber.
26. The chamber pump of paragraph 25, wherein the bleeding passage is located between a ball located inside the bore of the valve and a downstream end of the valve.
27. The chamber pump of paragraph 24, wherein the upper standing valve defines an upstream end of the accumulation chamber and the bottom standing valve defines the downstream end of the accumulation chamber.

Further phase lift operational procedures may be summarized as follow:

1. Well is free flowing:
   a. Open valves at surface and produce from A and C. This uses the maximum flow area.
   b. As velocity drops, close tubing A at surface (tubing C has a larger area than tubing A).
   c. As velocity drops more, close tubing C and open tubing A.
2. Artificial Lift is required: Produce from A and C.
   a. Unloading valves that port gas into chamber A and C are wireline installed.
   b. Assume surface compressors are limited to 1,500 psi.
   c. Unloading valves are spaced such that they will open and lighten the column.
   d. When the pressure drops enough, the next unloading valve will open.
   e. The first one will close when the column pressure reduces enough.
   f. The shifting pressures are set so that the unloading valves work the pressure down, so that very high-pressure surface compressors are not required.
   g. Orifices are used on these valves to supply flow stability between the A and C conduits.
   h. In this example: 1,200 psi is being supplied into the lowermost unloading valve. All of the others will eventually be closed.
3. Artificial Lift is required: Produce from C.
   a. To balance the velocity, the flow area might need to be reduced.
   b. Wireline remove the valves, and replace them with those that are ported into the C.
   c. As the column pressure reduces, they are cycled open and closed as before.
4. Artificial Lift is required: Produce from A.
   a. To balance the velocity, the flow area might need to be reduced more.
   b. Wireline remove the valves, and replace them with those that are ported into the A.
   c. As the column pressure reduces, they are cycled open and closed as before.
5. Continuous Lift:
   a. The chamber valve has a venturi orifice which injects gas continuously into the A tubing string.
6. Chamber Pumping:
   a. Even though the column pressure has been reduced, it is not zero. More fluid can be removed if the column pressure is reduced.
   b. Below the upper standing valve (check valve) a 2-position 3-way valve is installed. It is called a chamber valve.
   c. The B chamber below this valve is called B'.
   d. The A chamber below this valve is called A'.
   e. Its default (less than 1,400 psi on B) position has B' venting to C. The B chamber that goes into the chamber valve is closed.
   f. At this instant, the gas in B' is being vented through the chamber valve and into C, it then is vented to at the surface. Thus, C is maintained at the lowest bottom hole pressure.
   g. A small bleed orifice exists between A' and B'. This is used to vent the gas inside A'. This maximizes the fluid volume in chamber A' and B'.
   h. The surface pressure is increased above 1,400 psi (in this case).
   i. The chamber valve shifts.
   j. B pressure now enters B'. C chamber from this valve is closed.
   k. The increased pressure in B' rushes the slug of fluid up and out of A' above the upper standing valve and into A, that becomes a continuous flowing stream to the surface since the column pressure is less than 1,200 psi.

l. The lower standing valve prevents oil from exiting back into the well.

m. A' and B' are now full of gas at ~1,200 psi.

n. Surface pressure is reduced to 1,200 psi.

o. The chamber valve shifts back to default position, shutting off injection gas.

p. The gas in A' and B' vents to C through the chamber valve.

q. A' and B' are now filled with fluid again.

r. Since the surface pressure into B is cycled from 1,200 to 1,400 psi (to control the chamber valve) most of the gas energy in B chamber is conserved and used in the continuous flow stream to the surface.

s. Each cycle of the chamber moves a slug of fluid (~one to three barrels). Thus, pumping rate of up to 1,440 barrels/day.

t. Since the column pressure is blocked with the upper standing valve, and C is vented to the surface, the pressure below the upper standing valve can be nearly zero (separator pressure!). The well can be pumped dry without a packer.

7. Plunger Lift:

a. After the well is drawn down to less than 25 b/d or so, it can be lifted with a plunger.

b. The upper standing valve, the 3-way valve and the venturi are removed. Flow is being blocked from B to C, and from B to A.

c. A plunger is dropped into the A tubing.

d. It falls through the fluid in the A' tubing to maximize the slug volume.

e. Increase pressure in B. Since no valve are installed, the pressure gas goes into B' and to the bottom of the plunger.

f. After slug is lifted, the plunger is latched at the surface. A and B pressure is vented.

g. A' recharges with fluid.

h. The plunger is dropped for the next cycle.

The disclosed embodiments provide methods and systems for artificially gas lift a fluid from a well when the natural pressure of the formation fluid is not enough to bring the formation fluid to the surface. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for artificial gas lift of fluid from a well, the method comprising:

lowering a tubing system into the well, wherein the tubing system comprises an inner tubular string with a central annulus A, an outer tubular string, an annulus B formed between the inner tubular string and the outer tubular string, and an annulus C, formed between the outer tubular string and the well;

seating a first valve into a joint pipe mandrel, which is integrated in the tubing system, the first valve being configured to direct pressured gas from annulus B to annulus C for annular lifting of the fluid; and replacing the first valve with a second valve configured to direct pressured gas from annulus B to annulus A for tubing lifting of the fluid.

2. The method of claim 1, wherein the tubing system includes plural joint pipe elements, each joint pipe element having two concentric pipes.

3. The method of claim 2, further comprising: attaching a first joint pipe element to a second joint pipe element with a single rotational motion.

4. The method of claim 2, further comprising: attaching a first joint pipe element to a connector with a single rotational motion and attaching the connector to a second joint pipe element with another single rotational motion.

5. The method of claim 1, further comprising:

seating a third valve into a gas submersible pump mandrel (GSPM), said GSPM attached to a distal end of the tubing system and comprising:

an inner tubular string with a central annulus A';

an outer tubular string;

an annulus B' formed between the inner tubular string and the outer tubular string; and an annulus C' formed between the outer tubular string and the well; and directing pressured gas partially into the annulus A' of the GSPM and partially into a chamber pump to push the fluid from the chamber pump along the annulus B'.

6. The method of claim 1, wherein the first valve is also configured to direct pressured gas from annulus B to annulus A.

7. The method of claim 1, wherein each of the first valve and the second valve comprises:

a first seal, a second seal, and a third seal, each seal being configured to sealingly engage an inner surface of the joint pipe mandrel;

a first port disposed between the first seal and the second seal; and a second port disposed between the second seal and the third seal.

8. The method of claim 5, wherein the third valve comprises:

a first seal, a second seal, and a third seal, each seal being configured to sealingly engage an inner surface of the GSPM;

a first port and a second port, each being disposed between the first seal and the second seal; and a third port disposed between the second seal and the third seal.

9. The method of claim 8, wherein the first port is configured to open when exposed to injected gas at a predetermined pressure.

10. The method of claim 9, wherein the third valve further comprises a bellows assembly that is configured to move in an axial direction when exposed to pressured gas flowing through the first port.

11. The method of claim 10, wherein the third valve is configured such that axial movement of the bellows assembly causes the second port to open and the third port to close.

12. The method of claim 5, wherein the GSPM further comprises an upper standing valve disposed between the third valve and the chamber pump.

13. A method for artificial gas lift of fluid from a well, the method comprising:

lowering a tubing system into the well, wherein the tubing system comprises an inner tubular string with a central annulus A, an outer tubular string, an annulus B formed between the inner tubular string and the outer tubular string, and an annulus C, formed between the outer tubular string and the well;

seating a first valve into a gas submersible pump mandrel (GSPM), said GSPM attached to a distal end of the tubing system and comprising:

an inner tubular string with a central annulus A';

an outer tubular string;

an annulus B' formed between the inner tubular string and the outer tubular string; and an annulus C' formed between the outer tubular string and the well;

directing pressured gas partially into the annulus A' of the GSPM and partially into a chamber pump to push the fluid from the chamber pump along the annulus B'.

14. The method of claim 13, wherein the first valve comprises:

a first seal, a second seal, and a third seal, each seal being configured to sealingly engage an inner surface of the GSPM;

a first port and a second port, each being disposed between the first seal and the second seal; and a third port disposed between the second seal and the third seal.

15. The method of claim 14, wherein the first port is configured to open when exposed to injected gas at a predetermined pressure.

16. The method of claim 15, wherein the first valve further comprises a bellows assembly that is configured to move in an axial direction when exposed to pressured gas through the first port.

17. The method of claim 16, wherein the first valve is configured such that axial movement of the bellows assembly causes the second port to open and the third port to close.

18. The method of claim 13, wherein the GSPM further comprises an upper standing valve disposed between the third valve and the chamber pump.

* * * * *